US010351919B2

(12) United States Patent
Larsen et al.

(10) Patent No.: US 10,351,919 B2
(45) Date of Patent: Jul. 16, 2019

(54) SYSTEM FOR DRYING A PELT, A DRYING UNIT, A PELT BOARD AND AN ADAPTOR

(71) Applicant: MINKPAPIR A/S, Holstebro (DK)

(72) Inventors: Johnny Larsen, Aalborg (DK); Soren Frolund, Holstebro (DK); Mogens Fahlgren Andersen, Holstebro (DK); Soren Korsgaard, Lasby (DK)

(73) Assignee: MINKPAPIR A/S, Holstebro (DK)

( * ) Notice: Subject to any disclaimer, the term of this patent is extended or adjusted under 35 U.S.C. 154(b) by 276 days.

(21) Appl. No.: 15/128,669

(22) PCT Filed: Mar. 25, 2015

(86) PCT No.: PCT/EP2015/056431
§ 371 (c)(1),
(2) Date: Sep. 23, 2016

(87) PCT Pub. No.: WO2015/144774
PCT Pub. Date: Oct. 1, 2015

(65) Prior Publication Data

US 2017/0260597 A1 Sep. 14, 2017

(30) Foreign Application Priority Data

Mar. 25, 2014 (EP) ..... 14161481
Mar. 25, 2014 (EP) ..... 14161512
(Continued)

(51) Int. Cl.
*C14B 1/58* (2006.01)
*C14B 15/06* (2006.01)

(52) U.S. Cl.
CPC ..... *C14B 1/58* (2013.01); *C14B 15/06* (2013.01)

(58) Field of Classification Search
CPC ..... C14B 1/58; C14B 15/06; C14B 17/08; C14B 2700/07; A01K 5/00; G05D 1/0278
(Continued)

(56) References Cited

U.S. PATENT DOCUMENTS 1,110,016 A 9/1914 Thorpe
2,493,924 A * 1/1950 Mowad ..... C14B 1/04 69/33
(Continued)

FOREIGN PATENT DOCUMENTS

DK 177480 7/2013
DK 177582 10/2013
(Continued)

OTHER PUBLICATIONS

International Search Report on corresponding PCT application (PCT/EP2015/056431) from International Searching Authority (EPO) dated Jun. 15, 2015.
(Continued)

*Primary Examiner* — Stephen M Gravini
(74) *Attorney, Agent, or Firm* — Klein, O'Neill & Singh, LLP

(57) ABSTRACT

The present invention relates to an elongated pelt board for accommodating an animal pelt. The pelt board comprises a first wall element, a second wall element being spaced apart from the first wall element in the first radial direction, a third wall element and a fourth wall element being spaced apart from the third wall element in a second radial direction. The wall elements together define a cavity along a longitudinal direction. The wall elements defining a contracted state in which the first and second radial distances are reduced, and an expanded state in which the first and second radial distances are increased. The pelt board further comprising an elongated core element being movable in relation to each of
(Continued)

the wall elements. The elongated core element allows the wall elements to selectively define the contracted state or the expanded state by moving the elongated core element in the longitudinal direction.

16 Claims, 55 Drawing Sheets

(30) Foreign Application Priority Data

Dec. 22, 2014 (EP) ..... 14199640
Dec. 22, 2014 (EP) ..... 14199651

(58) Field of Classification Search
USPC ..... 34/103, 105, 104, 210, 218; 69/19.3
See application file for complete search history.

(56) References Cited

U.S. PATENT DOCUMENTS 3,137,963 A 6/1964 Hein
3,313,038 A * 4/1967 Bolz ..... C14B 1/26 34/103
3,526,967 A 9/1970 Bolz
4,389,795 A * 6/1983 Craggs ..... C14B 15/06 34/103
6,915,669 B2 * 7/2005 Hedegaard ..... C14B 1/26 69/19.3
D611,965 S * 3/2010 Hedegaard ..... D15/78
7,690,228 B2 * 4/2010 Hedegaard ..... C14B 1/26 69/19.1
9,493,852 B2 * 11/2016 Frolund ..... C14B 15/06
D809,372 S * 2/2018 Palsgaard ..... D8/388
2015/0250137 A1 * 9/2015 Palsgaard ..... A01K 5/00 119/57.92
2017/0260597 A1 * 9/2017 Larsen ..... C14B 15/06
2018/0030556 A1 * 2/2018 Larsen ..... C14B 17/08
2018/0057900 A1 * 3/2018 Andersen ..... C14B 1/26
2018/0209003 A1 * 7/2018 Larsen ..... C14B 1/58
2018/0245170 A1 * 8/2018 Larsen ..... C14B 1/58
2019/0017127 A1 * 1/2019 Larsen ..... C14B 15/06

FOREIGN PATENT DOCUMENTS

WO WO 82/03634 10/1982
WO WO 01/62985 8/2001
WO WO2005/026394 3/2005
WO WO2005/080607 9/2005
WO WO2014/032950 3/2014
WO WO-2015144777 A1 * 10/2015 ..... C14B 15/06
WO WO-2017118721 A1 * 7/2017 ..... C14B 1/58

OTHER PUBLICATIONS

Written Opinion on corresponding PCT application (PCT/EP2015/056431) from International Searching Authority (EPO) dated Jun. 15, 2015.
International Search Report on related PCT application (PCT/EP2015/056441) from International Searching Authority (EPO) dated Sep. 3, 2015.
Written Opinion on related PCT application (PCT/EP2015/056441) from International Searching Authority (EPO) dated Sep. 3, 2015.
Non-Final Office Action on co-pending U.S. Appl. No. 15/128,677 dated Jun. 5, 2018.
Danish patent application No. DK 2003 01592; filed on Oct. 28, 2003; Inventor: Jens Hedegaard.

* cited by examiner 10X
102
100
104

70'
76

92
90

88
76
90

130
122
124
76'
126
66''

84'
70'
78
68
82

10XI
128
122I
26I
76I
124
126
66II 84I
70I
78
68
82

26'
10^XI
132
122^II
124
66^II
76'

84'
70'
78
68
82

26'
10^XII
132'
122'''
124
66''
76'

84'
70'
78
68
82

26'
10^XI
132^II
122^IV
124
66^II
76'

84'
70'
78
68
82

26'
10^XII
132^III
122^V
124
66^II
76'

84'
70'
78
68
82

26'
10^XI
132
124
66^VI
76^II

84'
70^II
78
68
82

26'
10^XII
132'
124
76''
66^X

84'
70''
78
68
82

26I
10X
26I
128
76III
66XI 26I
10XI
26I
128
76III
66X 66X
76III
128
78
10XI
68
82

26I
10XII
128III
128II
76III
66XI

10XII
68
82
78
128III
76III
66XI 130
134
132
66VI
76II 130
134
132
76II
66VI

66VI
76II
84I
132
70II
132
78

130
134
68
82

136
130
134'
128'
124
76''
66^VII 130
136
134'
128'
124
138
66^VI
76''

136
134'
128'
124
138
66^VI
76''

66^VII
76''
84'
128'
70''
132
78

130
134'
68
82

26'
26'
10^XI
128'
134^II
176
166

26'
10^XI
128'
134^II
176
166
166

176
78
10^XI
134^II
68
82

SYSTEM FOR DRYING A PELT, A DRYING UNIT, A PELT BOARD AND AN ADAPTOR

CROSS-REFERENCE TO RELATED APPLICATIONS

This application is the national phase entry, under 35 U.S.C. Section 371(c), of International Application No. PCT/EP2015/056431, filed Mar. 25, 2015, claiming priority from European Application Nos. 14161481.8, filed Mar. 25, 2014, 14161512.0, filed Mar. 25, 2014, 14199640.5, filed Dec. 22, 2014, and 14199651.2, filed Dec. 22, 2014. The disclosures of the International Application and the European Applications from which this application claims priority are incorporated herein by reference in their entireties.

FEDERALLY SPONSORED RESEARCH OR DEVELOPMENT

Not Applicable

The present invention relates to a system for drying a pelt and comprising a drying unit and a pelt board. Furthermore, the present invention relates to a drying unit, a pelt board and further adaptors for use with a drying unit.

BACKGROUND

In the drying of pelts, e.g. mink or fox pelt, after skinning and scraping off the layer of fat on the leather side of the pelt, the pelts are typically stretched on a pelt board which is often provided with a fat-absorbing material with the object of removing the remaining fat on the leather side of the pelt.

The use of pelt boards in connection with the drying of pelts is well known in the prior art and there has in the past been developed a great number of configurations of such pelt boards. There has also been established a standard of pelt sizes and thus also of pelt boards.

The most widespread pelt boards in the past were made of wood, and may in short be described as a flat piece of wood defining a longitudinal direction and having in the longitudinal direction a first broadside surface, a second broadside surface, a first narrow side surface and a second narrow side surface. One end of the board, the bottom end, is cut off at right angles to the longitudinal direction. The lower end adjacent the bottom has a constant breadth, which breadth gradually decreases towards a pointed and rounded end approaching the top end of the board. Such boards typically also have a longitudinal slot for allowing air to pass.

The drying procedure of the pelt shall be understood to be a drying-out of the leather side of the pelt to an extent which by experience prevents any attack on the pelt by mites. The drying process is typically effected by the blowing of dry air in the slot on the board via pipes which are introduces into the slot, where via the perforations in the walls of the pelt bag the dry air is diffused out of the leather side of the pelt and dries the pelt.

From WO 01/62985 is known a bag shaped holster, which is referred to as a fixing bag, which is used for securing the pelts on a pelt board during the drying process. The fixing bag is drawn over the board with the stretched pelt from the cranium end of the pelt so that the fur side of the pelt is in tight contact with the fur, which results in the pelt being pressed against the board with a force which is sufficient for the pelt to remain substantially in the stretched position during the drying.

Further prior art includes U.S. Pat. No. 3,137,963 in which a pelt board comprising a flat body of sheet metal having perforations therein and beads along the sides is disclosed.

In WO 2005/026394 is disclosed a pelt board which is lockable in a position, in which it has a first circumference and can also assume a position in which it has a second circumference being smaller than the first circumference by displacing opposing half parts in relation to each other. This results in a considerably easier removal of the pelt from the pelt board.

U.S. Pat. No. 1,110,016 relates to a pelt board having a pair of longitudinal legs and a nose piece located there between.

U.S. Pat. No. 3,526,967 relates to a pelt drying system including an air conditioning unit for supplying temperature controlled air to a number of manifolds having nozzles onto which the pelt drying frames are attached.

WO 82/03634 relates to a pelting board of non-absorbing plastics having a plurality of channels near its edges to supply drying air to the edges of the board so that the pelt dry evenly and stick less often to the board.

U.S. Pat. No. 3,303,038 relates to a pelt drying frame comprising opposite side rods joined at a nose over which frame a pelt may be drawn and held taut.

DK 2012 70519 A1 relates to a pelt board has a lower part and an upper part. The lower part has an outer cross section circumference which is substantially constant and the upper part has an outer cross section which is gradually decreasing.

DK 2013 00091 U4 relates to a pelt board has a lower part and an upper part. The lower part has an outer cross section circumference, which is substantially constant and the upper part has an outer cross section which is gradually decreasing. The lower part extends between 36 cm and 50 cm.

DK 177480 B1 discloses a pelt board having two broad elongated side surfaces. The pelt board comprises expansion means defining a narrow elongated side surface extending between side edges of the broad side surfaces. The expansion means are movable between an expanded position and a non-expanded position.

Some of the above pelt boards have an outer circumference made up of opposing non-movable surfaces and opposing movable surfaces. Pelt boards having this variable circumference for simplifying the removal of the pelt after drying are thus known in the prior art. The pelt boards are thus expanded during the drying process. As the pelt is fixated firmly during drying and may shrink slightly, the pelts may be difficult to remove from the pelt boards. Further, the pelts are typically fixated in a stretched state, thus increasing the pressure of the pelt onto the pelt board. By reducing the circumference of the pelt board, the pelt will be easier to remove from the pelt board.

However, the pelt boards used until now only feature a limited variation in the circumference in that only a limited part of the circumferential surfaces are moving/may be reduced. Typically, the prior art pelt boards have two opposing surfaces which are movable in relation to each other and thus, there may still exist opposing surfaces or parts of the circumference which are non-movable in relation to each other. Although the pelt board according to the prior art may alter the total circumference and thereby relax the pelt, it has been noticed by the applicant that the pelt in some circumstances may still stick quite firm onto the pelt board at the locations of the pelt board at which the surface or circumference has not been reduced.

It is thus an object according to the present invention to provide technologies for simplifying the removal of the pelts from the pelt boards and avoiding the situations where the pelt due to the drying and stretching may stick to the pelt board, and at the same time ensure that the pelt board keeps a substantially elliptical circumference in order to distribute the inwardly oriented pressure of the pelt evenly over the pelt board.

It is an advantage according to the present invention that the pelt board may be locked in the expanded position and that the movement between the expanded position and the reduced position may be performed very accurately using very little force.

It is a feature according to the present invention that the pelt board may be modified to accommodate pelts of different sizes and shapes.

SUMMARY OF THE INVENTION

The above object, the above features and the above advantage together with numerous other objects, advantages and features, which will be evident from the below detailed description of the present invention, are according to a first aspect of the present invention obtained by an elongated pelt board for accommodating an animal pelt, the pelt board defining a longitudinal direction, a first radial direction perpendicular to the longitudinal direction and a second radial direction perpendicular to the longitudinal direction and the first radial direction, the pelt board comprising:

a first wall element extending along the longitudinal direction and defining a first outwardly oriented surface, a first inwardly oriented surface, a first set of oppositely located longitudinal edges and a first actuator member, a second wall element extending along the longitudinal direction and defining a second outwardly oriented surface, a second inwardly oriented surface facing the first inwardly oriented surface, a second set of oppositely located longitudinal edges and a second actuator member, the first and second wall elements being spaced apart in the first radial direction, a third wall element extending along the longitudinal direction and defining a third outwardly oriented surface, a third inwardly oriented surface, a third set of oppositely located longitudinal edges and a third actuator member, a fourth wall element extending along the longitudinal direction and defining a fourth outwardly oriented surface, a fourth inwardly oriented surface facing the third inwardly oriented surface, a fourth set of oppositely located longitudinal edges and a fourth actuator member, the third wall element and the fourth wall element being spaced apart in the second radial direction, the first inwardly oriented surface, the second inwardly oriented surface, the third inwardly oriented surface and the fourth inwardly oriented surface together defining a cavity along the longitudinal direction, the first wall element, the second wall element, the third wall element and the fourth wall element define:

a contracted state in which the first radial distance between the first inwardly oriented surface and the second inwardly oriented surface is reduced, and, the second radial distance between the third inwardly oriented surface and the fourth inwardly oriented surface is reduced, and an expanded state in which the first radial distance between the first inwardly oriented surface and the second inwardly oriented surface is increased, and, the second radial distance between the third inwardly oriented surface and the fourth inwardly oriented surface is increased, and an elongated core element extending within the cavity along the longitudinal direction between a top end and a bottom end and being movable in relation to each of the first wall element, second wall element, third wall element and fourth wall element, the elongated core element comprising a first cooperating member interacting with the first actuator member of the first wall element, a second cooperating member interacting with the second actuator member of the second wall element, a third cooperating member interacting with the third actuator member of the third wall element and a fourth cooperating member interacting with the fourth actuator member of the fourth wall element for allowing the first wall element, the second wall element, the third wall element and the fourth wall element to selectively define the contracted state or the expanded state by moving the elongated core element in the longitudinal direction relative to the first wall element, the second wall element, the third wall element and the fourth wall element.

The above object, the above features and the above advantage together with numerous other objects, advantages and features, which will be evident from the below detailed description of the present invention, are according to a second aspect of the present invention obtained by an elongated pelt board for accommodating an animal pelt, the pelt board defining a longitudinal direction, a first radial direction perpendicular to the longitudinal direction and a second radial direction perpendicular to the longitudinal direction and the first radial direction, the pelt board comprising:

a first wall element extending along the longitudinal direction and defining a first outwardly oriented surface, a first inwardly oriented surface, a first set of oppositely located longitudinal edges and a first actuator member, a second wall element extending along the longitudinal direction and defining a second outwardly oriented surface, a second inwardly oriented surface facing the first inwardly oriented surface, a second set of oppositely located longitudinal edges and a second actuator member, the first and second wall elements being spaced apart in the first radial direction, a third wall element extending along the longitudinal direction and defining a third outwardly oriented surface, a third inwardly oriented surface, a third set of oppositely located longitudinal edges and a third actuator member, a fourth wall element extending along the longitudinal direction and defining a fourth outwardly oriented surface, a fourth inwardly oriented surface facing the third inwardly oriented surface, a fourth set of oppositely located longitudinal edges and a fourth actuator member, the third wall element and the fourth wall element being spaced apart in the second radial direction, the first inwardly oriented surface, the second inwardly oriented surface, the third inwardly oriented surface and the fourth inwardly oriented surface together defining a cavity along the longitudinal direction, the first wall element, the second wall element, the third wall element and the fourth wall element define:

a contracted state in which the first radial distance between the first inwardly oriented surface and the second inwardly oriented surface is reduced, and, the second radial distance between the third inwardly oriented surface and the fourth inwardly oriented surface is reduced, and an expanded state in which the first radial distance between the first inwardly oriented surface and the second inwardly oriented surface is increased, and, the second radial distance between the third inwardly oriented surface and the fourth inwardly oriented surface is increased, and an elongated core element extending within the cavity along the longitudinal direction between a top end and a bottom end and being movable in relation to each of the first wall element, second wall element, third wall element and fourth wall element, the elongated core element comprising a first cooperating member interacting with the first actuator member of the first wall element, a second cooperating member interacting with the second actuator member of the second wall element, a third cooperating member interacting with the third actuator member of the third wall element and a fourth cooperating member interacting with the fourth actuator member of the fourth wall element for allowing the first wall element, the second wall element, the third wall element and the fourth wall element to selectively define the contracted state or the expanded state by moving the elongated core element in the longitudinal direction relative to the first wall element, the second wall element, the third wall element and the fourth wall element.

The pelt board according to the first and second aspect of the present invention should have an overall size which is suitable for accommodating a pelt of an animal such as a mink or fox. The pelt board according to the first and second aspect of the present invention typically has a substantially elliptic cylindrical shape which is tapering in the longitudinal direction. The pelt is applied onto the pelt board according to the first and second aspect of the present invention by drawing in onto the pelt board according to the first and second aspect of the present invention in the longitudinal direction, while the pelt board according to the first and second aspect of the present invention assumes its expanded state. It is understood that state of the art pelt bags may be used between the pelt and the pelt board according to the first and second aspect of the present invention in order to remove fatty substances from the pelt. The wall elements may be arched, which in connection with the wall elements should be understood to mean that the outer surfaces of the respective wall elements of the pelt board according to the first and second aspect of the present invention have a convex shape. The wall elements typically include a large number of holes or nozzles for allowing ventilation air to pass from the cavity within the pelt board according to the first and second aspect of the present invention to the outside through the pelt.

The first, second, third and fourth wall elements together define the substantially elliptical outer circumference of the pelt board according to the first and second aspect of the present invention, which is suitable for and adapted for accommodating a pelt of an animal, through its respective outwardly oriented surfaces.

The inwardly oriented surfaces may preferably define a concave shape, which surfaces together define the cavity in the pelt board according to the first and second aspect of the present invention. The wall elements are typically made of plastics. The wall elements are further delimited in the circumferential direction by longitudinal edges.

The elongated core element, which is located in the cavity, is movable in the longitudinal direction in relation to the wall elements. The actuator members of the wall elements and the cooperating members of the core element interact when the core element is moved in the longitudinal direction within the cavity. The cooperating members move in the longitudinal direction together with the elongated core whereas the actuator members move in any of the radial directions along with its respective wall element. The interaction between the cooperating members and the actuator members translate the longitudinal movement of the cooperating members to a radial movement of the actuator members.

The actuator members and the cooperating members thus cause the wall elements to move towards each other or away from each other in the respective first or second radial direction, thus making the cavity smaller or larger, when the core element is moved in the longitudinal direction relative to the wall elements. The wall elements are thus movable between the contacted state, in which the wall elements have moved towards each other, reducing the radial distances, and consequently the circumference of the pelt board according to the first and second aspects of the present invention and the cavity is small, and an expanded state in which the wall elements have moved away from each other, increasing the radial distances and consequently the circumference of the pelt board according to the first and second aspects of the present invention and the cavity is large. Typically, an upward movement of the elongated core element in relation to the wall elements yields an expansion of the circumference of the pelt board according to the first and second aspects of the present invention, whereas a downward movement of the elongated core element in relation to the wall elements yields a contraction of the circumference of the pelt board according to the first and second aspects of the present invention.

Typically, the wall elements of the pelt board according to the first and second aspects of the present invention move in directions which are spaced apart by 90 degrees and thus realize a four way expansion and contraction of the pelt board according to the first and second aspects of the present invention. Thus, the radial directions are perpendicular, i.e. spaced apart by 90 degrees. In this way, the overall impression of the shape of the pelt board according to the first and second aspects of the present invention, i.e. the general circumferential profile, is at least largely unaffected by the movements of the wall elements. In this way, the outwardly oriented pressure on the pelt during the drying will be applied substantially uniformly in the pelt by the outer surfaces of the arched elements. The outer surface of the wall elements will constitute the contacts surface between the pelt and the pelt board according to the first and second aspects of the present invention, not taking into account the optional presence of a pelt bag between the pelt and the pelt board according to the first and second aspects of the present invention. Using a two way expansion and contraction, e.g. by opposing movable wall element, will necessarily apply more pressure on the pelt at the movable surfaces relative to the non-movable surfaces. Such non-uniformly applied pressure may lead to non-uniform pelts or even damages on the pelt.

When in the expanded state, the circumference of the pelt board according to the first and second aspects of the present invention is large. In this state the pelt is applied to the pelt board according to the first and second aspects of the present invention, optionally using a pelt bag. During the drying process, the pelt looses fat and moist and consequently contracts slightly. It may thereafter be very difficult to remove the pelt from the board. By contacting the pelt board according to the first and second aspects of the present invention by moving the wall element towards each other, the circumference of the pelt board according to the first and second aspects of the present invention defined by the outer surface of the wall elements will be smaller and thus typically allow the pelt to loosen from the outer surfaces of the wall elements, such that the pelt may be removed from the pelt board according to the first and second aspects of the present invention. In this context, the complete circumference of the pelt board according to the first and second aspects of the present invention will contract, effectively eliminating the risk of the pelt sticking to the pelt board according to the first and second aspects of the present invention.

According to further embodiments of the pelt board according to the first and second aspects of the present invention, when in the contracted state, the first and second sets of oppositely located longitudinal edges overlap respective edges of the third and fourth sets of oppositely located longitudinal edges or alternatively the third and fourth sets of oppositely located longitudinal edges overlapping respective edges of the first and second sets of oppositely located longitudinal edges, and, when in the expanded state the first and second sets of oppositely located longitudinal edges are substantially flush with respective edges of the third and fourth sets of oppositely located longitudinal edges.

In order to allow the pelt to maintain an attractive surface structure, the outer surfaces of the wall elements should be at least substantially continuous. In order to achieve a substantially continuous outwardly oriented surface, the longitudinal edges of the wall elements in the expanded state should be at least substantially flush. This means that the outer surfaces of the wall elements form a substantially continuous structure avoiding any large gaps between the wall elements and adjacent outer surfaces.

When the pelt board according to the first and second aspects of the present invention assumes the contracted state and in order to maintain the general circumferential profile of the pelt board according to the first and second aspects of the present invention, it is advantageous that the longitudinal edges of adjacent wall elements of the pelt board according to the first and second aspects of the present invention do overlap each other such that only a minor deviation from a continuous surface exists between adjacent outer surfaces of the wall elements. It is understood from the above that in order to realize the contraction, a part of the wall elements located at the respective longitudinal edges of the wall element may be pushed above or below its adjacent wall elements to form the overlapping such that the longitudinal edges are non-flush.

According to further embodiments of the pelt board according to the first and second aspects of the present invention, any of the first wall element, the second wall element, the third wall element and/or the fourth wall element define a central part and a peripheral part, the peripheral part encompassing the set of edges, the central part and the peripheral part being flexibly joined together and when the first wall element, the second wall element, the third wall element and the fourth wall element define the contracted state, the peripheral part assuming an inwardly oriented position, whereas when the first wall element, the second wall element, the third wall element and the fourth wall element define the expanded state, the peripheral part assuming an outwardly oriented position.

In order to simplify the overlapping of the wall elements and allow the gap between adjacent wall elements to be minimized, the wall elements may be partially flexible. Although it is fully feasible to realize an expansion and contraction of the pelt board according to the first and second aspects of the present invention via the wall element using rigid wall elements, the thickness of the wall element will typically prevent a fully flush outwardly oriented surface in the expanded state. By allowing the part of the wall element which is going to be pushed below and/or above an adjacent wall element in the contracted state to be flexible in relation to the part of the wall element which is going to remain exposed to the pelt, the longitudinal edges of adjacent wall elements may be caused to be fully flush or continuous in the expanded state.

The central part of the respective wall element is movable in the respective first radial direction or the second radial direction according to the movement of the corresponding wall element, whereas the peripheral part may be movable in both the first and the second radial direction in order to be accommodated above or below the adjacent wall element as described above.

According to further embodiments of the pelt board according to the first and second aspects of the present invention, the first actuator member and the second actuator member constitute pins and the first cooperating member and the second cooperating member constitute grooves, e.g. linear or curved grooves, in which the pins are guided between the contracted state and the expanded state, or, wherein the first cooperating member and the second cooperating member constitute pins and the first actuator member and the second actuator member constitute grooves, e.g. linear or curved grooves, in which the pins are guided between the contracted state and the expanded state.

The above guiding principle using a pin which is guided by a groove allows a well defined movement of the wall elements. It is evident that the opposite configuration is equally feasible, i.e. having the first actuator member and the second actuator member constitute grooves, e.g. linear or curved grooves, and the first cooperating member and the second cooperating member constitute pins which are guided by the grooves between the contracted state and the expanded state, or any combination thereof. The longitudinal movement of the elongated core thus translates into a radial movement of the wall elements. The groove/pin configuration also allows for a very convenient latching of the wall elements and the core.

According to further embodiments of the pelt board according to the first and second aspects of the present invention, the third actuator member and the fourth actuator member constitute wedge members for contacting the third cooperating member and the fourth cooperating member, or, the third cooperating member and the fourth cooperating member constitute wedge members for contacting the third actuator member and the fourth actuator member.

Another guiding principle is employed by using wedge members which exhibit an angle and may consequently slide outwardly when pushed. The longitudinal movement of the elongated core element thus translates into a radial movement by interaction between the sloped members. This guiding principle may preferably be used when changing from said contracted state to said expanded state.

According to further embodiments of the pelt board according to the first and second aspects of the present invention, the third actuator member and the fourth actuator members further engage the cooperating members opposite the elongated core element.

Yet another guiding principle is employed by using actuator members acting on the side of the elongated core element which is located opposite the wall element to be moved. The longitudinal movement of the elongated core element thus translates into a radial movement by interaction typically by using sloped members. This guiding principle may preferably be used when changing from said expanded state to said contracted state.

According to further embodiments of the pelt board according to the first and second aspects of the present invention, any of the first wall element, second wall element, third wall element and fourth wall element have an arched shape such that any of said first outwardly oriented surface, second outwardly oriented surface, third outwardly oriented surface and fourth outwardly oriented surface define a convex shape.

Using a convex shape of the wall element will allow the outer surfaces of the wall elements to adapt to the pelt which typically has a cylindrical shape.

According to further embodiments of the pelt board according to the first and second aspects of the present invention, any of the first wall element, second wall element, third wall element and fourth wall element comprise ventilation grooves between the cavity and the outside of the pelt board according to the first and second aspects of the present invention.

Ventilation grooves may be present in order to allow dry air to be injected into the pelt for removing any remaining moisture in the pelt and thereby decrease the drying time of the pelt.

According to further embodiments of the pelt board according to the first and second aspects of the present invention, the first wall element, the second wall element, the third wall element and the fourth wall element define an opening between the cavity and the outside of the pelt board according to the first and second aspects of the present invention at the bottom end for allowing ventilation air to enter the cavity.

The dry air injected into the pelt via the pelt board according to the first and second aspects of the present invention and used for decreasing the drying time of the pelt may be let into the pelt board according to the first and second aspects of the present invention via a cavity near the bottom end of the pelt board according to the first and second aspects of the present invention. The bottom end of the pelt board according to the first and second aspects of the present invention is typically attachable to a drying unit for holding the pelt board according to the first and second aspects of the present invention in an upright position and for supplying the drying air.

According to further embodiments of the pelt board according to the first and second aspects of the present invention, the third wall element and the fourth wall element are fixedly connected at the bottom end.

In order to increase the rigidity of the pelt board according to the first and second aspects of the present invention and for allowing the pelt board according to the first and second aspects of the present invention to easily connect to a drying unit, the pelt board according to the first and second aspects of the present invention may assume the same circumference at the bottom end both in the expanded state and in the contracted state. This may be made by fixedly connecting the wall elements at constant distance relative to each other near the bottom end and allowing the flexibility of the wall elements to determine the movement of the lower portion of the pelt board according to the first and second aspects of the present invention. The lower extreme of the pelt board according to the first and second aspects of the present invention is typically not used for accommodating the pelt since the pelt boards according to the present invention are typically made longer than the longest pelts for which the pelt boards are intended.

According to further embodiments of the pelt board according to the first and second aspects of the present invention, the first wall element defines a first radial edge adjacent the top end of the elongated core, the second wall element comprising a second radial edge adjacent the top edge of the elongated core, the pelt board according to the first and second aspects of the present invention further comprising:

- a fifth wall element adjacent to the first wall element at the first radial edge, the fifth wall element extending along the longitudinal direction and away from the second wall element, the fifth wall element defining a fifth outwardly oriented surface and a fifth actuator member,
- a sixth wall element adjacent to the second wall element at the second radial edge, the sixth wall element extending along the longitudinal direction and away from the second wall element, the sixth wall element defining a sixth outwardly oriented surface and a sixth actuator member, the fifth and sixth wall elements being spaced apart in the first radial direction, and
- a core extension element connected to the top end of the elongated core element and extending along the longitudinal direction away from the elongated core element, the core extension element being movable in relation to the fifth wall element and sixth wall element, the core extension element comprising a fifth cooperating member interacting with the fifth actuator member of the fifth wall element and a sixth cooperating member interacting with the sixth actuator member of the sixth wall element for allowing the fifth wall element and the sixth wall element to change between the contracted state and the expanded states by moving the elongated core element and the core extension element in the longitudinal direction relative to the first wall element, the second wall element, the third wall element, the fourth wall element, the fifth wall element and the sixth wall element.

Although it is sometimes feasible, having a pelt board according to the first and second aspects of the present invention which is expandable along its entire circumference may be undesirable near the upper part of the pelt board according to the first and second aspects of the present invention. The upper part of the pelt board according to the first and second aspects of the present invention is intended to accommodate the neck and head part of the animal and since the neck and head part of the animal pelt have a smaller circumference than the body part of the pelt, the pelt board according to the first and second aspects of the present invention usually is tapered towards the top end having a thickness of the pelt board according to the first and second aspects of the present invention which is reduced near the top of the pelt board according to the first and second aspects of the present invention, as described above. Since the actuator members, cooperating members and elongated core element require some space within the cavity, it may not be feasible to allow the pelt board according to the first and second aspects of the present invention to expand and contract along its entire circumference, i.e. a four way expansion of the pelt board according to the first and second aspects of the present invention as described above, at the top end of the board. Instead, at the top end of the board, the pelt board according to the first and second aspects of the present invention may be allowed to be movable in only two opposing directions.

The fifth wall element constitutes an extension of the first wall element, the sixth wall element constitutes an extension of the second wall element, whereas the core extension element constitutes and extension of the elongated core element. The moving principle in the first radial direction of the fifth wall element, sixth wall element and core extension element may be the same between the first wall element, the second wall element and the elongated core element, albeit the adjacent wall elements moving in the second radial direction are missing. This top structure including the fifth wall element and the sixth wall element may thus be made significantly thinner than the bottom structure including the first wall element, the second wall element, the third wall element, the fourth wall element. The fifth wall element and the sixth wall element may optionally be arched but will typically be substantially flat due to the limited space available at the top of the pelt board according to the first and second aspects of the present invention.

According to further embodiments of the pelt board according to the first and second aspects of the present invention, the third wall element and the fourth wall element comprise opposing extension elements partially enclosing the core extension element.

In order to increase the rigidity of the top structure relative to the bottom structure, the top structure may include opposing extension elements which limit the radial movement or flexibility of the core extension element. The core extension element is thus located between the opposing extension elements, which are fixated to the respective third wall element and the fourth wall element.

According to further embodiments of the pelt board according to the first and second aspects of the present invention, the pelt board according to the first and second aspects of the present invention comprises:

- a lower section including the first wall element, the second wall element, the third wall element, the fourth wall element and the elongated core element,
- an upper section comprising the fifth wall element, the sixth wall element and the core extension element, and
- an intermediate section located between the lower section and the upper section and comprising a core connecting element interconnecting the elongated core element and the core extension element, and a number of substantially elliptic cylindrical elements surrounding the core connecting element.

The substantially elliptic cylindrical elements may be used for extending a short pelt board according to the first and second aspects of the present invention and make it suitable for larger animals. The substantially elliptic cylindrical elements typically do not have any variable circumference, however, the pelt typically sticks to the pelt board according to the first and second aspects of the present invention near the top and bottom ends of the pelt board according to the first and second aspects of the present invention, thus the elliptic cylindrical elements merely constitutes spacers. This will have the advantage that the same pelt board according to the first and second aspects of the present invention may be used with animals of very different size and the adaptation to the size of the particular animal will be made by using the elliptic cylindrical elements. The core connecting element is merely used for connecting the longitudinal motion from the elongated core element to the core extension element.

According to further embodiments of the pelt board according to the first and second aspects of the present invention, the fifth cooperating member and the sixth cooperating member constitute pins and the fifth actuator member and the sixth actuator member constitute grooves, e.g. linear or curved grooves, in which the pins are guided between the contracted state and the expanded state, or, the fifth actuator member and the sixth actuator member constitute pins and the fifth cooperating member and the sixth cooperating member constitute grooves, e.g. linear or curved grooves, in which the pins are guided between the contracted state and the expanded state The above guiding principle using a pin which is guided by a groove allows a well defined movement of the wall elements. This principle has been explained above in connection with the first and second actuator members.

According to further embodiments of the pelt board according to the first and second aspects of the present invention, the fifth wall element is connected to the first wall element at the first radial edge and the sixth wall element is connected to the second wall element at the second radial edge.

By connecting the fifth wall element to the first wall element at the first radial edge and connecting the sixth wall element to the second wall element at the second radial edge, it may be assured that the fifth wall element and the sixth wall element moves uniformly and synchronous with the respective first wall element and second wall element. It may also be avoided that the pelt is squeezed in-between the wall element and the arched wall elements at the first and second radial edges.

According to further embodiments of the pelt board according to the first and second aspects of the present invention, the elongated core element comprises a first protrusion adjacent the bottom end, the elongated core element being spring-loaded at the bottom end and defining a centralized relaxed position and a non-centralized loaded position in the first radial direction and/or second radial direction, the first wall element, the second wall element, the third wall element or the fourth wall element comprise a second protrusion cooperating with the first protrusion such that when the first wall element, the second wall element, the third wall element and the fourth wall element define the expanded state and the elongated core element defines the centralized related position, the first and second protrusions prevent any longitudinal movement of the elongated core element, whereas when the elongated core element defines the non-centralized loaded position, the first and second protrusions allow longitudinal movement of the elongated core element.

The pelt board according to the first and second aspects of the present invention is maintained in the expanded state merely due to the design of and internal friction between the movable parts of the pelt board according to the first and second aspects of the present invention. The friction increases with the pressure applied to the pelt board according to the first and second aspects of the present invention and although an increased friction may help keeping the pelt board according to the first and second aspects of the present invention in the expanded state also when a large inwardly pressure is applied from the pelt, it may also be very difficult to contract the pelt board according to the first and second aspects of the present invention. Experience has shown that after the drying, when the pelt has shrunk and thus applies a large pressure onto the pelt board according to the first and second aspects of the present invention, the users have to apply a large manual force to cause the pelt board according to the first and second aspects of the present invention to collapse. This work is very tedious and may lead to work related injuries.

The locking mechanism described above making use of cooperating protrusions for preventing movement of the elongated core element and thereby contraction of the pelt board according to the first and second aspects of the present invention allows the pelt board according to the first and second aspects of the present invention to remain in the expanded state even when exposed to very large inwardly oriented pressure, while reducing the amount of work needed for changing the pelt board according to the first and second aspects of the present invention into the contracted state. The first and second protrusions will interlock when the elongated core is in its central position, effectively preventing any longitudinal movement of the elongated core, which in turn prevents any radial movement of the wall elements.

By merely exposing the elongated core element to a small radial force, overcoming the friction between the first and second protrusion and the spring constant of the elongated core element, the inwardly oriented pressure from the dried pelt will cause the wall element to move inwardly and the pelt board according to the first and second aspects of the present invention to contact, while the elongated core element is moved in the longitudinal direction and the first protrusion is passing by the second protrusion. This mechanism will also be less prone to accidental activation since it is not depending on any hard to determine internal friction between the activation members and the cooperating members.

It is evident that the above locking mechanism may be used for a generic pelt board according to the first and second aspects of the present invention which does not necessarily have to encompass the four way expansion. Such pelt board according to the first and second aspects of the present invention may e.g. be defined as an elongated pelt board according to the first and second aspects of the present invention for accommodating an animal pelt, the pelt board according to the first and second aspects of the present invention defining a longitudinal direction, a first radial direction perpendicular to the longitudinal direction and a second radial direction perpendicular to the longitudinal direction and the first radial direction, the pelt board according to the first and second aspects of the present invention having a wall element and an elongated core element covered by the wall element, the wall element being capable of assuming an expanded state and a contacted state by longitudinal movement of the elongated core element, the elongated core element comprising a first protrusion adjacent a bottom end of the pelt board according to the first and second aspects of the present invention, the core element being spring-loaded at the bottom end and defines a centralized relaxed position and a non-centralized loaded position in the first radial direction and/or second radial direction, the wall element comprising a second protrusion cooperating with the first protrusion such that when the wall element define the expanded state and the elongated core element define the centralized related position, the first and second protrusions preventing any longitudinal movement of the elongated core element, whereas when the elongated core element define the non-centralized loaded position, the first and second protrusions allow longitudinal movement of the elongated core element.

The change from expanded state to contracted state may preferably be made when the bottom end of the elongated core element is attached to the drying unit, e.g. by tilting the pelt board according to the first and second aspects of the present invention sideways, thereby also taking advantage of the leverage provided by the pelt board according to the first and second aspects of the present invention for overcoming the friction between the first and second protrusions.

According to two further advantageous embodiments of the pelt board according to the second aspect of the present invention, the pelt board according to the second aspect of the present invention is adapted to establish an intermediate position in which the first wall element and the second wall element, or alternatively, the third wall element and the fourth wall element, are shifted relative to one another for establishing a first intermediate state and a second intermediate state, respectively.

Consequently, according to a first alternative embodiment of the pelt board according to the second aspect of the present invention, the first wall element, the second wall element, the third wall element and the fourth wall element further define a first intermediate state in which the first radial distance between the first inwardly orientated surface and the second inwardly orientated surface is increased, as compared to the contracted state.

According to a second alternative embodiment of the pelt board according to the second aspect of the present invention, the first wall element, the second wall element, the third wall element and the fourth wall element further define a second intermediate state, in which the second radial distance between the third inwardly orientated surface and the fourth inwardly orientated surface is increased, as compared to the contracted state.

Although the elongated pelt board according to the second aspect of the present invention may, according to the above described two alternative embodiments, in which a first and a second intermediate state, respectively, are defined, the elongated pelt board according to the second aspect of the present invention may be adapted to allow the change from the contracted state to the expanded state and vice versa via the first intermediate state, or alternatively via the second intermediate state, or by directly shifting the elongated pelt board according to the second aspect of the present invention from the contracted state to the expanded state or in the alternative, when collapsing the elongated pelt board according to the second aspect of the present invention from the expanded state to the contracted state.

In a variant of the elongated pelt board according to the second aspect of the present invention, the first and second wall elements and likewise the third and fourth wall elements are integrated into integral wall element structures and consequently, according to this alternative embodiment, the first wall element defines a first edge among the first set of oppositely located longitudinal edges and the second wall element defines a second edge among the second set of oppositely located longitudinal edges, the first and second edges being positioned adjacent one another, and the first wall element and the second wall element being integrally connected along the first and second edges, and the third wall element defines a third edge among the third set of oppositely located longitudinal edges, and the fourth wall element defines a fourth edge among the fourth set of oppositely located longitudinal edges, the third and fourth edges being positioned adjacent one another, and the third wall element and the fourth wall element being integrally connected along said third and fourth edges.

In the alternative embodiment of the pelt board according to the second aspect of the present invention, in which the first and second wall elements and likewise the third and fourth wall elements are integrated into integral wall elements, the first actuator member and the second actuator member are constituted by a single first integral actuator member, and the third actuator member and said fourth actuator member are constituted by a single second integral actuator member.

The above object, the above features and the above advantage together with numerous other objects, advantages and features, which will be evident from the below detailed description of the present invention, are according to a third aspect of the present invention obtained by an elongated pelt board for accommodating an animal pelt, the pelt board defining a longitudinal direction, a first radial direction perpendicular to the longitudinal direction and a second radial direction perpendicular to the longitudinal direction and the first radial direction, the pelt board comprising:

a first wall element extending along said longitudinal direction and defining a first outwardly oriented surface, a first inwardly oriented surface, a first set of oppositely located longitudinal edges and a first actuator member, a second wall element extending along said longitudinal direction and defining a second outwardly oriented surface, a second inwardly oriented surface facing said first inwardly oriented surface, a second set of oppositely located longitudinal edges and a second actuator member, said first wall element and said second wall element being of identical configuration and each having a low curvature part and a high curvature part joint together along a line of junction extending generally in said longitudinal direction, said low curvature part of said first wall element defining a first longitudinal edge of said first set of oppositely located longitudinal edges, said high curvature part of said first wall element defining a second longitudinal edge of said first set of oppositely located longitudinal edges, said low curvature part of said second wall element defining a first longitudinal edge of said second set of oppositely located longitudinal edges, said high curvature part of said second wall element defining a second longitudinal edge of said second set of oppositely located longitudinal edges, said first edge of said first wall element being positioned juxtaposed said second edge of said second wall element and said first edge of said second wall element being positioned juxtaposed said second edge of said first wall element, said first inwardly oriented surface and said second inwardly oriented surface together defining a cavity along said longitudinal direction, said first wall element and said second wall element defining:

a contracted state in which said first radial distance between said first inwardly oriented surface and said second inwardly oriented surface is reduced, in which said first edge of said first wall element is positioned closely against said second edge of said second wall element, and in which said first edge of said second wall element is positioned closely against said second edge of said first wall element, and an expanded state in which said first radial distance between said first inwardly oriented surface and said second inwardly oriented surface is increased, in which said first edge of said first wall element and said second edge of said second wall element is positioned in spaced apart relationship in said first radial direction, and in which said first edge of said second wall element and said second edge of said first wall element are positioned in spaced apart relationship and said first radial direction and an elongated core element extending within said cavity along said longitudinal direction between a top end and a bottom end and being movable in relation to said first wall element and second wall element, said elongated core element comprising a first cooperating member interacting with said first actuator member of said first wall element and second cooperating member interacting with said second actuator member of said second wall element, for allowing said first wall element and said second wall element, to selectively define said contracted state or said expanded state by moving said elongated core element in said longitudinal direction relative to said first wall element and said second wall element.

The above object, the above features and the above advantage together with numerous other objects, advantages and features, which will be evident from the below detailed description of the present invention, are according to a fourth aspect of the present invention obtained by an elongated pelt board for accommodating an animal pelt, the pelt board defining a longitudinal direction, a first radial direction perpendicular to the longitudinal direction and a second radial direction perpendicular to the longitudinal direction and the first radial direction, the pelt board comprising:

a first wall element extending along said longitudinal direction and defining a first outwardly oriented surface, a first inwardly oriented surface, a first set of oppositely located longitudinal edges and a first actuator member, a second wall element extending along said longitudinal direction and defining a second outwardly oriented surface, a second inwardly oriented surface facing said first inwardly oriented surface, a second set of oppositely located longitudinal edges and a second actuator member, said first wall element and said second wall element being of identical configuration and each having a low curvature part and a high curvature part joint together along a line of junction extending generally in said longitudinal direction, said low curvature part of said first wall element defining a first longitudinal edge of said first set of oppositely located longitudinal edges, said high curvature part of said first wall element defining a second longitudinal edge of said first set of oppositely located longitudinal edges, said low curvature part of said second wall element defining a first longitudinal edge of said second set of oppositely located longitudinal edges, said high curvature part of said second wall element defining a second longitudinal edge of said second set of oppositely located longitudinal edges, said first edge of said first wall element being positioned juxtaposed said second edge of said second wall element and said first edge of said second wall element being positioned juxtaposed said second edge of said first wall element, said first inwardly oriented surface and said second inwardly oriented surface together defining a cavity along said longitudinal direction, said first wall element and said second wall element defining:

a contracted state in which said first radial distance between said first inwardly oriented surface and said second inwardly oriented surface is reduced, in which said first edge of said first wall element is positioned closely against said second edge of said second wall element, and in which said first edge of said second wall element is positioned closely against said second edge of said first wall element, and an expanded state in which said first radial distance between said first inwardly oriented surface and said second inwardly oriented surface is increased, in which said first edge of said first wall element and said second edge of said second wall element is positioned in spaced apart relationship in said second radial direction, and in which said first edge of said second wall element and said second edge of said first wall element are positioned in spaced apart relationship and said second radial direction, and an elongated core element extending within said cavity along said longitudinal direction between a top end and a bottom end and being movable in relation to said first wall element and second wall element, said elongated core element comprising a first cooperating member interacting with said first actuator member of said first wall element and second cooperating member interacting with said second actuator member of said second wall element, for allowing said first wall element and said second wall element, to selectively define said contracted state or said expanded state by moving said elongated core element in said longitudinal direction relative to said first wall element and said second wall element.

The pelt board according to the third and fourth aspects of the present invention should have an overall size which is suitable for accommodating a pelt of an animal such as a mink or fox. The pelt board according to the third and fourth aspects of the present invention typically has a substantially elliptic cylindrical shape which is tapering in the longitudinal direction. The pelt is applied onto the pelt board according to the third and fourth aspects of the present invention by drawing in onto the pelt board according to the third and fourth aspects of the present invention in the longitudinal direction, while the pelt board according to the third and fourth aspects of the present invention assumes its expanded state. It is understood that state of the art pelt bags may be used between the pelt and the pelt board according to the third and fourth aspects of the present invention in order to remove fatty substances from the pelt. The wall elements typically include a large number of holes or nozzles for allowing ventilation air to pass from the cavity within the pelt board according to the third and fourth aspects of the present invention to the outside through the pelt.

The first and second wall elements together define the substantially elliptical outer circumference of the pelt board according to the third and fourth aspects of the present invention, which is suitable for and adapted for accommodating a pelt of an animal, through its respective outwardly oriented surfaces. The inwardly oriented surfaces may preferably define a concave shape, which surfaces together define the cavity in the pelt board according to the third and fourth aspects of the present invention. The wall elements are typically made of plastics. The wall elements are further delimited in the circumferential direction by longitudinal edges.

The elongated core element, which is located in the cavity, is movable in the longitudinal direction in relation to the wall elements. The actuator members of the wall elements and the cooperating members of the core element interact when the core element is moved in the longitudinal direction within the cavity. The cooperating members move in the longitudinal direction together with the elongated core whereas the actuator members move in any of the radial directions along with its respective wall element. The interaction between the cooperating members and the actuator members translate the longitudinal movement of the cooperating members to a radial movement of the actuator members.

The actuator members and the cooperating members thus cause the wall elements to move towards each other or away from each other in the respective first or second radial direction, thus making the cavity smaller or larger, when the core element is moved in the longitudinal direction relative to the wall elements. The wall elements are thus movable between the contacted state, in which the wall elements have moved towards each other, reducing the radial distances, and consequently the circumference of the pelt board according to the third and fourth aspects of the present invention and the cavity is small, and an expanded state in which the wall elements have moved away from each other, increasing the radial distances and consequently the circumference of the pelt board according to the third and fourth aspects of the present invention and the cavity is large. Typically, an upward movement of the elongated core element in relation to the wall elements yields an expansion of the circumference of the pelt board according to the third and fourth aspects of the present invention, whereas a downward movement of the elongated core element in relation to the wall elements yields a contraction of the circumference of the pelt board according to the third and fourth aspects of the present invention.

The outer surface of the wall elements will constitute the contacts surface between the pelt and the pelt board according to the third and fourth aspects of the present invention, not taking into account the optional presence of a pelt bag between the pelt and the pelt board according to the third and fourth aspects of the present invention.

When in the expanded state, the circumference of the pelt board according to the third and fourth aspects of the present invention is large. In this state the pelt is applied to the pelt board according to the third and fourth aspects of the present invention, optionally using a pelt bag. During the drying process, the pelt looses fat and moist and consequently contracts slightly. It may thereafter be very difficult to remove the pelt from the board. By contacting the pelt board according to the third and fourth aspects of the present invention by moving the wall element towards each other, the circumference of the pelt board according to the third and fourth aspects of the present invention defined by the outer surface of the wall elements will be smaller and thus allow the pelt to loosen from the outer surfaces of the wall elements, such that the pelt may be removed from the pelt board according to the third and fourth aspects of the present invention. In this context, the complete circumference of the pelt board according to the third and fourth aspects of the present invention will contract, effectively eliminating the risk of the pelt sticking to the pelt board according to the third and fourth aspects of the present invention.

In order to simplify the overlapping of the wall elements and allow the gap between adjacent wall elements to be minimized, the wall elements may be partially flexible. Although it is fully feasible to realize an expansion and contraction of the pelt board according to the third and fourth aspects of the present invention via the wall element using rigid wall elements, the thickness of the wall element will typically prevent a fully flush outwardly oriented surface in the expanded state. By allowing the part of the wall element which is going to be pushed below and/or above an adjacent wall element in the contracted state to be flexible in relation to the part of the wall element which is going to remain exposed to the pelt, the longitudinal edges of adjacent wall elements may be caused to be fully flush or continuous in the expanded state.

According to a further embodiment of the pelt board according to the third and fourth aspects of the present invention, the first actuator member and the second actuator member constitute pins and the first cooperating member and the second cooperating member constitute grooves, e.g. linear or curved grooves, in which the pins are guided between the contracted state and the expanded state, or, wherein the first cooperating member and the second cooperating member constitute pins and the first actuator member and the second actuator member constitute grooves, e.g. linear or curved grooves, in which the pins are guided between the contracted state and the expanded state.

The above guiding principle using a pin which is guided by a groove allows a well defined movement of the wall elements. It is evident that the opposite configuration is equally feasible, i.e. having the first actuator member and the second actuator member constitute grooves, e.g. linear or curved grooves, and the first cooperating member and the second cooperating member constitute pins which are guided by the grooves between the contracted state and the expanded state, or any combination thereof. The longitudinal movement of the elongated core thus translates into a radial movement of the wall elements. The groove/pin configuration also allows for a very convenient latching of the wall elements and the core.

Another guiding principle is employed by using wedge members which exhibit an angle and may consequently slide outwardly when pushed. The longitudinal movement of the elongated core element thus translates into a radial movement by interaction between the sloped members. This guiding principle may preferably be used when changing from said contracted state to said expanded state.

Yet another guiding principle is employed by using actuator members acting on the side of the elongated core element which is located opposite the wall element to be moved. The longitudinal movement of the elongated core element thus translates into a radial movement by interaction typically by using sloped members. This guiding principle may preferably be used when changing from said expanded state to said contracted state.

According to a further embodiment according to the present invention, the first wall element and the second wall element have an arched shape such that the first outwardly oriented surface and the second outwardly oriented surface define a convex shape.

Using a convex shape of the wall element will allow the outer surfaces of the wall elements to adapt to the pelt which typically has a cylindrical shape.

According to a further embodiment according to the present invention, the first wall element and the second wall element comprise ventilation grooves between the cavity and the outside of the pelt board according to the third and fourth aspects of the present invention.

Ventilation grooves may be present in order to allow dry air to be injected into the pelt for removing any remaining moisture in the pelt and thereby decrease the drying time of the pelt.

According to a further embodiment according to the present invention, the first wall element and the second wall element define an opening between the cavity and the outside of the pelt board according to the third and fourth aspects of the present invention at the bottom end for allowing ventilation air to enter the cavity.

The dry air injected into the pelt via the pelt board according to the third and fourth aspects of the present invention and used for decreasing the drying time of the pelt may be let into the pelt board according to the third and fourth aspects of the present invention via a cavity near the bottom end of the pelt board according to the third and fourth aspects of the present invention. The bottom end of the pelt board according to the third and fourth aspects of the present invention is typically attachable to a drying unit for holding the pelt board according to the third and fourth aspects of the present invention in an upright position and for supplying the drying air.

In accordance with the presently preferred embodiment of the elongated pelt board according to the third and fourth aspects of the present invention according to the first and the second aspect of the present invention, the first wall element and the third wall element are constituted by a first unitary structure, the second wall element and the fourth wall element are constituted by a second unitary structure and the core element and the core extension element are constituted by a second unitary core element structure. Consequently, this presently preferred embodiment of the pelt board according to the third and fourth aspects of the present invention according to the first and the second aspect of the present invention is assembled from three separate elements, namely a single unitary core element structure and two identically shaped unitary wall element structures.

In order to increase the rigidity of the pelt board according to the third and fourth aspects of the present invention and for allowing the pelt board according to the third and fourth aspects of the present invention to easily connect to a drying unit, the pelt board according to the third and fourth aspects of the present invention may assume the same circumference at the bottom end both in the expanded state and in the contracted state. This may be made by fixedly connecting the wall elements at constant distance relative to each other near the bottom end and allowing the flexibility of the wall elements to determine the movement of the lower portion of the pelt board according to the third and fourth aspects of the present invention. The lower extreme of the pelt board according to the third and fourth aspects of the present invention is typically not used for accommodating the pelt since the pelt board according to the third and fourth aspects of the present invention is typically made longer than the longest pelts for which the pelt board according to the third and fourth aspects of the present invention is intended.

According to a further embodiment of the pelt board according to the third and fourth aspects of the present invention, the first wall element defines a first radial edge adjacent the top end of the elongated core, the second wall element comprising a second radial edge adjacent the top edge of the elongated core, the pelt board further comprising:

a third wall element adjacent to the first wall element at the first radial edge, the third wall element extending along the longitudinal direction and away from the second wall element, the third wall element defining a third outwardly oriented surface and a third actuator member, a fourth wall element adjacent to the second wall element at the second radial edge, the fourth wall element extending along the longitudinal direction and away from the second wall element, the fourth wall element defining a fourth outwardly oriented surface and a fourth actuator member, the third and fourth wall elements being spaced apart in the first radial direction, and a core extension element connected to the top end of the elongated core element and extending along the longitudinal direction away from the elongated core element, the core extension element being movable in relation to the third wall element and fourth wall element, the core extension element comprising a third cooperating member interacting with the third actuator member of the third wall element and a fourth cooperating member interacting with the fourth actuator member of the fourth wall element for allowing the third wall element and the fourth wall element to change between the contracted state and the expanded states by moving the elongated core element and the core extension element in the longitudinal direction relative to the first wall element, the second wall element, the third wall element, the fourth wall element, the third wall element and the fourth wall element.

Although it is sometimes feasible, having a pelt board which is expandable along its entire circumference may be undesirable near the upper part of the pelt board according to the third and fourth aspects of the present invention. The upper part of the pelt board is intended to accommodate the neck and head part of the animal and since the neck and head part of the animal pelt have a smaller circumference than the body part of the pelt, the pelt board usually is tapered towards the top end having a thickness of the pelt board which is reduced near the top of the pelt board, as described above. Since the actuator members, cooperating members and elongated core element require some space within the cavity, it may not be feasible to allow the pelt board to expand and contract along its entire circumference, at the top end of the board.

According to a further embodiment of the pelt board according to the third and fourth aspects of the present invention, the third wall element and the fourth wall element comprise opposing extension elements partially enclosing the core extension element.

According to a further embodiment of the pelt board according to the third and fourth aspects of the present invention, the pelt board comprises:

a lower section including the first wall element and the second wall element and the elongated core element, an upper section comprising the third wall element, the fourth wall element and the core extension element, and an intermediate section located between the lower section and the upper section and comprising a core connecting element interconnecting the elongated core element and the core extension element.

According to a further embodiment of the pelt board according to the third and fourth aspects of the present invention, the third cooperating member and the fourth cooperating member constitute pins and the third actuator member and the fourth actuator member constitute grooves, e.g. linear or curved grooves, in which the pins are guided between the contracted state and the expanded state, or, the third actuator member and the fourth actuator member constitute pins and the third cooperating member and the fourth cooperating member constitute grooves, e.g. linear or curved grooves, in which the pins are guided between the contracted state and the expanded state.

The above guiding principle using a pin which is guided by a groove allows a well defined movement of the wall elements. This principle has been explained above in connection with the first and second actuator members.

According to a further embodiment of the pelt board according to the third and fourth aspects of the present invention, the third wall element is connected to the first wall element at the first radial edge and the fourth wall element is connected to the second wall element at the second radial edge.

By connecting the third wall element to the first wall element at the first radial edge and connecting the fourth wall element to the second wall element at the second radial edge, it may be assured that the third wall element and the fourth wall element moves uniformly and synchronous with the respective first wall element and second wall element. It may also be avoided that the pelt is squeezed in-between the wall element and the arched wall elements at the first and second radial edges.

According to a further embodiment of the pelt board according to the third and fourth aspects of the present invention, the elongated core element comprises a first protrusion adjacent the bottom end, the elongated core element being spring-loaded at the bottom end and defining a centralized relaxed position and a non-centralized loaded position in the first radial direction and/or second radial direction, the first wall element and the second wall element comprise a second protrusion cooperating with the first protrusion such that when the first wall element and the second wall element define the expanded state and the elongated core element defines the centralized related position, the first and second protrusions prevent any longitudinal movement of the elongated core element, whereas when the elongated core element defines the non-centralized loaded position, the first and second protrusions allow longitudinal movement of the elongated core element.

The pelt board according to the third and fourth aspects of the present invention is maintained in the expanded state merely due to the design of and internal friction between the movable parts of the pelt board. The friction increases with the pressure applied to the pelt board and although an increased friction may help keeping the pelt board in the expanded state also when a large inwardly pressure is applied from the pelt, it may also be very difficult to contract the pelt board. Experience has shown that after the drying, when the pelt has shrunk and thus applies a large pressure onto the pelt board, the users have to apply a large manual force to cause the pelt board to collapse. This work is very tedious and may lead to work related injuries.

The locking mechanism described above making use of cooperating protrusions for preventing movement of the elongated core element and thereby contraction of the pelt board allows the pelt board to remain in the expanded state even when exposed to very large inwardly oriented pressure, while reducing the amount of work needed for changing the pelt board into the contracted state. The first and second protrusions will interlock when the elongated core is in its central position, effectively preventing any longitudinal movement of the elongated core, which in turn prevents any radial movement of the wall elements.

By merely exposing the elongated core element to a small radial force, overcoming the friction between the first and second protrusion and the spring constant of the elongated core element, the inwardly oriented pressure from the dried pelt will cause the wall element to move inwardly and the pelt board to contact, while the elongated core element is moved in the longitudinal direction and the first protrusion is passing by the second protrusion. This mechanism will also be less prone to accidental activation since it is not depending on any hard to determine internal friction between the activation members and the cooperating members.

It is evident that the above locking mechanism may be used for a generic pelt board which does not necessarily have to encompass the four way expansion. Such pelt board may e.g. be defined as an elongated pelt board for accommodating an animal pelt, the pelt board defining a longitudinal direction, a first radial direction perpendicular to the longitudinal direction and a second radial direction perpendicular to the longitudinal direction and the first radial direction, the pelt board having a wall element and an elongated core element covered by the wall element, the wall element being capable of assuming an expanded state and a contacted state by longitudinal movement of the elongated core element, the elongated core element comprising a first protrusion adjacent a bottom end of the pelt board, the core element being spring-loaded at the bottom end and defines a centralized relaxed position and a non-centralized loaded position in the first radial direction and/or second radial direction, the wall element comprising a second protrusion cooperating with the first protrusion such that when the wall element define the expanded state and the elongated core element define the centralized related position, the first and second protrusions preventing any longitudinal movement of the elongated core element, whereas when the elongated core element define the non-centralized loaded position, the first and second protrusions allow longitudinal movement of the elongated core element.

The change from expanded state to contracted state may preferably be made when the bottom end of the elongated core element is attached to the drying unit, e.g. by tilting the pelt board sideways, thereby also taking advantage of the leverage provided by the pelt board for overcoming the friction between the first and second protrusions.

The above object, the above features and the above advantage together with numerous other objects, advantages and features which will be evident from the below detailed description of the present invention are according to a fifth aspect of the present invention obtained by a method of manufacturing a pelt board for accommodating an animal pelt, the method comprising:

providing a first wall element defining a first outwardly oriented surface, a first inwardly oriented surface, a first set of oppositely located longitudinal edges and a first actuator member, providing a second wall element defining a second outwardly oriented surface, a second inwardly oriented surface, a second set of oppositely located longitudinal edges and a second actuator member, providing a third wall element defining a third outwardly oriented surface, a third inwardly oriented surface, a third set of oppositely located longitudinal edges and a third actuator member, providing a fourth wall element defining a fourth outwardly oriented surface, a fourth inwardly oriented surface, a fourth set of oppositely located longitudinal edges and a fourth actuator member, providing an elongated core element comprising a first cooperating member, a second cooperating member, a third cooperating member and a fourth cooperating member, positioning the first wall element, the second wall element, the third wall element and the fourth wall element along a longitudinal direction such that the first inwardly oriented surface is facing the second inwardly oriented surface and spaced apart along a first radial direction perpendicular to the longitudinal direction, the third inwardly oriented surface is facing the fourth inwardly oriented surface and spaced apart along a second radial direction perpendicular to the longitudinal direction and the first radial direction such that the first inwardly oriented surface, the second inwardly oriented surface, the third inwardly oriented surface and the fourth inwardly oriented surface together defining a cavity along the longitudinal direction, interacting the first cooperating member, the second cooperating member, the third cooperating member and the fourth cooperating member with the first actuator member of the first wall element, the second actuator member of the second wall element, the third actuator member of the third wall element and the fourth actuator member of the fourth wall element, respectively, and moving the elongated core element in the longitudinal direction relative to the first wall element, the second wall element, the third wall element and the fourth wall element thereby causing the first wall element, the second wall element, the third wall element and the fourth wall element to move between a contracted state and an expanded state, when in the contracted state the first radial distance and the second radial distance between the first inwardly oriented surface and the second inwardly oriented surface, and, the third inwardly oriented surface and the fourth inwardly oriented surface, respectively, are reduced, whereas, when in the expanded state the first radial distance and the second radial distance between the first inwardly oriented surface and the second inwardly oriented surface, and, the third inwardly oriented surface and the fourth inwardly oriented surface, respectively, are increased.

The above object, the above features and the above advantage together with numerous other objects, advantages and features which will be evident from the below detailed description of the present invention are according to a sixth aspect of the present invention obtained by a method of manufacturing a pelt board for accommodating an animal pelt, the method comprising:

providing a first wall element defining a first outwardly oriented surface, a first inwardly oriented surface, a first set of oppositely located longitudinal edges and a first actuator member, providing a second wall element defining a second outwardly oriented surface, a second inwardly oriented surface, a second set of oppositely located longitudinal edges and a second actuator member, providing a third wall element defining a third outwardly oriented surface, a third inwardly oriented surface, a third set of oppositely located longitudinal edges and a third actuator member, providing a fourth wall element defining a fourth outwardly oriented surface, a fourth inwardly oriented surface, a fourth set of oppositely located longitudinal edges and a fourth actuator member, providing an elongated core element comprising a first cooperating member, a second cooperating member, a third cooperating member and a fourth cooperating member, positioning the first wall element, the second wall element, the third wall element and the fourth wall element along a longitudinal direction such that the first inwardly oriented surface is facing the second inwardly oriented surface and spaced apart along a first radial direction perpendicular to the longitudinal direction, the third inwardly oriented surface is facing the fourth inwardly oriented surface and spaced apart along a second radial direction perpendicular to the longitudinal direction and the first radial direction such that the first inwardly oriented surface, the second inwardly oriented surface, the third inwardly oriented surface and the fourth inwardly oriented surface together defining a cavity along the longitudinal direction, interacting the first cooperating member, the second cooperating member, the third cooperating member and the fourth cooperating member with the first actuator member of the first wall element, the second actuator member of the second wall element, the third actuator member of the third wall element and the fourth actuator member of the fourth wall element, respectively, and moving the elongated core element in the longitudinal direction relative to the first wall element, the second wall element, the third wall element and the fourth wall element thereby causing the first wall element, the second wall element, the third wall element and the fourth wall element to move between a contracted state and an expanded state, when in the contracted state the first radial distance and the second radial distance between the first inwardly oriented surface and the second inwardly oriented surface, and, the third inwardly oriented surface and the fourth inwardly oriented surface, respectively, are reduced, whereas, when in the expanded state the first radial distance and the second radial distance between the first inwardly oriented surface and the second inwardly oriented surface, and, the third inwardly oriented surface and the fourth inwardly oriented surface, respectively, are increased.

The above object, the above features and the above advantage together with numerous other objects, advantages and features which will be evident from the below detailed description of the present invention are according to a seventh aspect of the present invention obtained by a method of manufacturing a pelt board for accommodating an animal pelt, the method comprising:

providing a first wall element defining a first outwardly oriented surface, a first inwardly oriented surface, a first set of oppositely located longitudinal edges and a first actuator member, providing a second wall element defining a second outwardly oriented surface, a second inwardly oriented surface, a second set of oppositely located longitudinal edges and a second actuator member, said first wall element and said second wall element being of identical configuration and each having a low curvature part and a high curvature part joint together along a line of junction extending generally in said longitudinal direction, said low curvature part of said first wall element defining a first longitudinal edge of said first set of oppositely located longitudinal edges, said high curvature part of said first wall element defining a second longitudinal edge of said first set of oppositely located longitudinal edges, said low curvature part of said second wall element defining a first longitudinal edge of said second set of oppositely located longitudinal edges, said high curvature part of said second wall element defining a second longitudinal edge of said second set of oppositely located longitudinal edges, said first edge of said first wall element being positioned juxtaposed said second edge of said second wall element and said first edge of said second wall element being positioned juxtaposed said second edge of said first wall element, said first inwardly oriented surface and said second inwardly oriented surface together defining a cavity along said longitudinal direction, providing an elongated core element comprising a first cooperating member and a second cooperating member, positioning said first wall element and said second wall element along a longitudinal direction such that said first inwardly oriented surface is facing said second inwardly oriented surface and spaced apart along a first radial direction perpendicular to said longitudinal direction, such that said first inwardly oriented surface and said second inwardly oriented surface together define a cavity along said longitudinal direction, interacting said first cooperating member and said second cooperating member with said first actuator member of said first wall element and said second actuator member of said second wall element, respectively, and moving said elongated core element in said longitudinal direction relative to said first wall element and said second wall element causing said first wall element and said second wall element to move between a contracted state in which said first radial distance between said first inwardly oriented surface and said second inwardly oriented surface is reduced, in which said first edge of said first wall element is positioned closely against said second edge of said second wall element, and in which said first edge of said second wall element is positioned closely against said second edge of said first wall element, and an expanded state in which said first radial distance between said first inwardly oriented surface and said second inwardly oriented surface is increased, in which said first edge of said first wall element and said second edge of said second wall element is positioned in spaced apart relationship in said first radial direction, and in which said first edge of said second wall element and said second edge of said first wall element are positioned in spaced apart relationship and said first radial direction.

The above object, the above features and the above advantage together with numerous other objects, advantages and features which will be evident from the below detailed description of the present invention are according to a eighth aspect of the present invention obtained by a method of manufacturing a pelt board for accommodating an animal pelt, the method comprising:

providing a first wall element defining a first outwardly oriented surface, a first inwardly oriented surface, a first set of oppositely located longitudinal edges and a first actuator member, providing a second wall element defining a second outwardly oriented surface, a second inwardly oriented surface, a second set of oppositely located longitudinal edges and a second actuator member, said first wall element and said second wall element being of identical configuration and each having a low curvature part and a high curvature part joint together along a line of junction extending generally in said longitudinal direction, said low curvature part of said first wall element defining a first longitudinal edge of said first set of oppositely located longitudinal edges, said high curvature part of said first wall element defining a second longitudinal edge of said first set of oppositely located longitudinal edges, said low curvature part of said second wall element defining a first longitudinal edge of said second set of oppositely located longitudinal edges, said high curvature part of said second wall element defining a second longitudinal edge of said second set of oppositely located longitudinal edges, said first edge of said first wall element being positioned juxtaposed said second edge of said second wall element and said first edge of said second wall element being positioned juxtaposed said second edge of said first wall element, said first inwardly oriented surface and said second inwardly oriented surface together defining a cavity along said longitudinal direction, providing an elongated core element comprising a first cooperating member and a second cooperating member, positioning said first wall element and said second wall element along a longitudinal direction such that said first inwardly oriented surface is facing said second inwardly oriented surface and spaced apart along a first radial direction perpendicular to said longitudinal direction, such that said first inwardly oriented surface and said second inwardly oriented surface together define a cavity along said longitudinal direction, interacting said first cooperating member and said second cooperating member with said first actuator member of said first wall element and said second actuator member of said second wall element, respectively, and moving said elongated core element in said longitudinal direction relative to said first wall element and said second wall element causing said first wall element and said second wall element to move between a contracted state in which said first radial distance between said first inwardly oriented surface and said second inwardly oriented surface is reduced, in which said first edge of said first wall element is positioned closely against said second edge of said second wall element, and in which said first edge of said second wall element is positioned closely against said second edge of said first wall element, and an expanded state in which said first radial distance between said first inwardly oriented surface and said second inwardly oriented surface is increased, in which said first edge of said first wall element and said second edge of said second wall element is positioned in spaced apart relationship in said second radial direction, and in which said first edge of said second wall element and said second edge of said first wall element are positioned in spaced apart relationship and said first radial direction.

The above methods according to the fifth, sixth, seventh and eighth aspects of the present invention may preferably be used together with the pelt board according to the first aspect. The wall elements and the elongated core are preferably made as separate molded plastic items. The wall elements are typically snap fitted together. In some cases, any of the first wall element, the second wall element, the third wall element and the fourth wall element may constitute two or more items which are snap fitted together.

In addition to the above described shortcomings of the prior art pelt boards, it has been revealed by the applicant company that the pelt boards and their associated drying units usually embodied as drying boxes exhibit serious drawbacks as to their drying capability. Through experiments, which have been carried out by the applicant company, it has been revealed that a particular drawback of the prior art pelt boards relating to the drying capability has to do with a physical limitation of the air volume, which may be input into the pelt board for establishing the drying of the pelt received and fixated relative to the pelt board, and in view of this realization, it is a further object of the present invention to improve the drying capability of the pelt boards by use of an associated and cooperating drying unit, which together with its pelt board or pelt boards improve the overall drying capability or in the alternative, drying time used for the drying of pelts by use of the pelt boards and the corresponding drying unit.

The above objects, the above features and the above advantages together with the above described specific objects of improving the drying capability of the pelt boards and the associated drying units together with numerous other objects, advantages and features, which will be evident from the below detailed description of the present invention, are according to a ninth aspect of the present invention obtained by a system for drying a pelt, said system comprising a drying unit and a pelt board, said pelt having a substantially tubular shape defining an inwardly oriented leather side and an outwardly oriented fur side and further defining a nose end and a rear end, said pelt board defining a top end for accommodating and fixating said nose end of said pelt, a circumferential and apertured wall defining an inner cavity and an outer surface for facing said inwardly oriented leather side of said pelt and a bottom end opposite said top end, said pelt board defining an outer bottom end contour at said bottom end, said outer bottom end contour defining a bottom end area, said pelt board further having a connector extending outwardly from said bottom end and adapted for connecting said pelt board to said drying unit, said drying unit having a housing defining a top surface and including a blower or communicating with a blower assembly for supplying air into said housing, said top surface defining a receptor aperture having a configuration matching said connector of said pelt board and serving to receive said connector for supporting said pelt board in an upright position relative to said top surface, an air inlet being provided into said inner cavity at said bottom end of said pelt board for allowing air to be introduced into said inner cavity and to be forced out through said apertured wall for the drying of said inwardly oriented leather side of said pelt, said air inlet defining an inlet area constituting at least 15% of said bottom area of said pelt board and less than approximately 95% of said bottom area, and preferably more than 30% of said bottom area, such as further preferably approximately 45-50% of said bottom area of said pelt board, and an air outlet being provided at said top surface of said housing for communicating with said air inlet and defining an outlet area constituting between 15% and 95% of said bottom area, such as preferably more than 30%, such as preferably 45-50% of said bottom area of said pelt board.

According to the investigations and experiments carried out by the applicant, which will be discussed below, it has been revealed that the pelt boards which have been developed by the applicant company and also the competitor company Jasopels A/S and known as 'FIX-tane 2' and 'XL-tane', respectively, have inherently a limitation as to the volume of air, which may be forced through the pelt boards, which limitation is primarily determined by the air inlet into the pelt board in question, which air inlet is established through the connector of the pelt board, which connector is in the prior art described as a "stubby element". Apart from the inlet limitation, the overall configuration and in particular the apertured outer surface of the pelt board also establishes a limitation as to the air inlet capability or volumetric air inlet capability of the prior art pelt boards. In accordance with the teachings of the present invention as defined in the ninth aspect of the present invention, the air outlet from the drying unit and the air inlet into the pelt board, which drying unit and pelt board constitute a system according to the ninth aspect of the present invention, exhibit a large interface area allowing a substantive increase of the air inlet into the pelt board, which again improves the drying capability or reduces the drying time for the drying of the pelts mounted on the pelt boards. It is in this context to be realized that an extended drying time may in itself deteriorate the pelt for the reason that the existence of wet areas at the leather side of the pelt may generate so-called black spots, which eventually deteriorate the pelts and reduces the commercial value of the pelt.

In accordance with the presently preferred embodiment of the system according to the ninth aspect of the present invention, the air inlet area and the air outlet area are of the same size or alternatively of substantially the same size, simply for gaining the benefit of the large inlet area of the pelt board. As will be evident from the below detailed description of experiments carried out by the applicant company, it will be verified that an increase of the inlet area above approximately 45-50% of the bottom area provides a rather limited increase in the drying capability of the pelt board and the overall system, as it is contemplated that the dominating factor in determining the maximum drying capability and the maximum volume of air, which may be forced into the drying pelt, is in an embodiment in which the inlet air exceeds 50% of the bottom area predominantly determined or limited by the apertured wall of the pelt board.

The air inlet of the pelt board may be constituted by a single large aperture at the bottom of the pelt board or alternatively be implemented by several individual air inlets, which are preferably located circumferentially encircling the connector of the pelt board simply for increasing the flow of air into the pelt board along the central axis of the pelt board. Similarly, the air outlet of the drying unit may advantageously in accordance with and in conformity with the above embodiment of the pelt board be located circumferentially encircling the receptor aperture.

In accordance with the prior art technique as implemented in the commercially available products produced and sold by the applicant company and also the competitor company Jasopels A/S, the connector may have additional inlet slots for allowing air to be introduced into the inner cavity from the housing of the drying unit through the slots, which additional slots evidently further increase the volumetric input of air into the pelt board.

In accordance with specific further embodiments of the system according to the ninth aspect of the present invention, two adaptors are provided, the one serving for allowing a conventional drying unit to be used in combination with the drying unit of the system according to the ninth aspect of the present invention, and the alternative or second embodiment constituting an adaptor allowing the pelt board of the system according to the ninth aspect of the present invention to be used in combination with the conventional drying unit to be used in combination with the conventional or prior art pelt board such as the above described pelt boards produced by the applicant company and the competitor company Jasopels A/S. According to these two distinct embodiments of the system according to the ninth aspect of the present invention, the system further comprises a first adaptor having an inlet end configured in conformity with said bottom end of said pelt board and having an opposite closed-off upper end, in which a minor air outlet aperture, such as an aperture of the size of 400 $mm^2$, is provided for allowing air to be output through said minor air outlet aperture for input into a conventional pelt board having a smaller size connector through which air is input into the inner cavity of the pelt board through the connector, said first adaptor having a first inner air passage from said air inlet to said minor air outlet aperture, and still further comprises a second adaptor having an outlet configured in conformity with said bottom end of said pelt board and having an opposite closed-off bottom end, from which a smaller size connector extends, said smaller size connector having inlet slots for allowing air to be introduced into the inner space of said second adaptor through said smaller size connector, said second adaptor having a second inner air passage from said small size connector to said air outlet.

In accordance with the system according to the ninth aspect of the present invention, the drying unit is advantageously embodied for receiving a plurality of pelt boards and the system consequently further, according to the presently preferred embodiment of the system according to the ninth aspect of the present invention comprises a set of pelt boards and a housing of the drying unit, and similarly has a plurality of receptor apertures and air outlets.

In order to improve the drying capability of the system according to the ninth aspect of the present invention, the drying unit preferably has biased closing-off plates for closing off receptor apertures and corresponding air outlets, in which receptor apertures no pelt board is received, simply to prevent that the air forced into the housing of the drying unit is outlet through open receptor apertures and corresponding air outlets without being introduced into the pelt boards, on which pelts are mounted and consequently being wasted in relation to the intentional purpose of forcing air into the housing of the drying unit, namely of causing the air to be outlet from the housing of the drying unit and input into the pelt boards, on which pelts are received.

It is to be realized that the system according to the ninth aspect of the present invention and particularly the pelt board of the system according to the ninth aspect of the present invention may be implemented in accordance with the above described aspects of the present invention relating to the advantageous embodiments of the expandable and collapsible pelt boards.

The above objects, the above features and the above advantages together with the above described specific objects of improving the drying capability of the pelt boards and the associated drying units together with numerous other objects, advantages and features will be evident from the below detailed description of the present invention, which are according to a tenth aspect of the present invention obtained by a drying unit for use in combination with a pelt board and for drying a pelt, said pelt having a substantially tubular shape defining an inwardly oriented leather side and an outwardly oriented fur side and further defining a nose end and a rear end, said drying unit having a housing defining a top surface and including a blower or communicating with a blower assembly for supplying air into said housing, said top surface defining a receptor aperture having a configuration matching a connector of said pelt board and serving to receive said connector for supporting said pelt board in an upright position relative to said top surface, and an air outlet being provided at said top surface of said housing defining an outlet area constituting between 15% and 95% of said bottom area, such as preferably more than 30%, such as preferably 45-50% of said bottom area of said pelt board.

The drying unit according to the tenth aspect of the present invention may advantageously include any of the features of the above described system according to the ninth aspect of the present invention.

The above objects, the above features and the above advantages together with the above described specific objects of improving the drying capability of the pelt boards and the associated drying units together with numerous other objects, advantages and features, which will be evident from the below detailed description of the present invention, are according to an eleventh aspect of the present invention obtained by a pelt board for use in combination with a drying unit for drying a pelt, said pelt having a substantially tubular shape defining an inwardly oriented leather side and an outwardly oriented fur side and further defining a nose end and a rear end, said pelt board defining a top end for accommodating and fixating said nose end of said pelt, a circumferential and apertured wall defining an inner cavity and an outer surface for facing said inwardly oriented leather side of said pelt and a bottom end opposite said top end, said pelt board defining an outer bottom end contour at said bottom end, said outer bottom end contour defining a bottom end area, said pelt board further having a connector extending outwardly from said bottom end and adapted for connecting said pelt board to said drying unit, and an air inlet being provided into said inner cavity at said bottom end of said pelt board for allowing air to be introduced into said inner cavity and to be forced out through said apertured wall for the drying of said inwardly oriented leather side of said pelt, said air inlet defining an inlet area constituting at least 15% of said bottom area of said pelt board and less than approximately 95% of said bottom area, and preferably more than 30% of said bottom area, such as further preferably approximately 45-50% of said bottom area of said pelt board.

The pelt board according to the eleventh aspect of the present invention may, apart from any of the features of the pelt board defined in the system according to the ninth aspect of the present invention, preferably and advantageously include features according to the above described aspects relating to the expandable and collapsible pelt boards according to the previously described aspects of the present invention.

The above objects, the above features and the above advantages together with the above described specific objects of improving the drying capability of the pelt boards and the associated drying units together with numerous other objects, advantages and features, which will be evident from the below detailed description of the present invention, are according to an twelfth aspect of the present invention obtained by an adaptor for use in combination with a drying unit for drying a pelt, and a pelt board, said pelt having a substantially tubular shape defining an inwardly oriented leather side and an outwardly oriented fur side and further defining a nose end and a rear end, said pelt board and said drying unit defining an air transfer area between the bottom end of said pelt board and an air outlet of said drying unit constituting between 15% and 95% of the bottom end area of said pelt board, such as preferably more than 30%, such as preferably 45-50% of said bottom area of said pelt board, said adaptor having an inlet end configured in conformity with said bottom end of said pelt board and having an opposite closed-off upper end, in which a minor air outlet aperture, such as an aperture of the size of 400 $mm^2$, is provided for allowing air to be output through said minor air outlet aperture for input into a conventional pelt board having a smaller size connector through which air is input into the inner cavity of the pelt board through the connector, said first adaptor having an inner air passage from said air inlet to said minor air outlet aperture.

The above objects, the above features and the above advantages together with the above described specific objects of improving the drying capability of the pelt boards and the associated drying units together with numerous other objects, advantages and features, which will be evident from the below detailed description of the present invention, are according to an thirteenth aspect of the present invention obtained by an adaptor for use in combination with a drying unit for drying a pelt, and a pelt board, said pelt having a substantially tubular shape defining an inwardly oriented leather side and an outwardly oriented fur side and further defining a nose end and a rear end, said pelt board having a smaller size connector at its bottom end, through which smaller size connector air is input into the inner cavity of the pelt board, and said drying unit having a minor receptor and air outlet aperture for receiving said smaller size connector, such as an aperture of the size of 400 $mm^2$, said adaptor having an inlet end including said smaller size connector and having an opposite upper end, in which an air outlet aperture of the size of 1000 $mm^2$-2500 $mm^2$ is provided for allowing air to be output through said air outlet aperture for input into a pelt board having an air inlet of the size of 1000 $mm^2$-2500 $mm^2$ into an inner cavity of said pelt board, said adaptor having an inner air passage from said smaller size connector to said air outlet aperture.

The above objects, the above features and the above advantages together with the above described specific objects of improving the drying capability of the pelt boards and the associated drying units together with numerous other objects, advantages and features, which will be evident from the below detailed description of the present invention, are according to a fourteenth aspect of the present invention obtained by a system for drying a pelt, said system comprising a drying unit and a pelt board, said pelt having a substantially tubular shape defining an inwardly oriented leather side and an outwardly oriented fur side and further defining a nose end and a rear end, said pelt board defining a top end for accommodating and fixating said nose end of said pelt, a circumferential and apertured wall defining an inner cavity and an outer surface for facing said inwardly oriented leather side of said pelt and a bottom end opposite said top end, said pelt board defining an outer bottom end contour at said bottom end, said outer bottom end contour defining a bottom end area, said drying unit having a housing defining a top surface and including a blower or communicating with a blower assembly for supplying air into said housing, an air inlet being provided into said inner cavity at said bottom end of said pelt board for allowing air to be introduced into said inner cavity and to be forced out through said apertured wall for the drying of said inwardly oriented leather side of said pelt, and an air outlet being provided at said top surface of said housing for communicating with said air inlet via an interface there between, said interface establishing connection between said pelt board and said drying unit for supporting said pelt board in an upright position relative to said top surface defining an interface area constituting at least 15% of said bottom area of said pelt board less than approximately 95% of said bottom area, and preferably more than 30% of said bottom area, such as further preferably approximately 45-50% of said bottom area of said pelt board.

The above objects, the above features and the above advantages together with the above described specific objects of improving the drying capability of the pelt boards and the associated drying units together with numerous other objects, advantages and features will be evident from the below detailed description of the present invention, are according to a fifteenth aspect of the present invention obtained by a drying unit for use in combination with a pelt board and for drying a pelt, said pelt having a substantially tubular shape defining an inwardly oriented leather side and an outwardly oriented fur side and further defining a nose end and a rear end, said drying unit having a housing defining a top surface and including a blower or communicating with a blower assembly for supplying air into said housing, said top surface defining an interface relative to said pelt board for supporting said pelt board in an upright position relative to said top surface and for allowing air to be input to an inner cavity of said pelt board from said drying unit, said interface defining an interface area between said pelt board and said top surface constituting between 15% and 95% of the bottom area of said pelt board, such as preferably more than 30%, such as preferably 45-50% of said bottom area of said pelt board.

The above objects, the above features and the above advantages together with the above described specific objects of improving the drying capability of the pelt boards and the associated drying units together with numerous other objects, advantages and features will be evident from the below detailed description of the present invention, are according to a fifteenth aspect of the present invention obtained by a drying unit for use in combination with a pelt board and for drying a pelt, the pelt having a substantially tubular shape defining an inwardly oriented leather side and an outwardly oriented fur side and further defining a nose end and a rear end, the drying unit having a housing defining a top surface and including a blower or communicating with a blower assembly for supplying air into the housing, the top surface defining an interface relative to the pelt board for supporting the pelt board in an upright position relative to the top surface and for allowing air to be input to an inner cavity of the pelt board from the drying unit, the interface defining an interface area between the pelt board and the top surface constituting between 15% and 95% of the bottom area of the pelt board, such as preferably more than 30%, such as preferably 45-50% of the bottom area of the pelt board.

It is to be realized that the system according to the fourteenth aspect of the present invention and particularly the pelt board of the system according to the fourteenth aspect of the present invention and further the drying unit according to the fifteenth aspect of the present invention may be implemented in accordance with the above described aspects of the present invention relating to the advantageous embodiments of the expandable and collapsible pelt boards.

DETAILED DESCRIPTION OF THE DRAWINGS

Figure 1A:
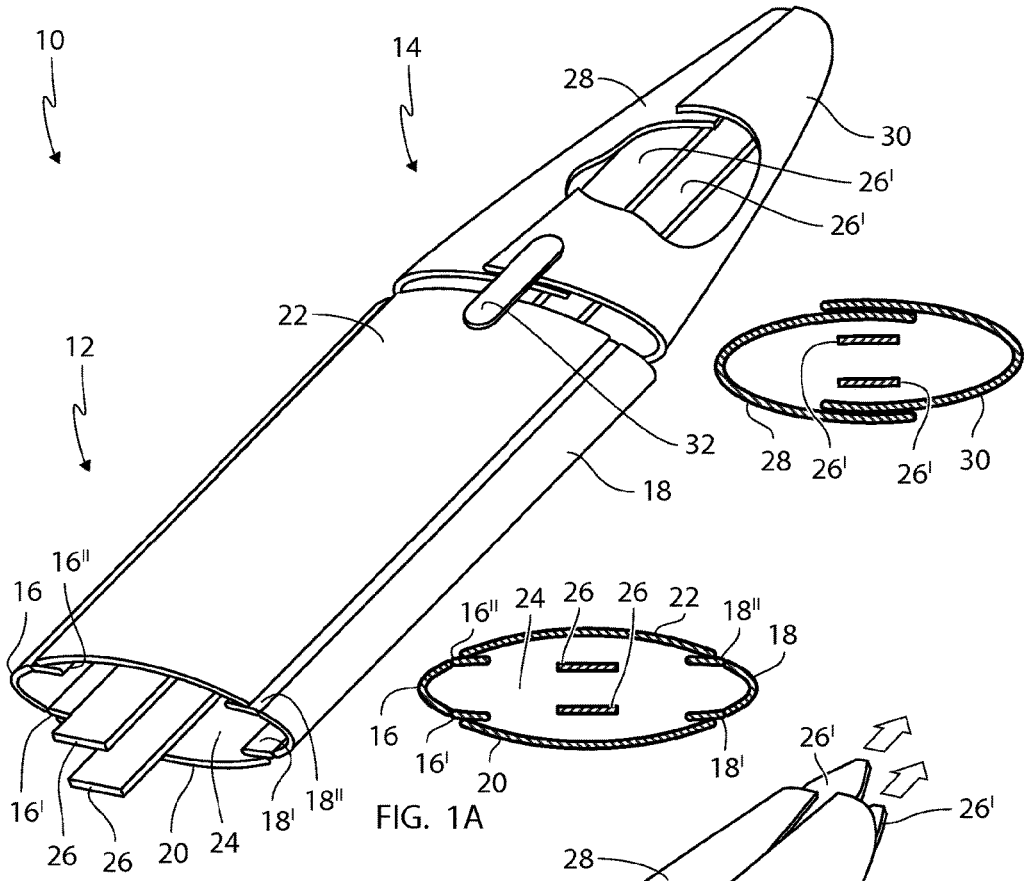
FIG. 1A illustrates a contracted pelt board according to the present invention.
Figure 1B:
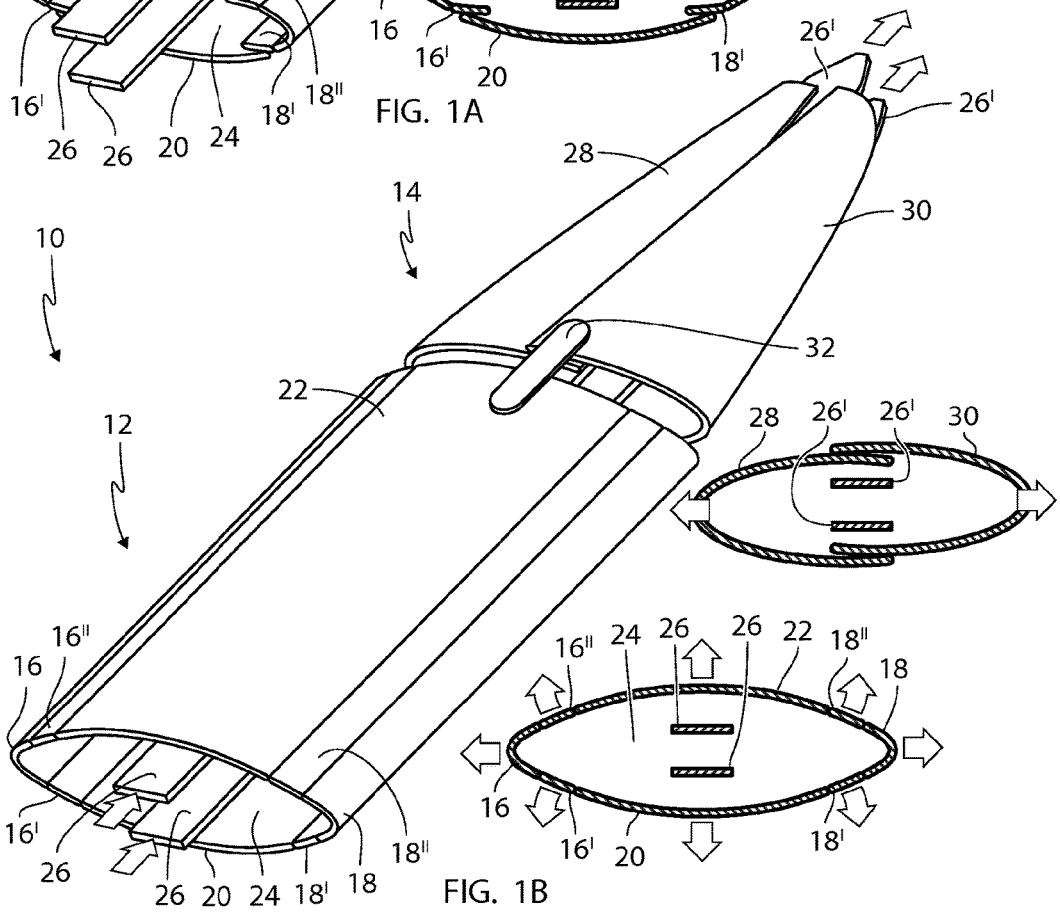
FIG. 1B illustrates an expanded pelt board according to the present invention.

In the below detailed description of the various embodiments described with reference to the drawings, the same reference numerals are used throughout the figures identifying identical components described only once in the first occurrence of the element. Elements or components serving the same purpose or being configured similar to previously described components or elements, respectively, are designated the same reference numeral as previously indicated, however, added a marking to identify the geometrical difference from the previously described component or element, still, to the use of the same integer identifying the correspondence as to function and structure. It is further contemplated that elements or components from one embodiment described below may readily be combined with another embodiment with reference to a different figure, as the various variants of embodiments are readily interchangeable and/or elements or components from one embodiment being readily substituted with or by components or elements of another embodiment.

FIG. 1A shows a perspective view of a first embodiment of a pelt board 10 in the contracted state. The pelt board 10 comprises a lower part 12 and an upper part 14. The lower part 12 comprises a first arched wall element 16, a second wall element 18, a third wall element 20, a fourth wall element 22 which together define a cavity 24 in which an elongated core element 26 is located. The first arched wall element 16, the second wall element 18, the third wall element 20 and the fourth wall element 22 are shown here schematically as being solid, it is however understood that for optimal drying of the pelt, they should be louvered for allowing ventilation air to pass from the pelt board to the pelt. The upper part 14 comprise a fifth wall element 28 and a sixth wall element 30, both which in the present case are arched and tapered but which also may be made non-arched and non-tapered. The elongated core element 26 extends into the upper part 14 in the form of a core extension element 26'.

The first wall element 16 and the second wall element 18 comprises respective peripheral elements 16' 16" 18' 18", which are flexibly connected to the center elements of the respective first wall element 16 and the second wall element 18. The third wall element 20 will in the present contracted state overlap the peripheral elements 16' 18' and the fourth wall element 20 will in the present contracted state overlap the peripheral elements 16" 18". The fifth wall element 28 and a sixth wall element 30 both mutually overlap each other. An extension element 32 is interconnecting the lower part 12 and the upper part 14.

âFIG. 1B shows a perspective view of the first embodiment of the pelt board 10 in the expanded state. By pushing the elongated core element 26 in a longitudinal direction as shown by the arrows, the wall elements are all forced in outwardly oriented directions as shown by the arrows. The first wall element 16 and the fifth wall element 28 are moved along a first radial dimension while the second wall element 18 and the sixth wall element 30 are moved along the first radial dimension but in the opposite direction, the first radial dimension being perpendicular to the longitudinal direction defined by the elongated core element 26. The third wall element 20 and the fourth wall element 22 are forced in opposite directions along a second radial direction as shown by the arrows, which second radial direction is perpendicular to both the first radial dimension and to the longitudinal dimension. The peripheral portions 16' 16" 18' 18" of the respective first wall element 16 and second wall element 18 move along both the first and second radial dimensions such that the expanded pelt board 10' form a smooth outer surface.

Figure 2A:
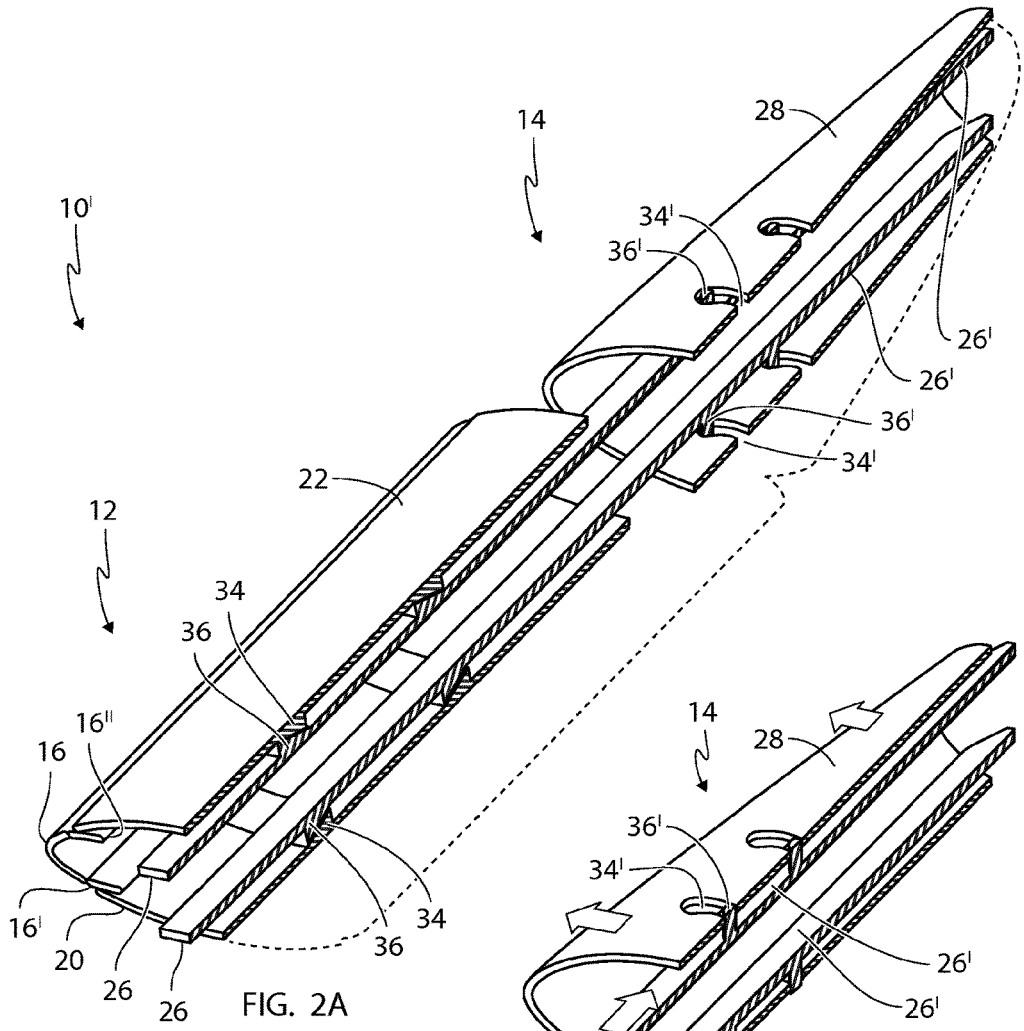
FIG. 2A illustrates a cut out view of a contracted pelt board.

FIG. 2A shows a cut-out perspective view of another embodiment of a pelt board 10' in the contracted state. The third wall element 20 and the fourth wall element 22 comprise actuator members 34 along the longitudinal dimension and the elongated core element 26 comprise cooperating members 36 along the longitudinal dimension. The actuator members 34 and cooperating members 36 define opposing wedges. In the contracted state of the pelt board 10, the sloping surfaces of the opposing wedges are non-overlapping or overlapping such that no outwardly oriented force is generated, i.e. that the protruding portions of the opposing wedges are non-overlapping.

The fifth wall element 28 and the sixth wall element 30 comprise actuator members 34' along the longitudinal dimension and the elongated core element 26 comprise cooperating members 36' along the longitudinal dimension. The actuator members 34' define curved grooves along the longitudinal dimension of the fifth wall element 28 and the sixth wall element 30 whereas the cooperating members 36 define pins of the core extension element 26'.

Figure 2B:
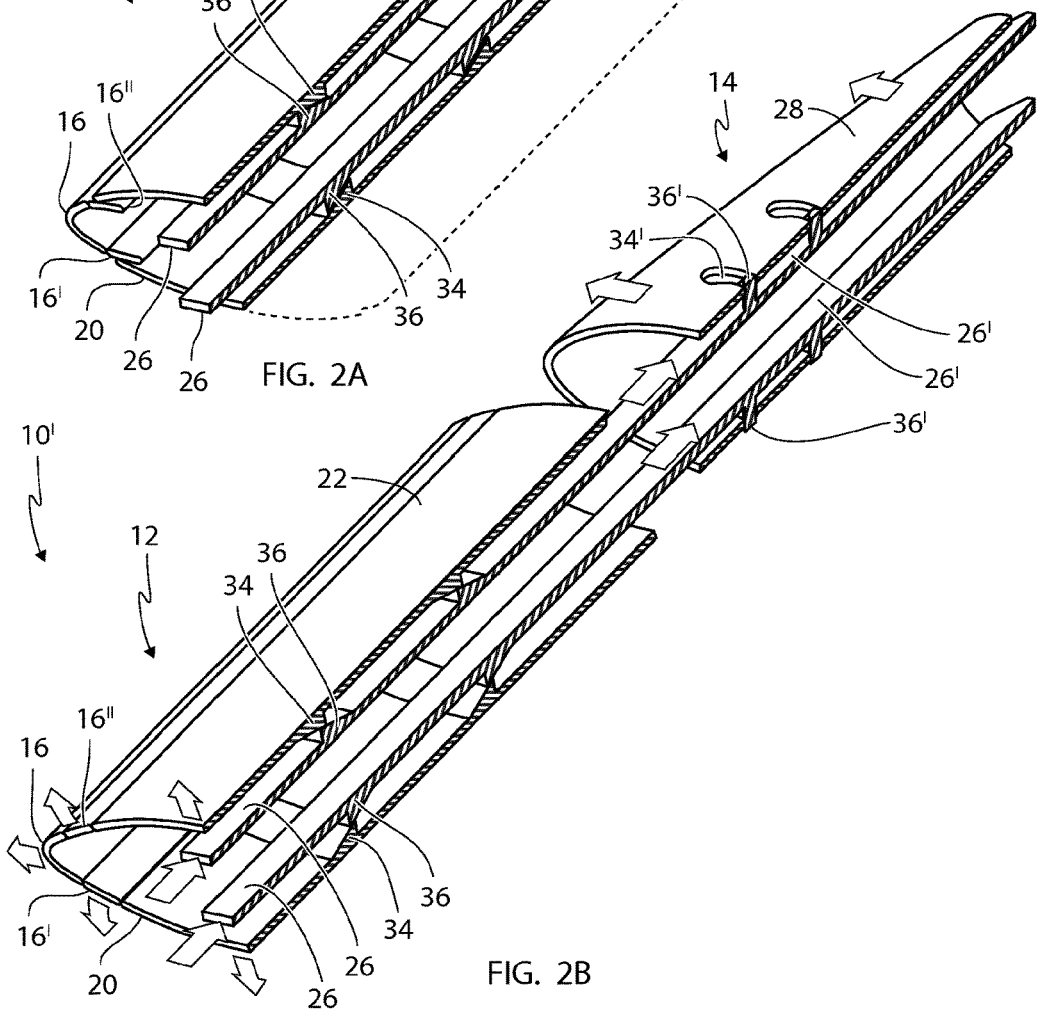
FIG. 2B illustrates a cut out view of an expanded pelt board.

FIG. 2B shows a cut-out perspective view of the pelt board 10' in the expanded state. The sloping surfaces of the opposing wedges are now overlapping such that an outwardly oriented force is achieved, i.e. the protruding parts of the opposing wedges are overlapping causing the third wall element 20 and the fourth wall element 22 to move outwardly in opposite directions.

When the core extension element 26' moves together with the elongated core element 26 along the longitudinal dimension, the pins constituting the cooperating members 36' move along the curved grooves constituting the actuator members 34' and thereby causing the fifth wall element 28 and the sixth wall element to move outwardly in opposite directions.

The movement of the first wall element 16 and the second wall element 18 will be explained in detail in the following figures.

Figure 3:
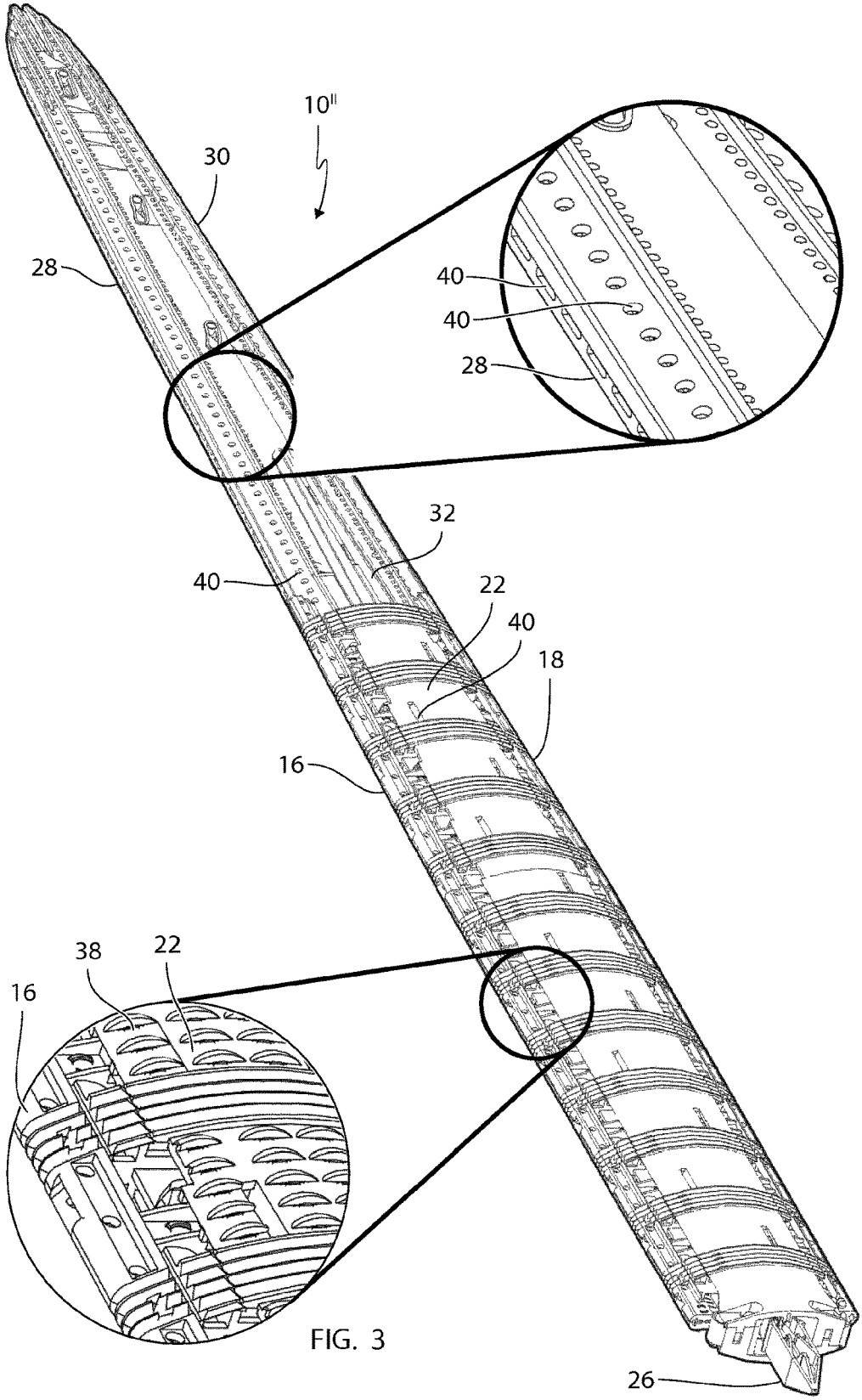
FIG. 3 illustrates a further pelt board embodiment according to the present invention.

FIG. 3 shows a perspective view of a further embodiment of a pelt board 10". In the present embodiment, the fifth wall element 28 and the sixth wall element 30 are substantially flat in order to be able to accommodate the neck part of the animal pelt. The surface of the arched wall elements 16 18 20 22 have ribs 38 for allowing the pelt to be properly fixated to the pelt board 10". Further all of the wall elements 16 18 20 22 have ventilation holes 40.

Figure 4:
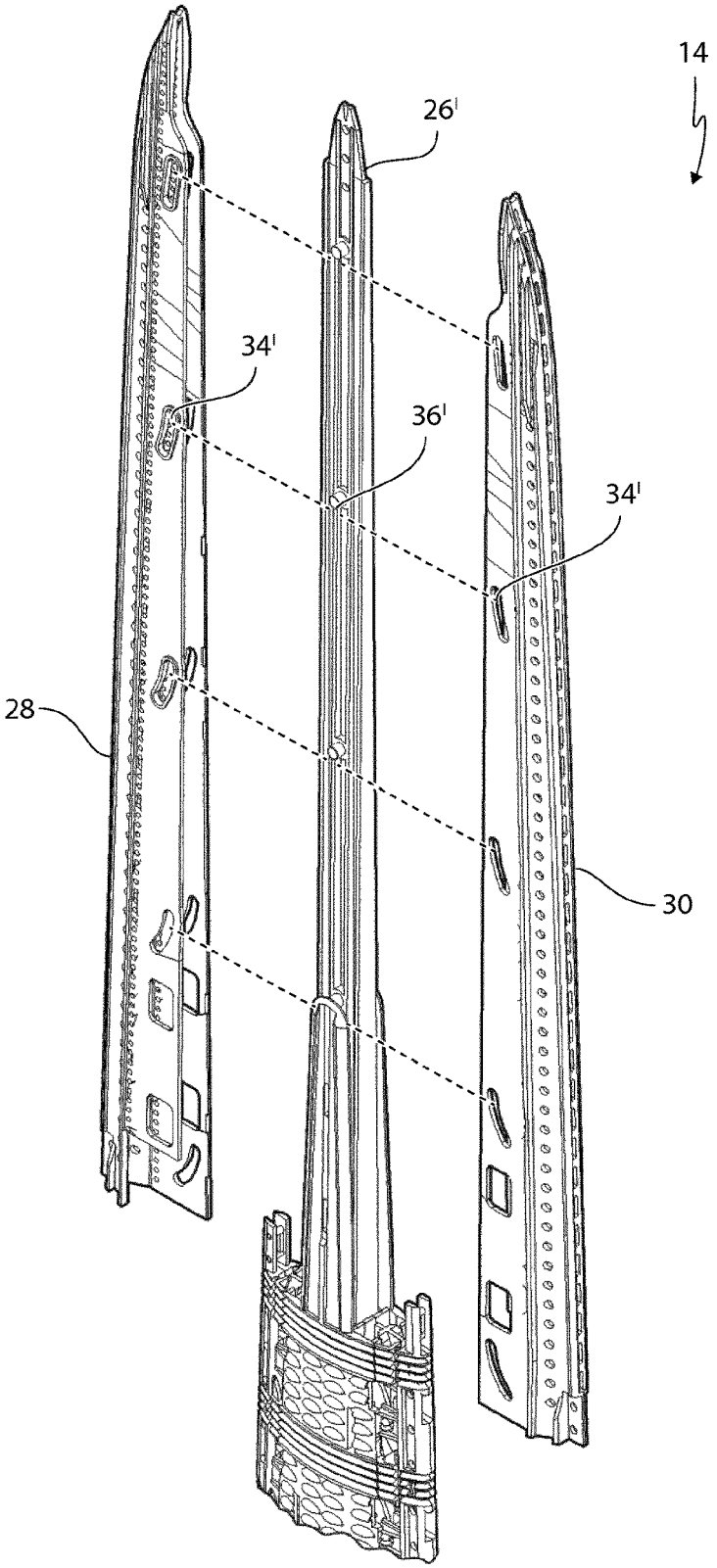
FIG. 4 illustrates the upper part of a pelt board according to the present invention.

FIG. 4 shows a perspective view of the upper part 14 of the pelt board 10". It shows in detail how the fifth wall element 28 and the sixth wall element 30 both connect to the core extension element 26'. The actuator elements 34' in form of curved grooves connect to the cooperating members 36' in the form of pins. By longitudinal movement of the core extension element 26', the pins will follow the path defined by the curved grooves and thus cause the fifth wall element 28 and the sixth wall element 30 to move outwardly along the curve defined by the interaction between the curved grooves and the pins.

Figure 5:
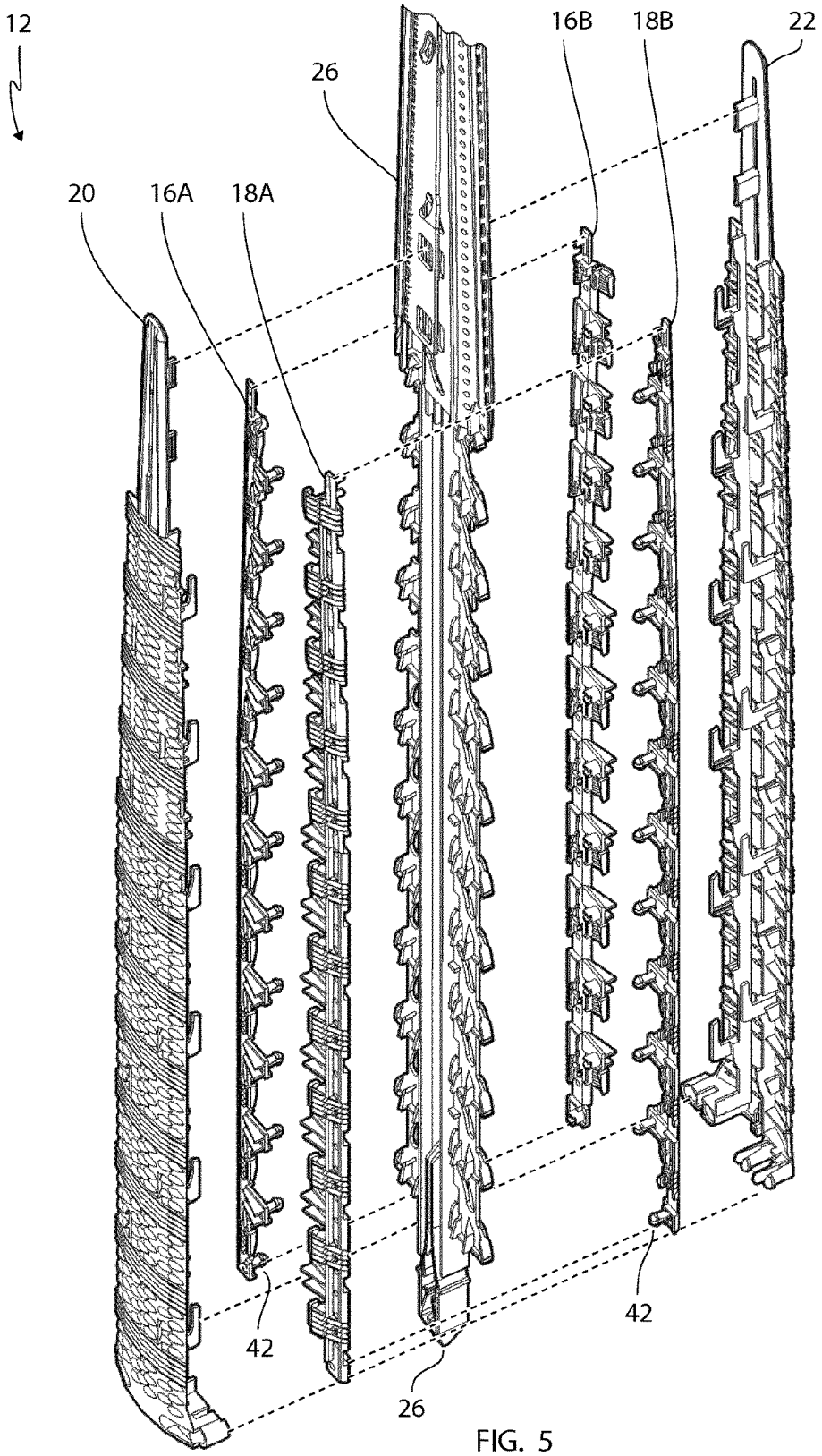
FIG. 5 illustrates the lower part of a pelt board according to the present invention.

FIG. 5 shows a perspective view of the lower part 12 of the pelt board 10". In the present embodiment the first wall element 16 is composed of two elements designated the reference numerals 16A and 16B which are interconnected by means of a snap fit connection 42. Also, the second wall element 18 is composed of two elements designated the reference numerals 18A and 18B and which are interconnected by means of a snap fit connection 42.

Figure 6A:
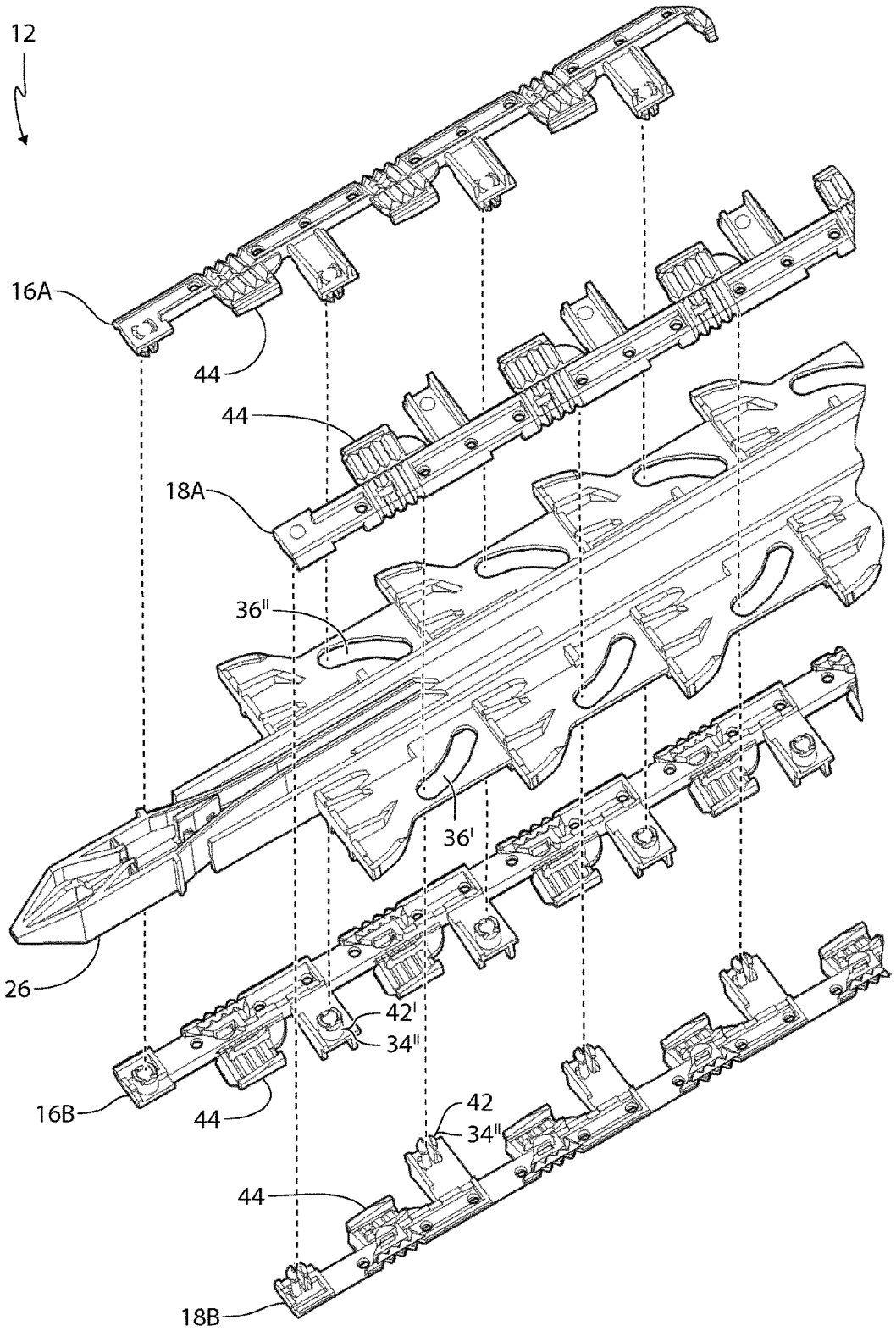
FIG. 6A illustrates the assembly of a pelt board according to the present invention.

FIG. 6A shows a perspective view of the lower part 12 of the pelt board 10". The present view especially shows a close-up view of the elements 16A 16B 18A 18B making up the first wall element 16 and the second wall element 18, respectively. In order to make the first wall element 16 and the second wall element 18 move in the first radial direction, the snap fit mechanisms 42 42', when assembled, define actuator members 34" in the form of pins. The elongated core element 26 defines cooperating members 36" in the form of curved grooves. The working principle of the curved groove and the pin is the same as for the upper part of the pelt board 10". The pins are guided by the curved grooves and forced inwardly/outwardly according to the longitudinal movement of the elongated core element 26. Thereby, the first wall element 16 and the second wall element 18 move along the first radial dimension and at the same time the first wall element 16 and the second wall element 18 are held by the elongated core element 26.

The wall elements 16A 16B 18A 18B also each comprise a number of respective peripheral parts 44 which are flexibly connected to its corresponding wall elements 16A 16B 18A 18B.

Figure 6B:
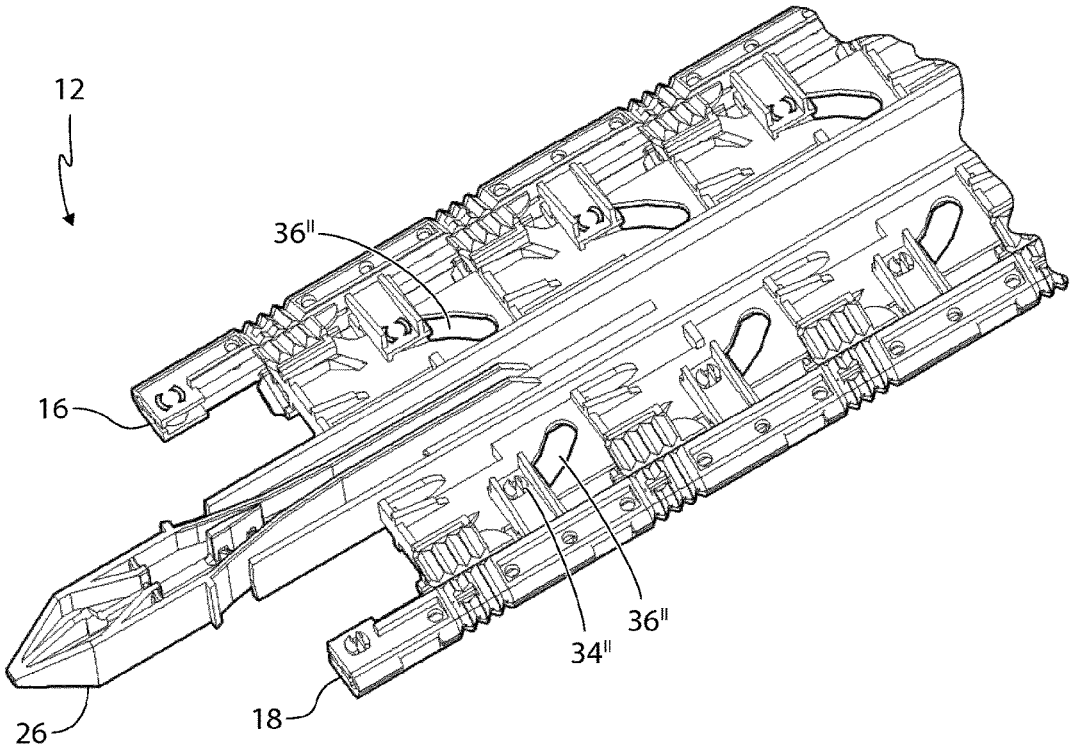
FIG. 6B illustrates an elongated core element and wall elements of the pelt board.

FIG. 6B shows a perspective view of the lower part 12 of the pelt board 10" when assembled. When interconnected, each of the snap fit mechanism 42 42' will form a pin 34" to be guided in the curved groove of the elongated core element 26. The peripheral parts 44, which will be described in detail below, form a substantially smooth and continuous surface together with it corresponding wall element 16 18.

Figure 7A:
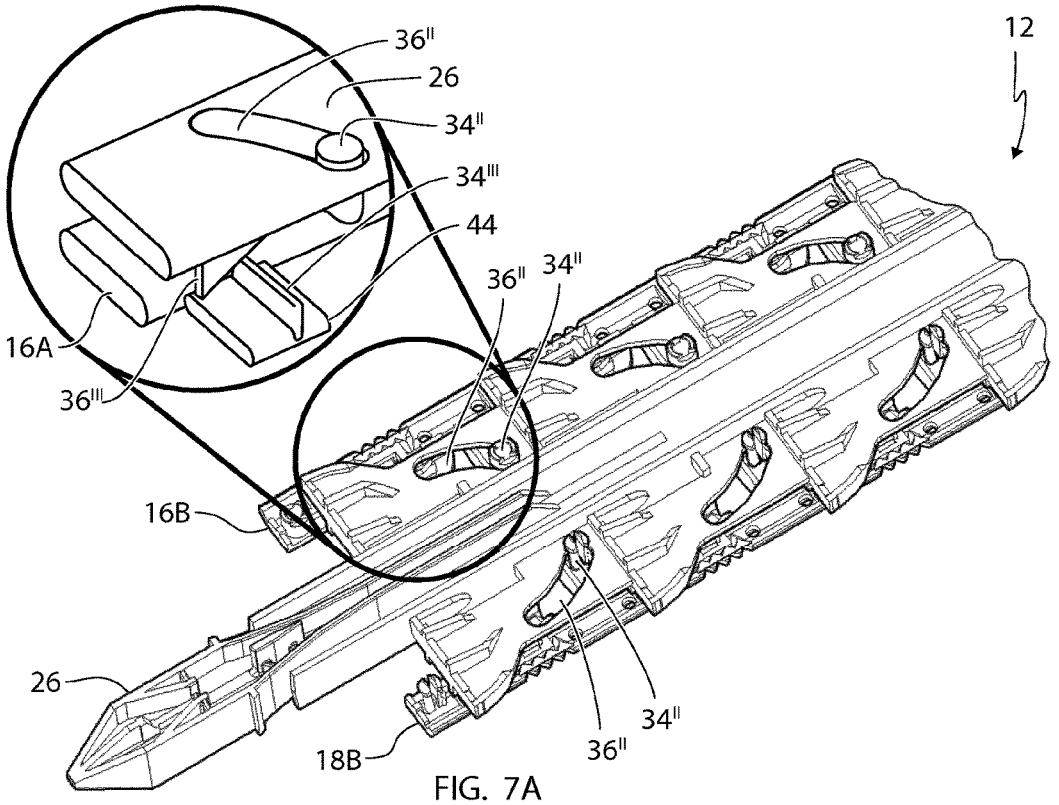
FIG. 7A illustrates the working principle of the peripheral part.

FIG. 7A shows a close up view describing the functional principle of the elongated core element 26, the wall element 16A and the corresponding peripheral part 44. The present view represents the contracted state of the pelt board. The elongated core element 26 comprises a further cooperating member 36'" constituting a wedge and which is adapted to cooperate with an actuator member 34'" constituting a protrusion on the peripheral part 44.

Figure 7B:
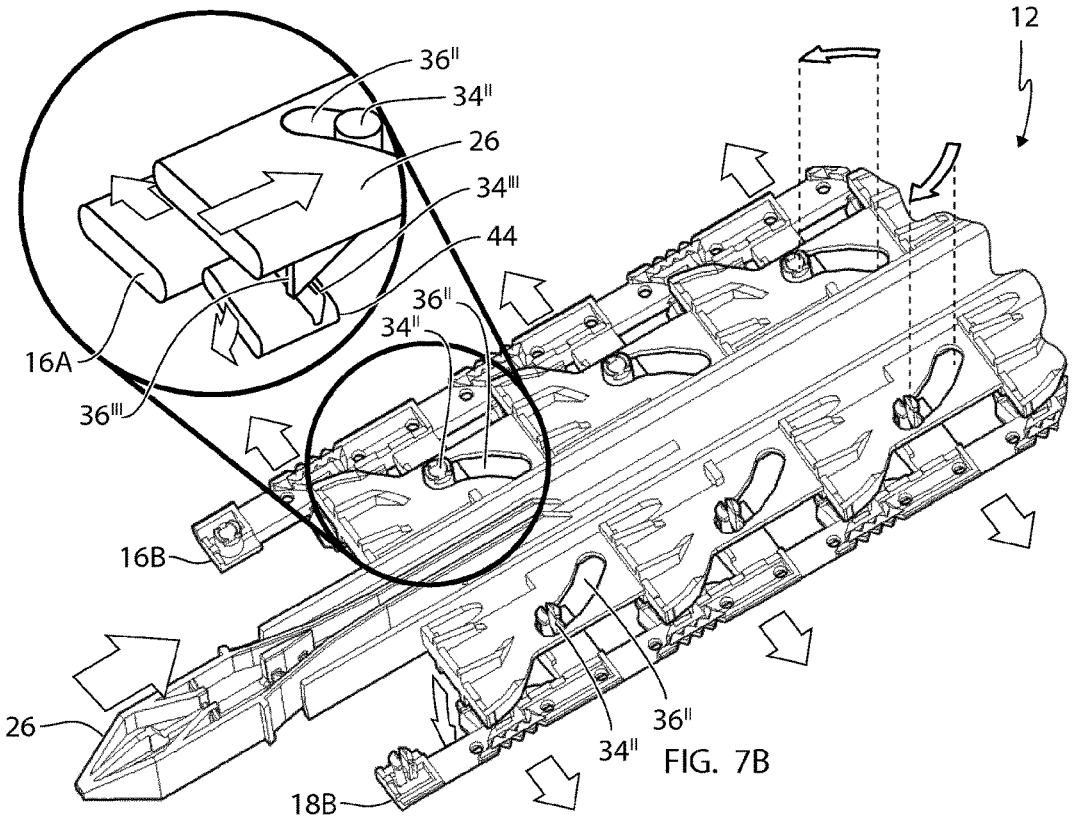
FIG. 7B illustrates the expansion of the peripheral part.

FIG. 7B shows the setup of FIG. 7B when in the expanded state. The elongated core element 26 moves in the longitudinal direction relative to the wall element 16*a* and causes the wall element 16A to move outwardly in the first radial direction as shown by the arrows. The outwardly movement of the wall element 16A is caused by the interaction between the cooperating member 36'" and the actuator member 34". The longitudinal movement of the elongated core 26 causes the actuator member 34'" constituting a protrusion to slide on the cooperating member 36'" constituting a wedge and thereby the peripheral part 44 is caused to move outwardly in both the first and second radial directions as shown by the arrow.

Figure 8A:
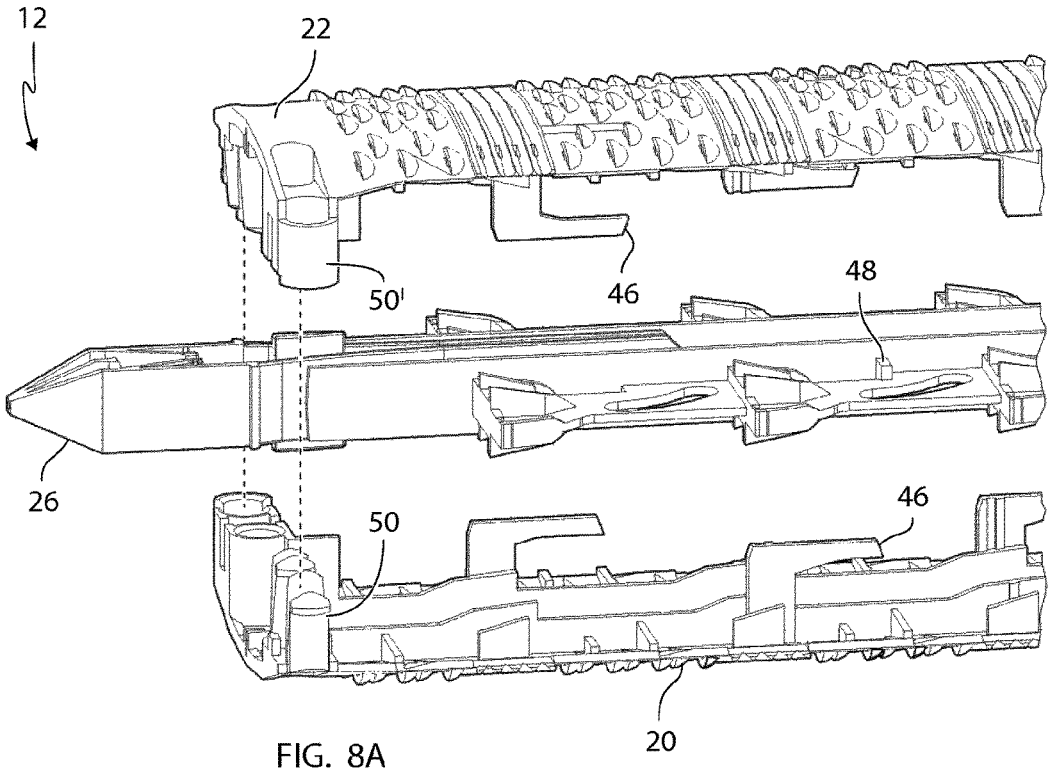
FIG. 8A illustrates an actuator member interacting with the opposite core surface.

FIG. 8A shows a perspective view illustrating how the third wall element 20 and the fourth wall element 22 are fastened together and to the elongated core element 26. The third and fourth wall elements 20 22 each comprise further actuator members in the form of fastening members 46, which are cooperating with corresponding tracks 48 of the elongated core element 26. The third and fourth wall elements 20 22 are in the present embodiment additionally joined together via corresponding clip-on mechanisms 50 50' at the bottom end of the pelt board.

Figure 8B:
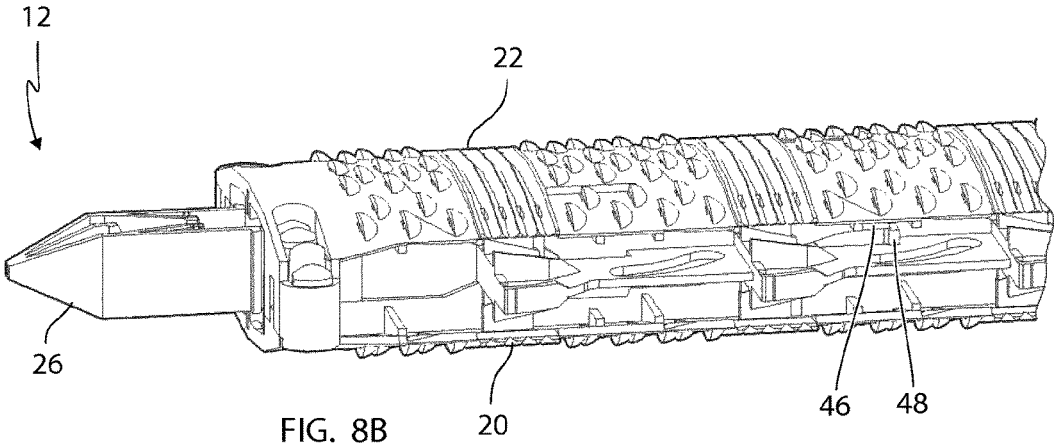
FIG. 8B illustrates the elongated core element and wall elements of the pelt board.

FIG. 8B shows the lower part 12 of the pelt board when the third wall element 20 and the fourth wall element 22 are fastened together and to the elongated core element 26.

Figure 9A:
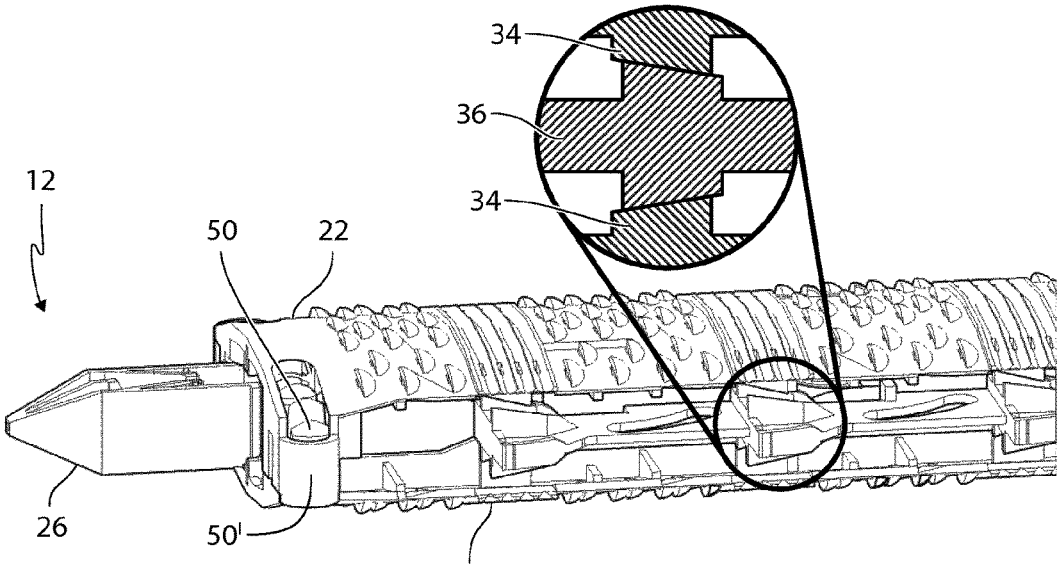
FIG. 9A illustrates actuator members and cooperating members of the pelt board.

FIG. 9A shows a close-up view illustrating the working principle of the third wall element 20 and the fourth wall element 22. The third wall element 20 and the fourth wall element 22 each comprise actuator members 34 and the elongated core element 26 comprises cooperating members 36. The actuator members 34 and the cooperating members 36 define wedges having sloped in opposite direction. In the present contracted state, the wedges of the actuator members 34 and the cooperating members 36 are located such that the protruding parts of the wedges are non-overlapping, allowing the third wall element 20 and the fourth wall element 22 to define a small distance between themselves. The fastening members 46, described in detail in the previous figure, will in the present case be interacting with the corresponding tracks 48 of the elongated core element 26 such that each of the third wall element 20 and the fourth wall element 22 are pulled inwardly towards the elongated core element 26.

Figure 9B:
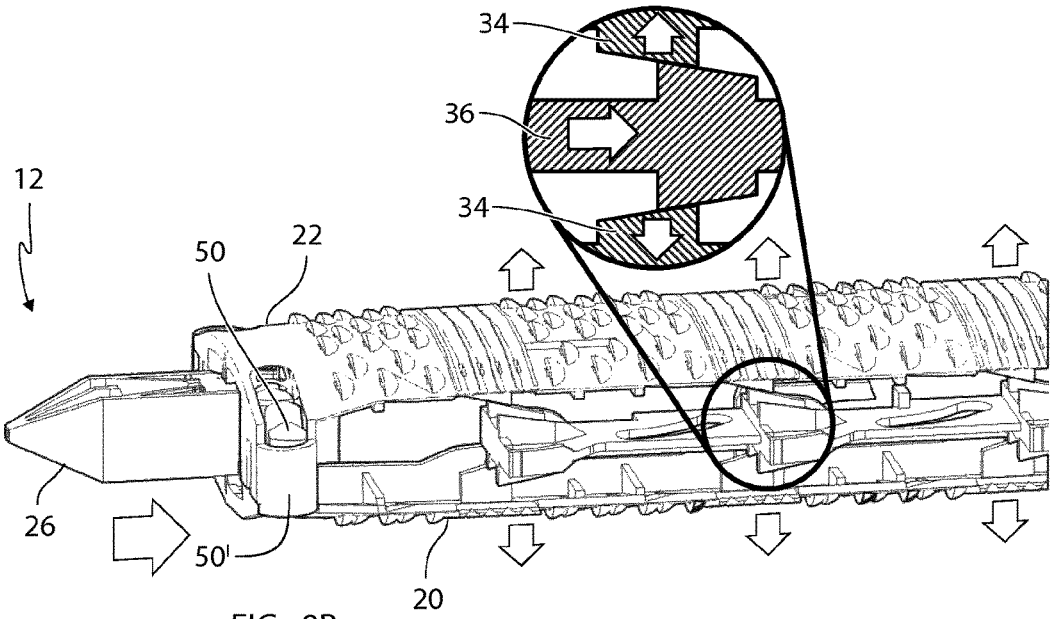
FIG. 9B illustrates the movement of the actuator members and cooperating members.

FIG. 9B shows a close-up view illustrating the working principle of the third wall element 20 and the fourth wall element 22 when in the expanded state. In the present expanded state, the wedges of the actuator members 34 and the cooperating members 36 are located such that the protruding parts of the wedges are overlapping, causing the third wall element 20 and the fourth wall element 22 to define a larger distance between themselves. The moving principle of the third wall element 20, the fourth wall element 22 and the elongated core element 26 is illustrated by the arrows.

Figure 9C:
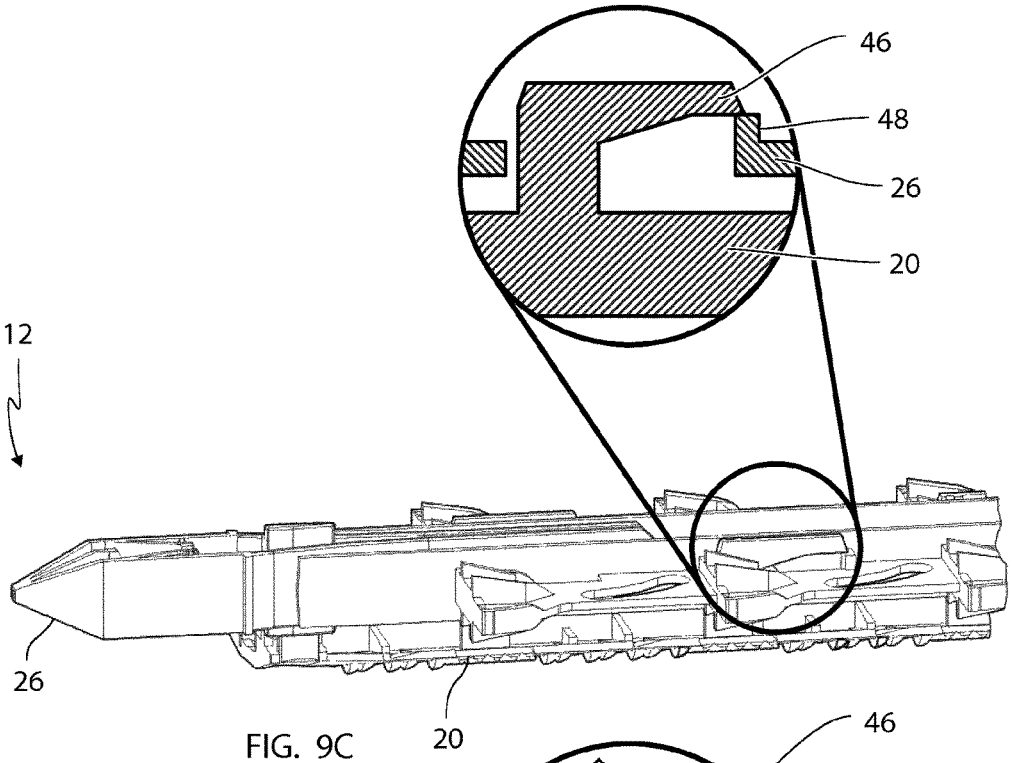
FIG. 9C illustrates the fastening member and the track of the pelt board.

FIG. 9C shows a close-up view illustrating the working principle of the fastening member 46 when the pelt board is in the expanded state. The fastening member 46 has a wedged shape for controlling the distance between the elongated core element 26 and the respective third wall element 20 and the fourth wall element 22 depending on the longitudinal position of the elongated core element 26. The fastening member 46 of the respective third wall element 20 and the fourth wall element 22 grasps the track 48 of the elongated core element 26 which is located opposite the third wall element 20 of which the present fastening member 46 is part of.

Figure 9D:
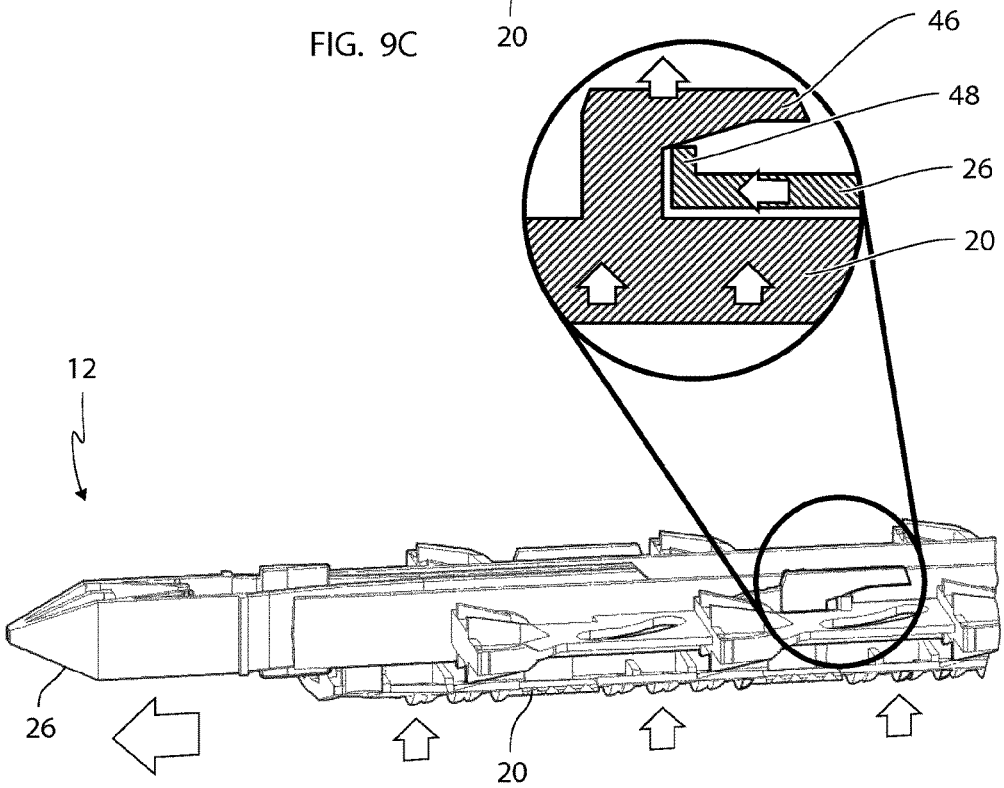
FIG. 9D illustrates the movement of the fastening member in relation to the track.

FIG. 9D shows a close-up view illustrating the working principle of the fastening member 46 when the pelt board is in the expanded state. The contraction of the wall third wall element 20 and the fourth wall element 22 may be controlled in that the slope of the fastening member causes the third wall element 20 and the fourth wall element 22 to move closer to the elongated core element 26 when the pelt board is assuming the contracted state.

Figure 10A:
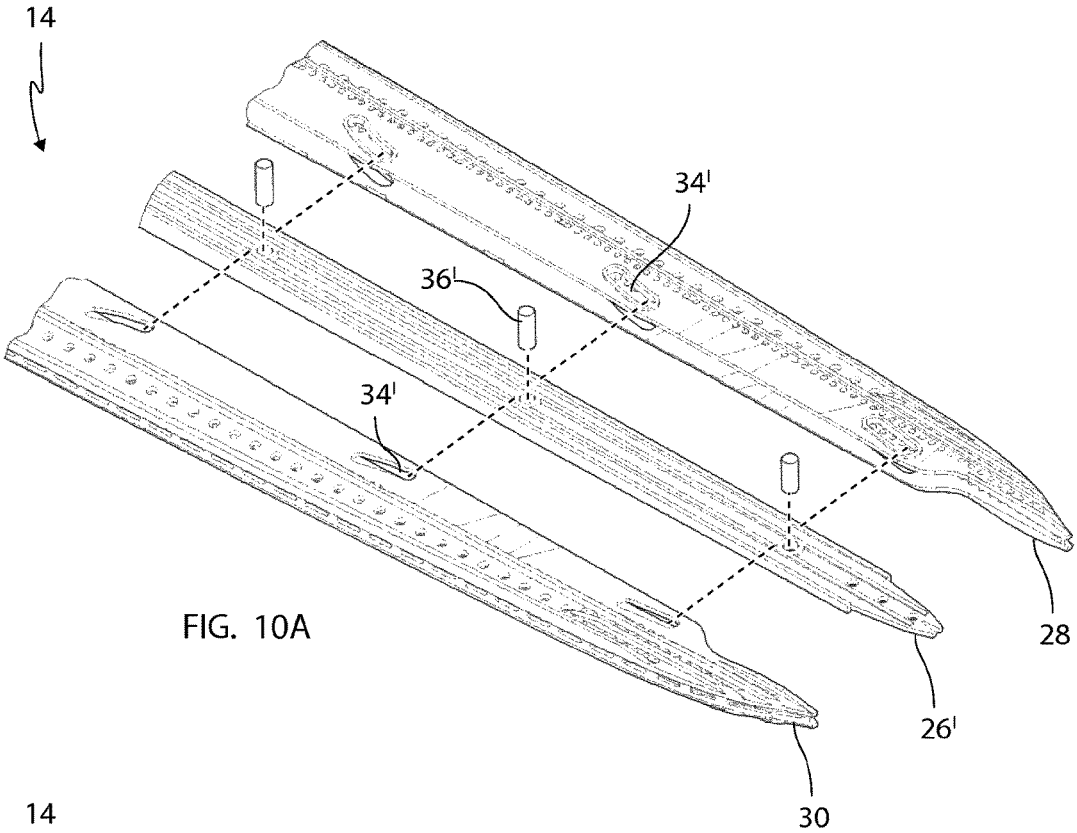
FIG. 10A illustrates the assembly of the upper part of the pelt board.

FIG. 10A shows the mounting principle of the upper part 14. In the first step, the fifth wall element 28 and the sixth wall element 30 are positioned in a partial overlapping position about the core extension element 26'. In the next step, the cooperating members 36', which constitute pins, are positioned through the actuator members 34', which constitute curved grooves, and through the center of the core extension element 26'.

Figure 10B:
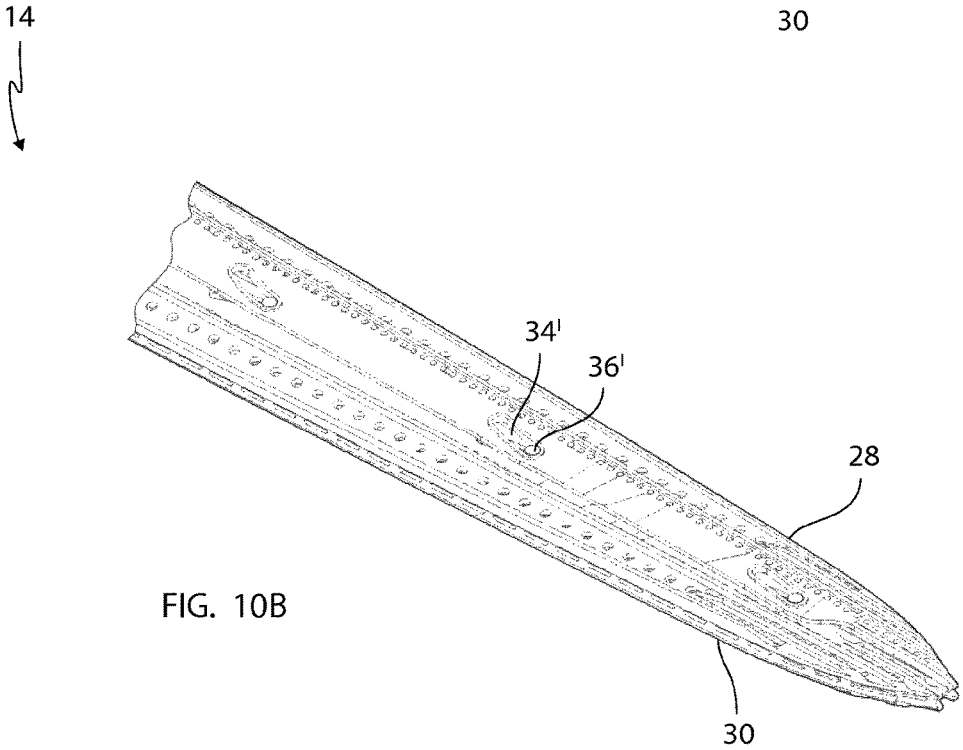
FIG. 10B illustrates the finished upper part of the pelt board.

FIG. 10B shows a perspective view of the upper part 14 when mounted and when in the expanded state.

Figure 11A:
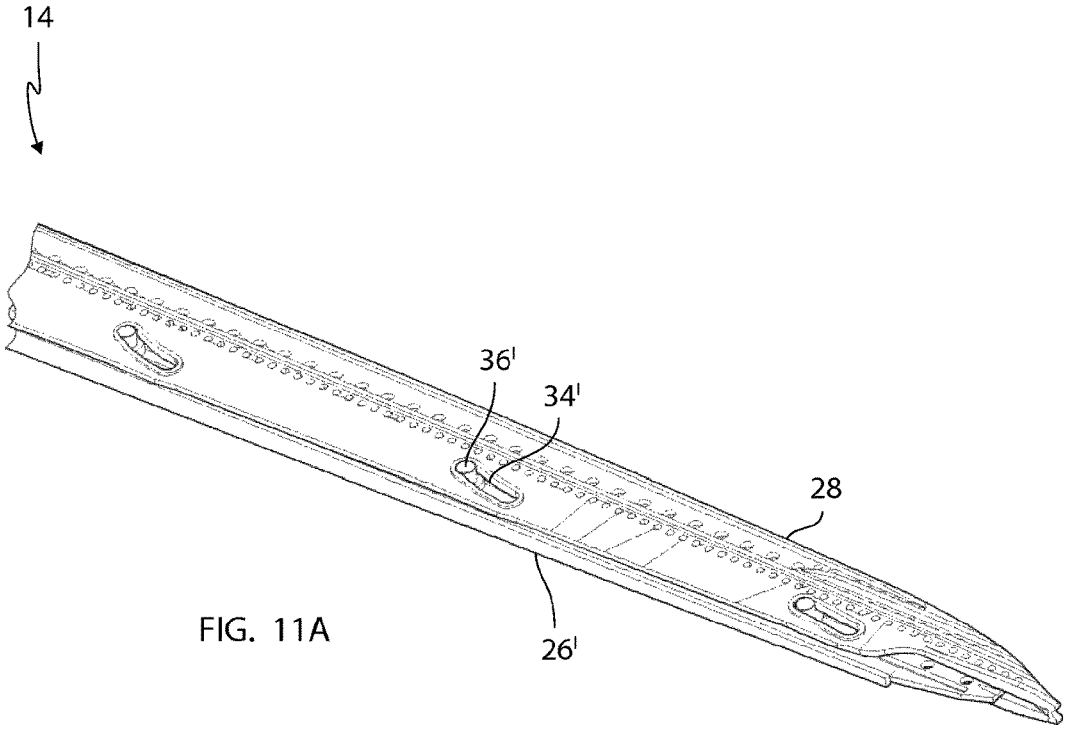
FIG. 11A illustrates the upper part of the pelt board in the contracted state.

FIG. 11A shows the moving principle of the upper part 14 of the pelt board. The cooperating members 36' are guided in the actuator members 34' for causing the fifth wall element 28 and the sixth wall element 30 to minimize the radial dimension between themselves and relative to the core extension element 26.

Figure 11B:
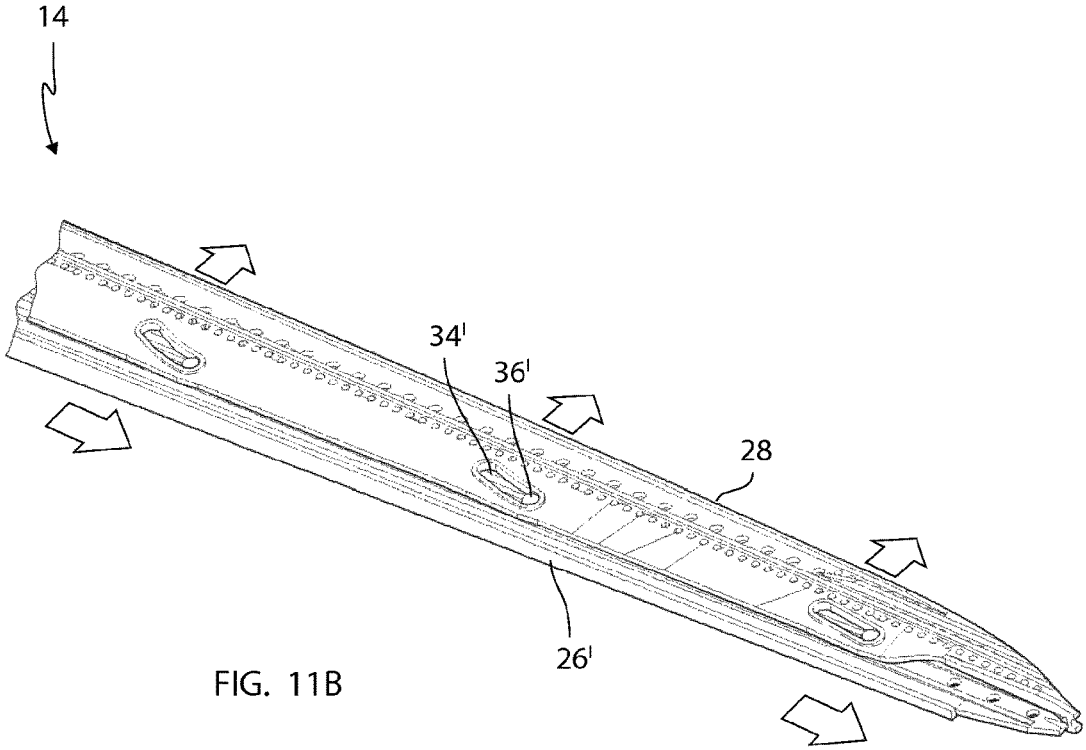
FIG. 11B illustrates the upper part of the pelt board in the expanded state.

FIG. 11B shows the moving principle of the upper part 14 of the pelt board. The cooperating members 36' are guided in the actuator members 34' for causing the fifth wall element 28 and the sixth wall element 30 to increase the radial dimension between them and relative to the core extension element 26 when the core extension element 26 is moved in the longitudinal direction as shown by the arrows.

Figure 12A:
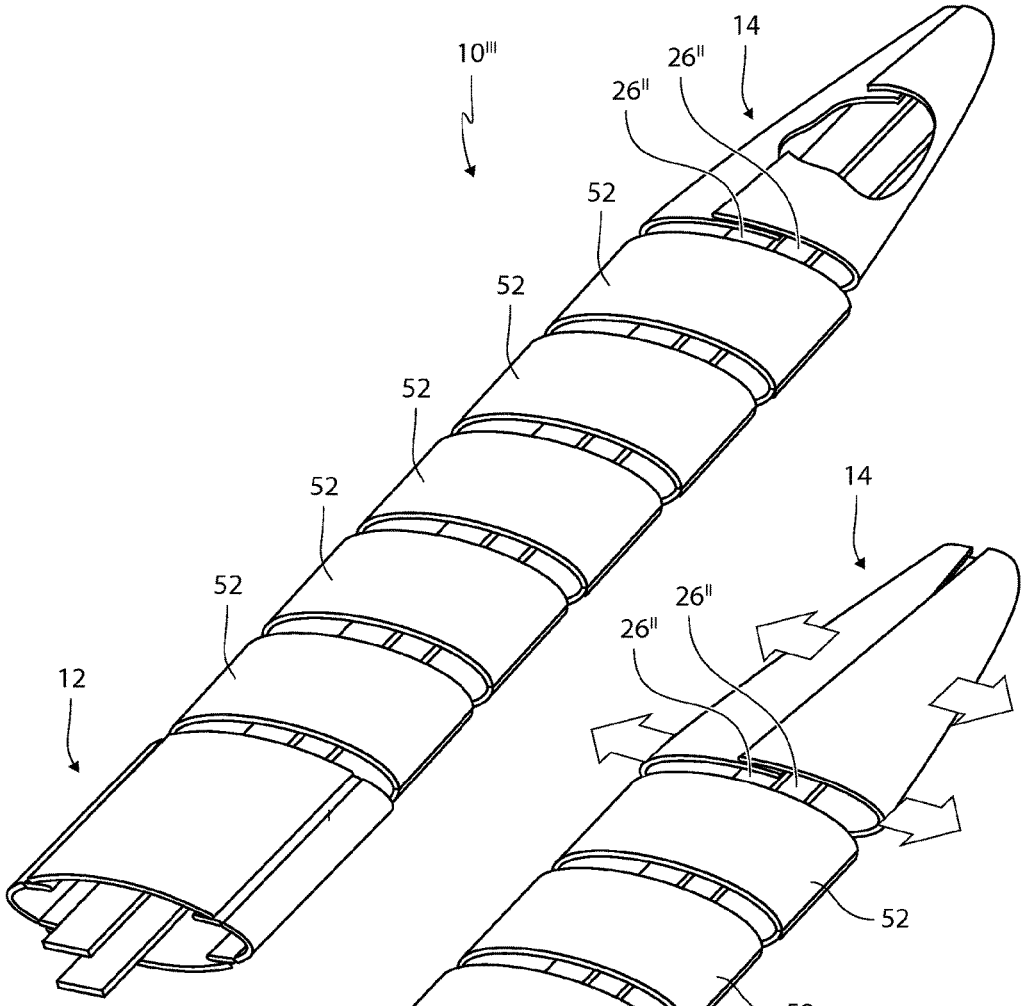
FIG. 12A illustrates the use of intermediate sections.

FIG. 12A shows a perspective view of a further embodiment of a pelt board 10'". The pelt board 10'" resembles the pelt boards of the previous embodiments however in order to be able to adjust the length of the pelt board 10'", there has been included intermediate sections 52 in-between the upper part 14 and the lower part 12. The intermediate sections 52 constitute elliptic cylindrical spacer elements which are non-expandable. The intermediate sections 52 may be made non-expandable since the pelt is most likely to stick to the upper part 14 and the lower part 12. However, the intermediate sections 52 may of course also be made expandable similar to the lower part 12 or the upper part 14. For large pelts, a plurality of intermediate sections 52 may be used. A core connecting element 26" may be used for interconnecting the elongate core element of the lower part 12 and the core extension element of the upper part 14.

Figure 12B:
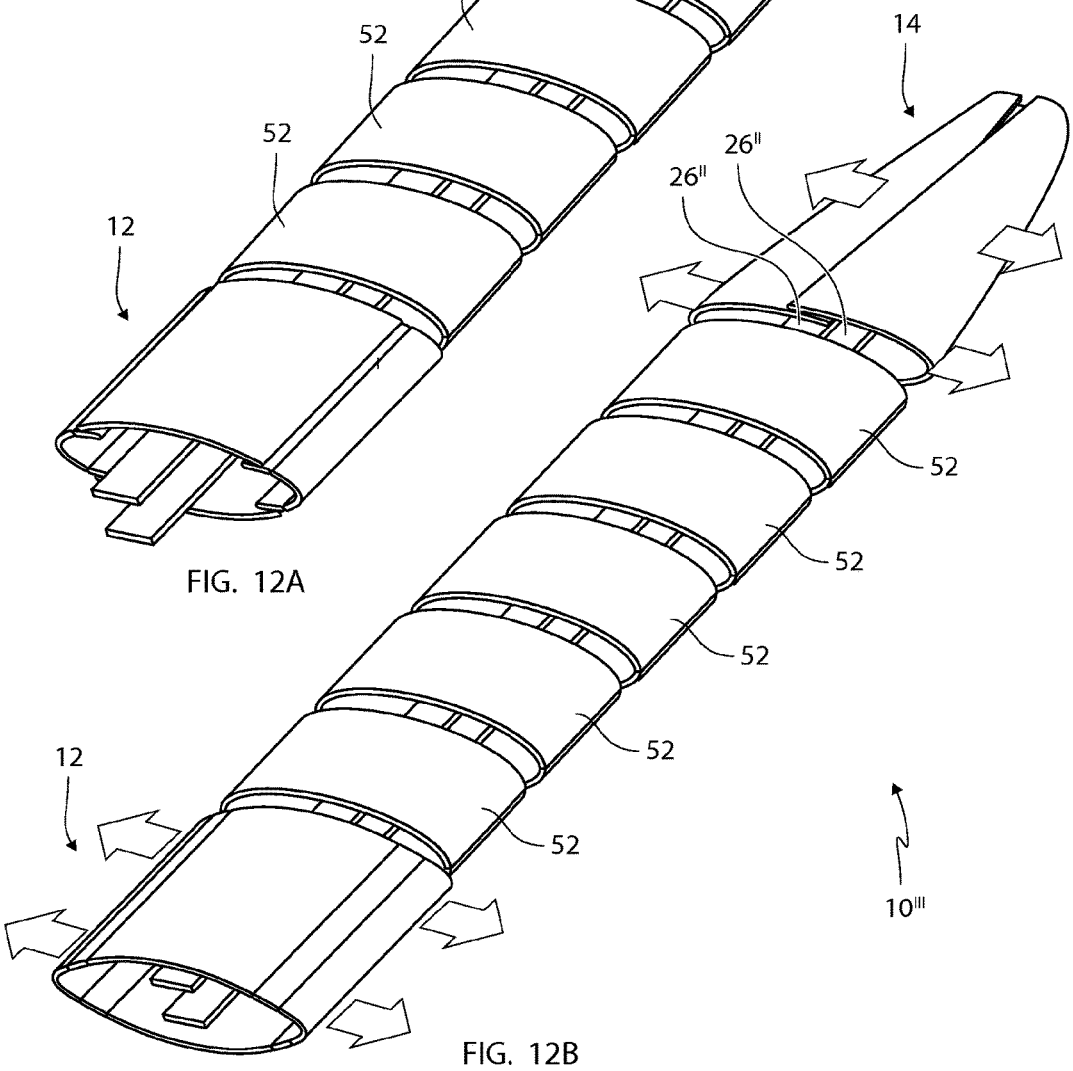
FIG. 12B illustrates the working principle of the intermediate sections.

FIG. 12B shows a perspective view of a third embodiment of a pelt board 10''' and illustrates how the lower part 12 and the upper part 14 is expanding as shown by the arrows, while the intermediate sections remain constant in circumference.

Figure 13:
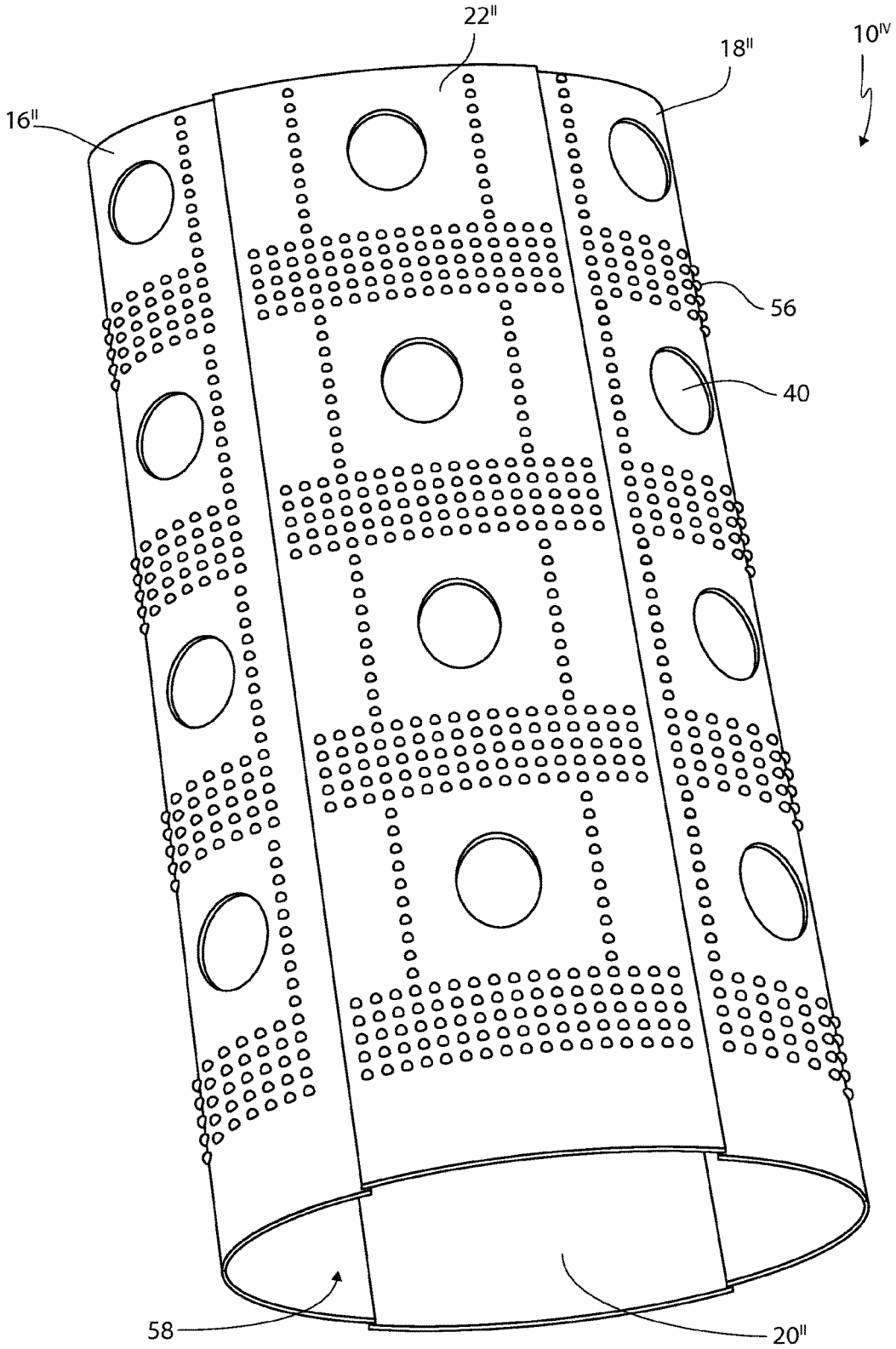
FIG. 13 illustrates a further embodiment of the pelt board.

FIG. 13 shows a perspective view of a fourth embodiment of a pelt board $\mathbf{10}^{IV}$. The present pelt board 56 comprises a number of ribs 56 which contribute to holding the pelt on the pelt board. Further, a number of ventilation holes 40 are present for allowing the pelt to dry quickly. The pelt board $\mathbf{10}^{IV}$ is of elliptical configuration and the third and fourth wall elements 20 22, having an arched configuration, may overlap the first and second wall elements 16 18 in order to assume the expanded state and the contracted state. The elongated core element has in the present view been omitted. A large opening 58 is present at the bottom end of the pelt board $\mathbf{10}^{IV}$ for allowing a large amount of dry ventilation air to enter the pelt board $\mathbf{10}^{IV}$.

Figure 14:
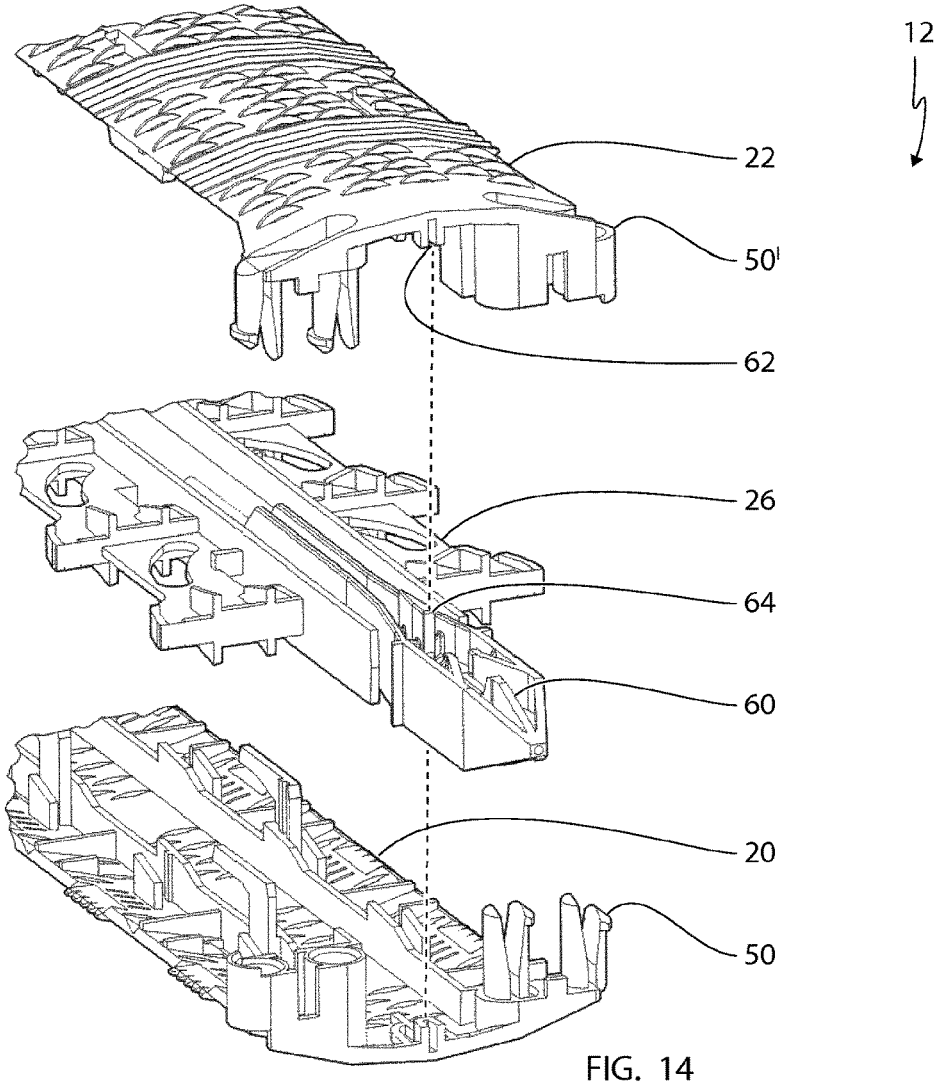
FIG. 14 illustrates the assembly of the bottom part of the pelt board.

FIG. 14 shows the bottom end of the lower part 12 of the pelt board. The lower ends of the third wall element 20 and the fourth wall element 22 are fixated by means of cooperating clip-on mechanisms 50 50' such that the third wall element 20 and the fourth wall element 22 cannot move in relation to each other adjacent the lower end of the pelt board. Typically, the pelt does stop a few centimeters above the lower end, otherwise a longer pelt board should be used. Thus, it is not necessary that the third wall element 20 and the fourth wall element 22 are movable adjacent the lower end of the pelt board. A connecting element 60 is used for moving the elongated core element 26 in the longitudinal direction. Also shown are first locking protrusions 62 located on each of the third wall element 20 and fourth wall element 22. Second locking protrusions 64 are located on the connecting element 60. The locking protrusions 62 64 are used to lock the elongated core element 26 in the expanded state. This will be explained further below.

Figure 15:
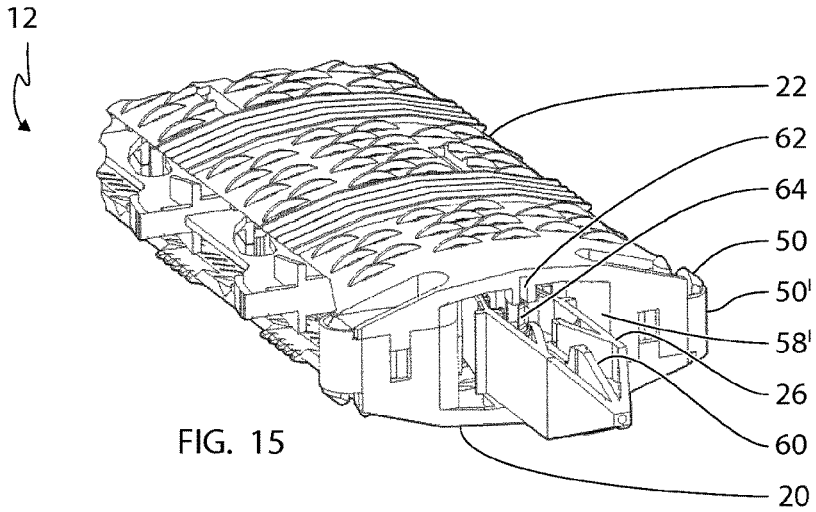
FIG. 15 illustrates the connecting element of the pelt board.

FIG. 15 shows the lower part 12 of the pelt board when it has been assembled. The connecting element 60 extends from an opening 58' at the lower end of the pelt board. The opening 58' is preferably large for allowing a large flow of air to enter the interior of the pelt board 10 and most preferably the opening 58' defines the greater part of the entire bottom surface of the pelt board 10. The opening 58' typically constitutes the limiting flow surface which determines the amount of air which will flow through the pelt board. A small opening 58' would limit the flow which would cause a less efficient drying of the pelt.

Figure 16:
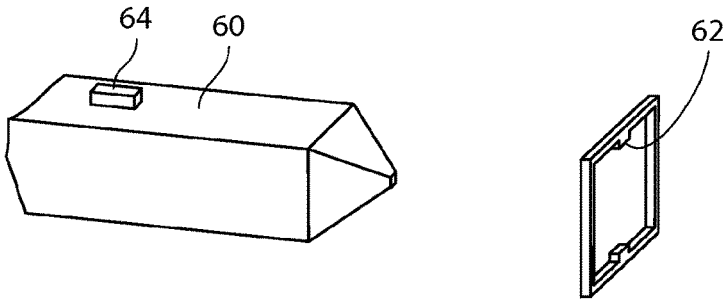
FIG. 16 illustrates the protrusions of the locking mechanism of the core element.

FIG. 16 shows a perspective close up of the connecting element 60 and the locking principle employed to lock the pelt board in the expanded state. The third and fourth wall elements comprise first locking protrusions 62, whereas the connecting element 60 comprises second locking protrusions 64. The connecting element 60 is flexible in the first radial direction in relation to the third and fourth wall elements. The present locking mechanism is located adjacent the bottom end of the pelt board and together with the friction between the internal moving parts of the pelt board, i.e. the actuator members and the cooperating members, it will eliminate the need of any further locking mechanisms inside the pelt board. The present locking mechanism should be located adjacent the bottom end of the pelt board in order to avoid it being jammed by fatty substances which may come from the pelt. The change from expanded state to contracted state may preferably be made when the bottom end of the elongated core element is attached to the drying unit, e.g. by tilting the pelt board sideways, thereby also taking advantage of the leverage provided by the pelt board for overcoming the friction between the first and second protrusions.

Figure 17A:
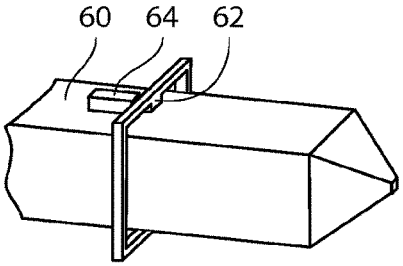
FIGS. 17A, 17B, 17C and 17D are a series illustrating the working principle of the locking mechanism.

FIG. 17A shows the locked position of the pelt board. The first locking protrusions 62 are located below the second locking protrusions 64. The first locking protrusion 62 thus prevents the longitudinal movement of the connecting element 60 and thus of the elongated core element.

Figure 17B:
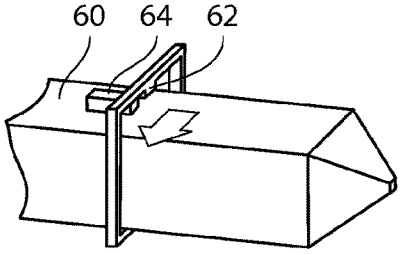

FIG. 17B shows the unlocking of the pelt board. By moving the connecting element 60 in the first radial direction, the second locking protrusion 64 is free to move past the first locking protrusion 62.

Figure 17C:
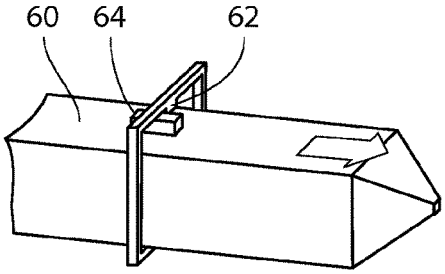

FIG. 17C shows the movement from expanded state to contracted state of the unlocked pelt board. By moving the connecting element 60 in the longitudinal direction, such that the second locking protrusion 64 moves past the first locking protrusion 62, the state may be altered from the expanded state to the contracted state.

Figure 17D:
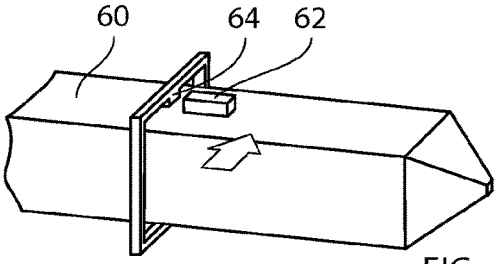

FIG. 17D shows the connecting element 60 when the pelt board is in the contracted state. By releasing the connecting element 60, it flexes back to its central relaxed position.

Figure 18A:
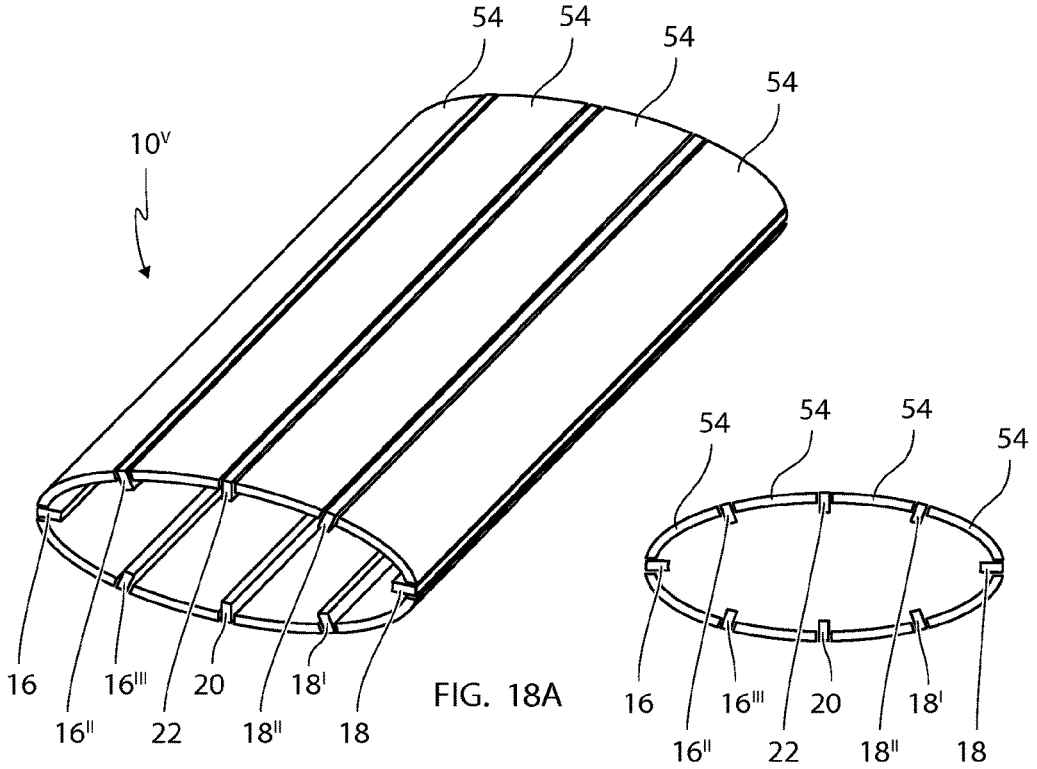
FIG. 18A illustrates a further embodiment of the pelt board in the contracted state.

FIG. 18A shows a perspective view of a further embodiment of a pelt board $\mathbf{10}^{V}$ when in the contracted state. The pelt board $\mathbf{10}^{V}$ comprises movable wall elements 16, 16', 16", 18, 18', 18", 20, 22 which together do not cover the complete circumference of the pelt board. In-between the wall elements 16, 16', 16", 18, 18', 18", 20, 22 fixed wall elements 54 are located. When in the contracted state, the wall elements 16, 16', 16", 18, 18', 18", 20, 22 form an even outer surface together with the fixed wall elements 54.

Figure 18B:
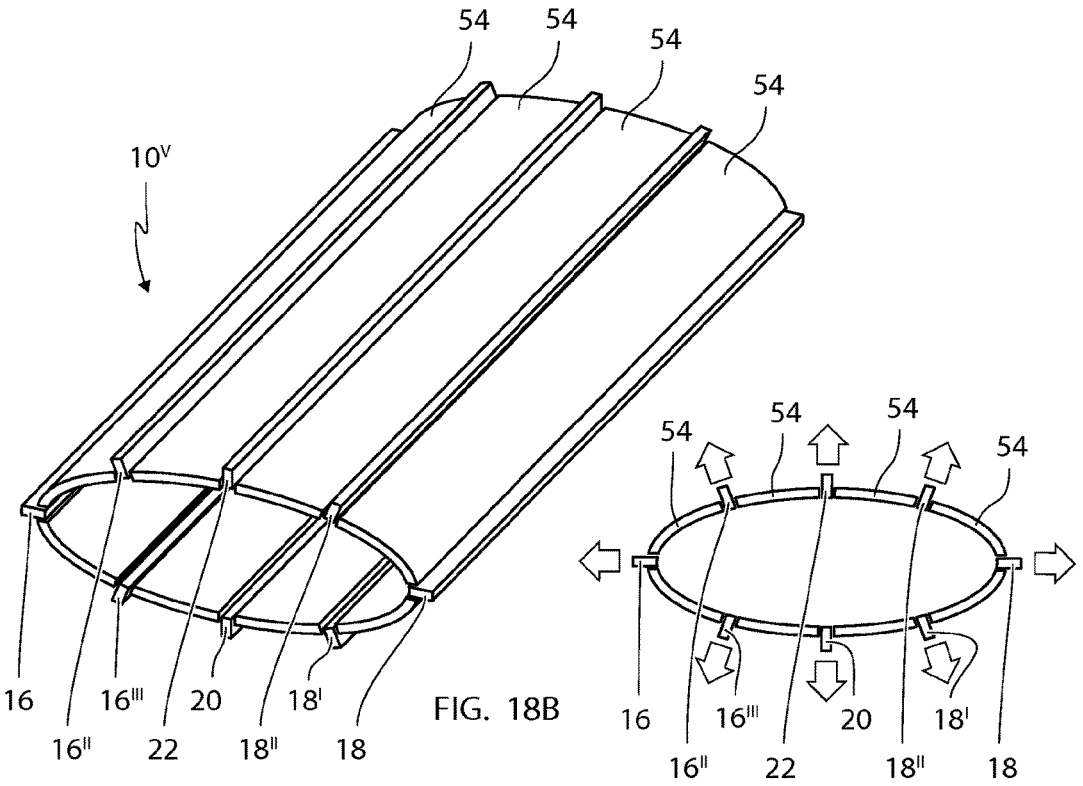
FIG. 18B illustrates a further embodiment of the pelt board in the expanded state.

FIG. 18B shows a perspective view of a further embodiment of a pelt board $\mathbf{10}^{V}$ when in the expanded state. When in the expanded state, the wall elements 16, 16', 16", 18, 18', 18", 20, 22 move outwardly and form contact surfaces for the pelts. The moving principle of the wall elements 16, 16', 16", 18, 18', 18", 20, 22 have not been shown, however, preferably the same principles are used as for the previous embodiments.

Figure 19:
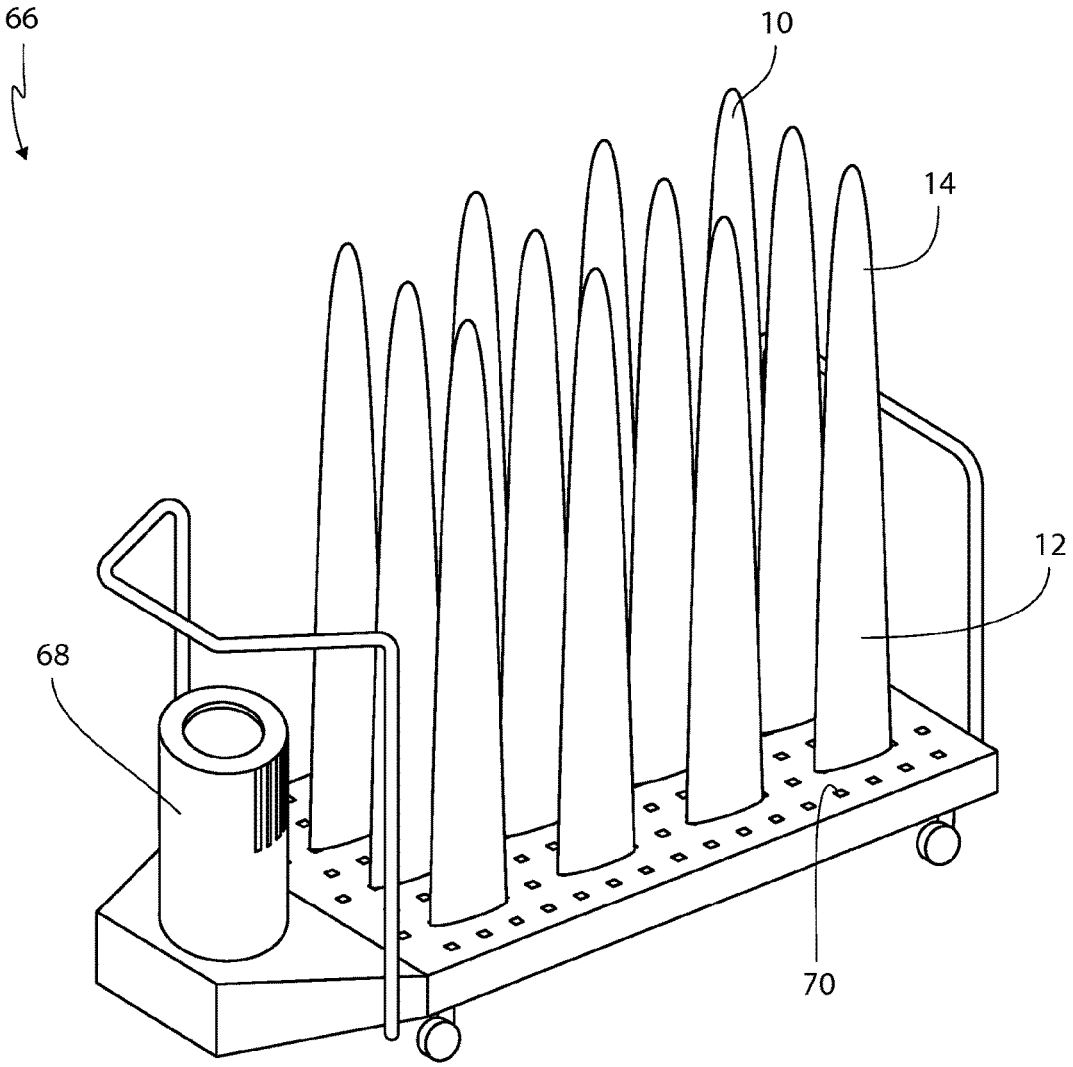
FIG. 19 illustrates a pelt board and a drying unit.

FIG. 19 shows the pelt board during drying when connected to a drying unit 66. The drying unit 66 has a ventilator 68 and a number of ventilation apertures 70. The ventilator produces a flow of air which is led via the ventilation apertures 70 into the pelt board 10 through the openings 58' at the lower part 12 of the pelt board 10.

Figure 20A:
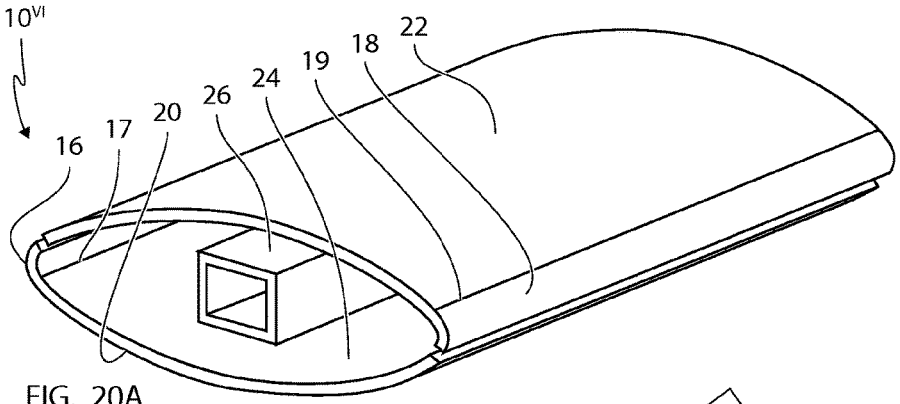
FIGS. 20A, 20B and 20C are a series illustrating the working principal of a further embodiment of the pelt board according to the present invention.

FIG. 20A shows a perspective view of a further embodiment of the pelt board $\mathbf{10}^{VI}$, in which the first wall element 16 is integrally joint to the third wall element 20 as indicated by a line of junction 17 and similarly, the second wall element 18 is integrally joint to the fourth wall element 22 through a line of junction 19. The embodiment of the pelt board $\mathbf{10}^{VI}$ shown in FIGS. 20A-20C presents the further feature of allowing the pelt board to be expanded in two alternative and separate directions; a first direction shown in FIG. 20B as indicated by arrows, according to which expansion the third wall element and the fourth wall element 22 are separated from one another for expanding the pelt board in a first transversal direction and likewise in FIG. 20C, the expansion of the pelt board $\mathbf{10}^{VI}$ caused by shifting the first wall element 16 and the second wall element 18 relative to one another for expanding the pelt board in a direction indicated by arrows in FIG. 20C, which direction is orthogonal to the direction of expansion shown in FIG. 20B.

Figure 20B:
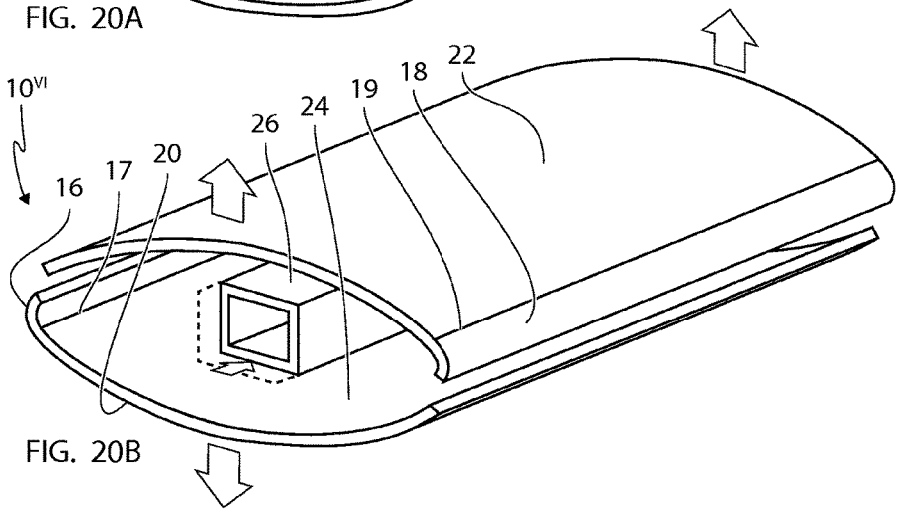
Figure 21A:
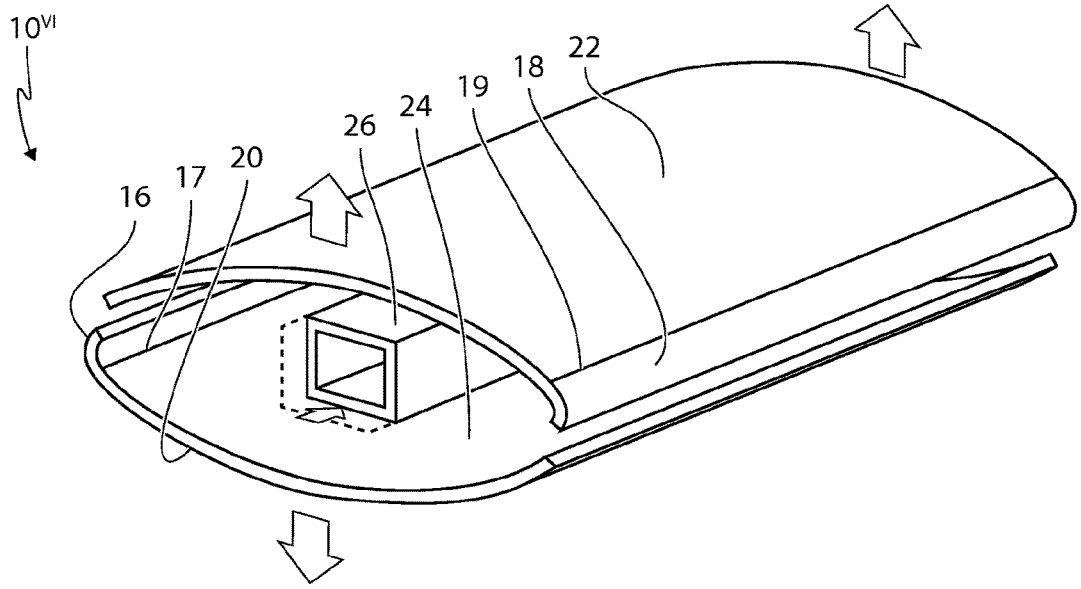
FIGS. 21A and 21B illustrate the expansion of the pelt board in a first transversal direction.
Figure 21B:
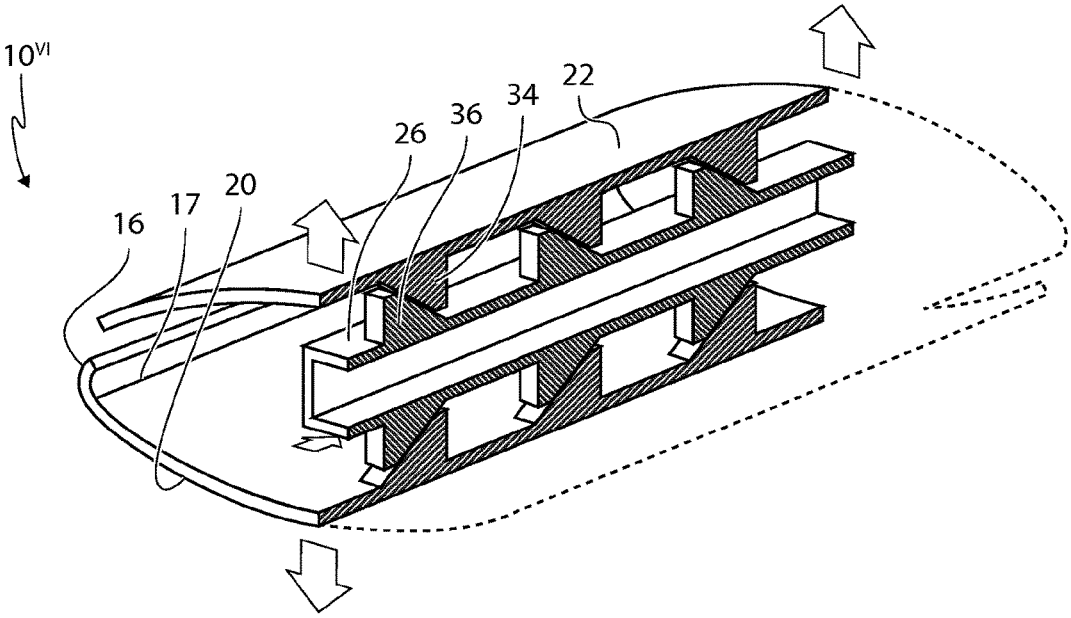
Figure 22A:
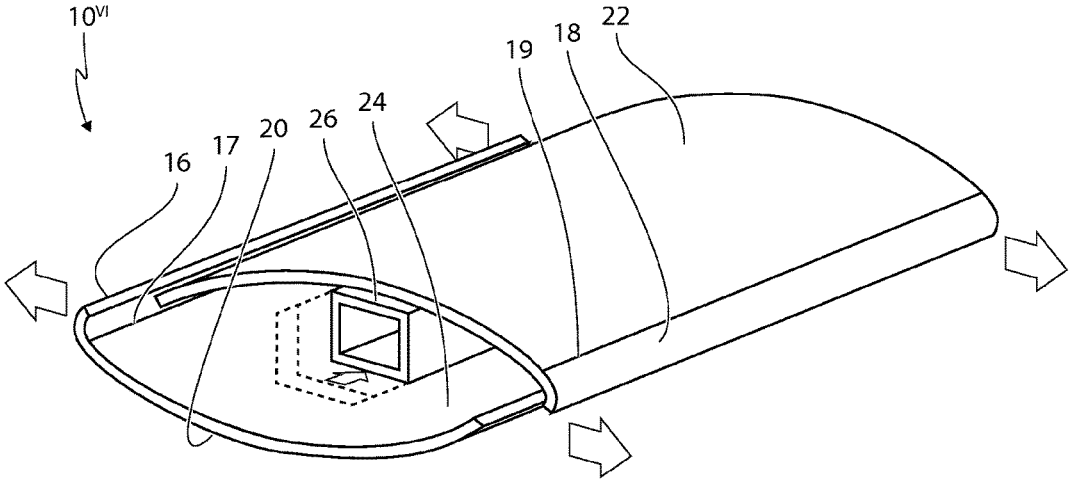
FIGS. 22A and 22B illustrate the expansion of the pelt board in a second transversal direction.
Figure 22B:
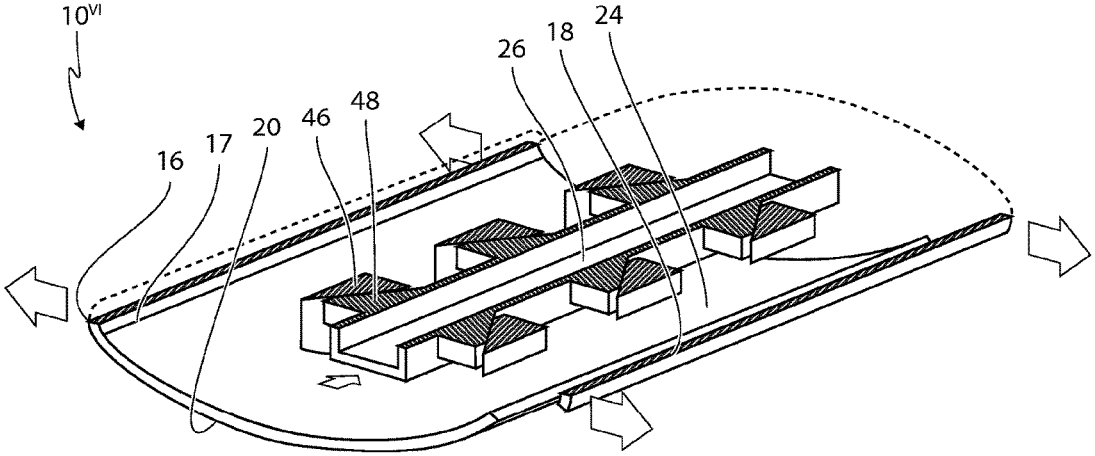
Figure 23A:
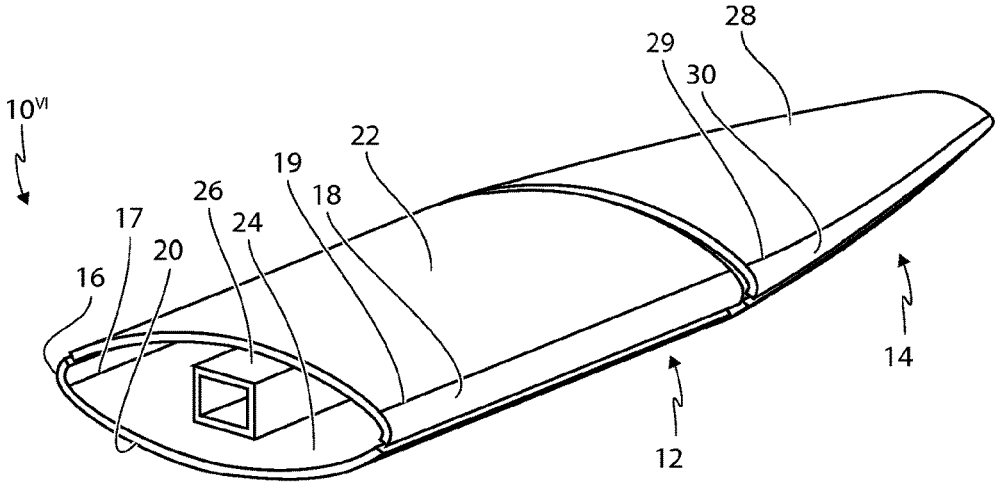
FIGS. 23A, 23B and 23 C are a series illustrating the expansion of the pelt board in two different transversal directions.
Figure 23B:
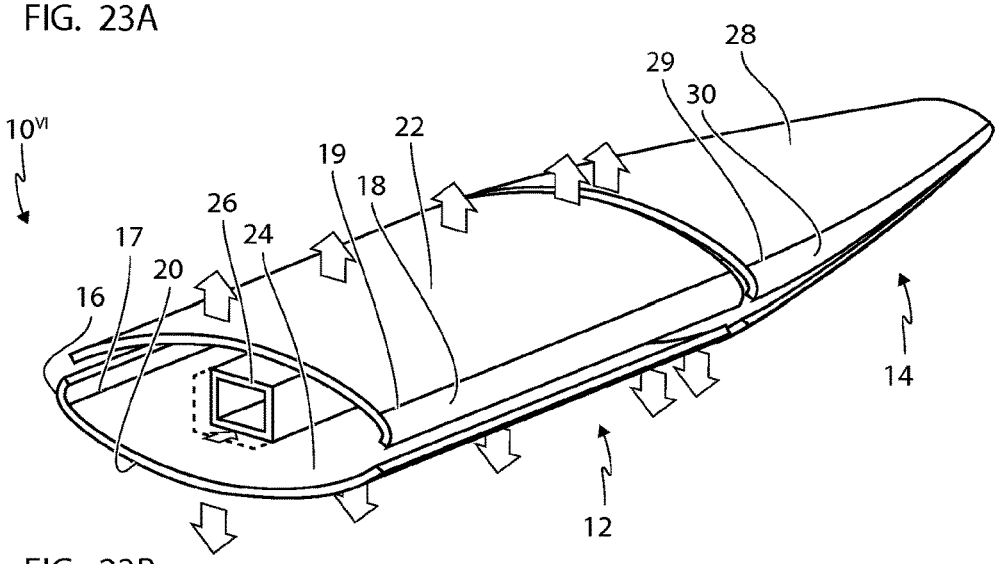
Figure 23C:
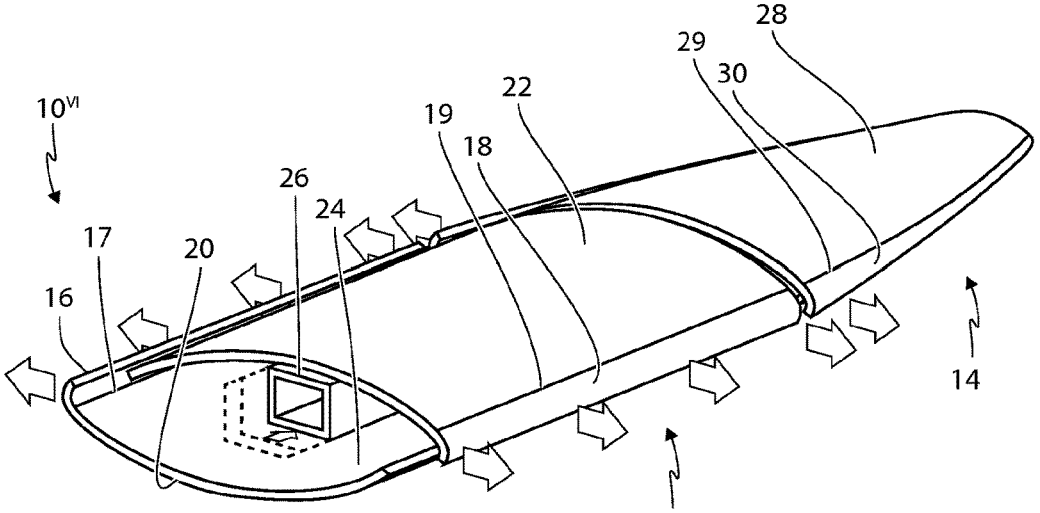

FIGS. 21A and 21B illustrate in greater details the expansion of the pelt board $\mathbf{10}^{VI}$ in the first transversal direction indicated in FIG. 20B and similarly, in FIGS. 22A and 22B, the expansion in the second transversal direction is illustrated in greater details.

Figure 20C:
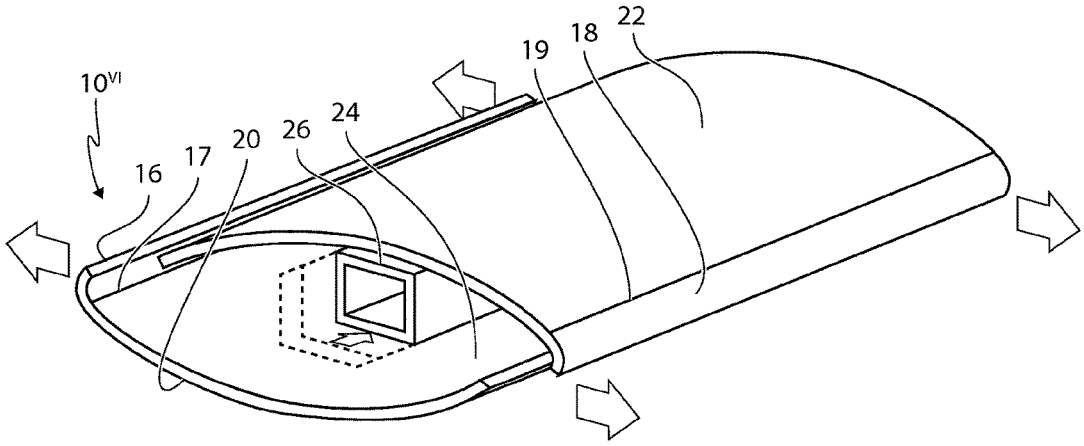

As is indicated in FIG. 20B and FIG. 20C and likewise in FIGS. 21A and 22A, the expansion in the second transversal direction is accomplished as a further movement of the elongated core element 26 as the movement of the central core element 26 from the position shown in FIG. 20A to the position shown in FIG. 20B accomplishes the expansion of the pelt board in the first transversal direction and further motion of the central core element 26 as indicated in FIG. 20C creates the further expansion in the second transversal direction. By modifying the actuator members 34, 36 and 46, 48 or repositioning them relative to one another, the shifting from the non-expanded state to the full expansion shown in FIG. 20C may be accomplished in a different way by firstly shifting the first and second wall element 16, 18 relative to one another and then afterwards shifting the third and fourth wall elements 18 and 20 relative to one another. In a still further variant of the pelt board $\mathbf{10}^{VI}$, the shifting of the pelt board from the non-expanded state to the first or the second expanded states shown in FIGS. 20B and 20C, respectively, may be accomplished selectively by shifting the central core element 26 sidewise in order to contact the one set of actuators 34, 36 shown in FIG. 21B, or alternatively the second set 46, 48 shown in FIG. 22B.

FIGS. 24-27 illustrate a 3-component embodiment of the pelt board $\mathbf{10}^{IV}$, which embodiments constitutes the presently preferred embodiment of the pelt board according to the present invention.

Figure 24:
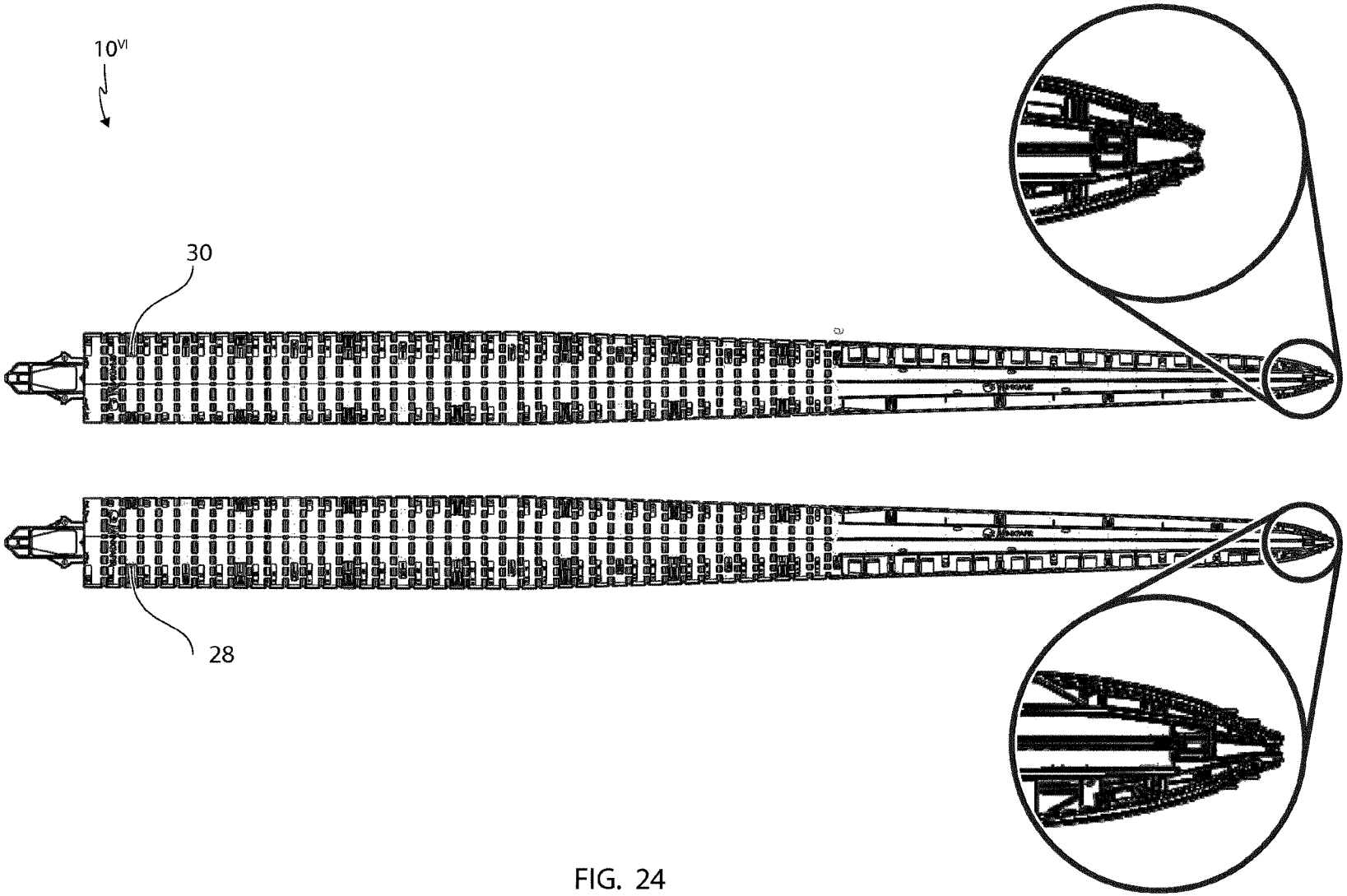
FIG. 24 illustrates details of a further and presently preferred embodiment of the pelt board according to the present invention.

In FIG. 24, the two shell parts 28 and 29 are shown exposing the exterior surfaces of the two shell parts and in addition, in the left hand part of FIG. 24 exposing the upper ends of the two shell parts, which upper ends serve to catch and fixate a part of the pelt at the head of the pelt. As is evident from the enlarged views of FIG. 24 at the left hand side of FIG. 24, the upper ends are provided with catching claws or teeth serving to fixate the head of the pelt relative to the pelt board.

Figure 25:
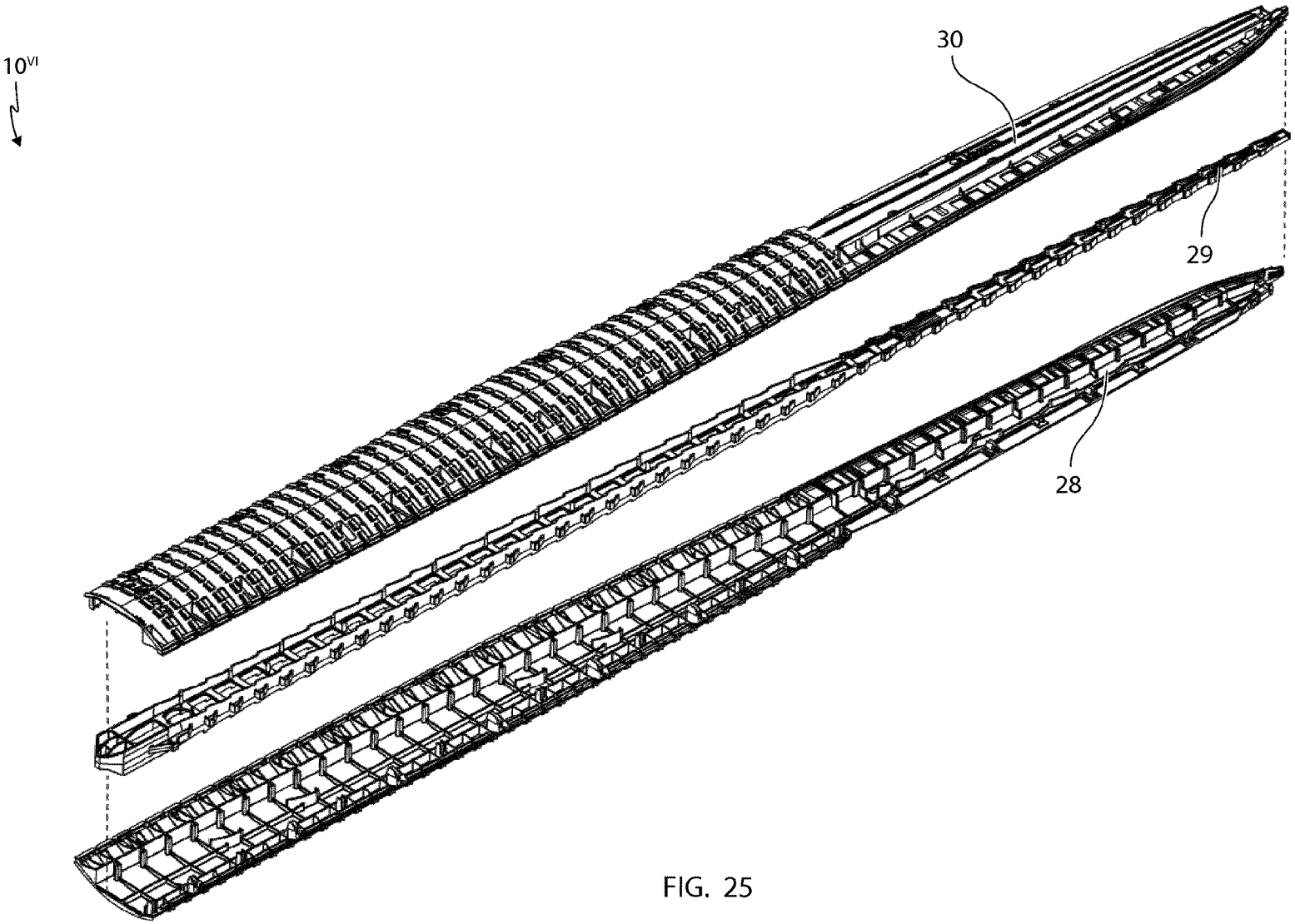
FIG. 25 illustrates the pelt board also shown in FIG. 24 in a disassembled state.

In FIG. 25, the two shell parts 28 and 30 are shown in disassembled state exposing the central elongated core element 29 having at its lower end an outwardly protruding part serving to cooperate with a conventional tanning machine and a conventional drying machine.

Figure 26:
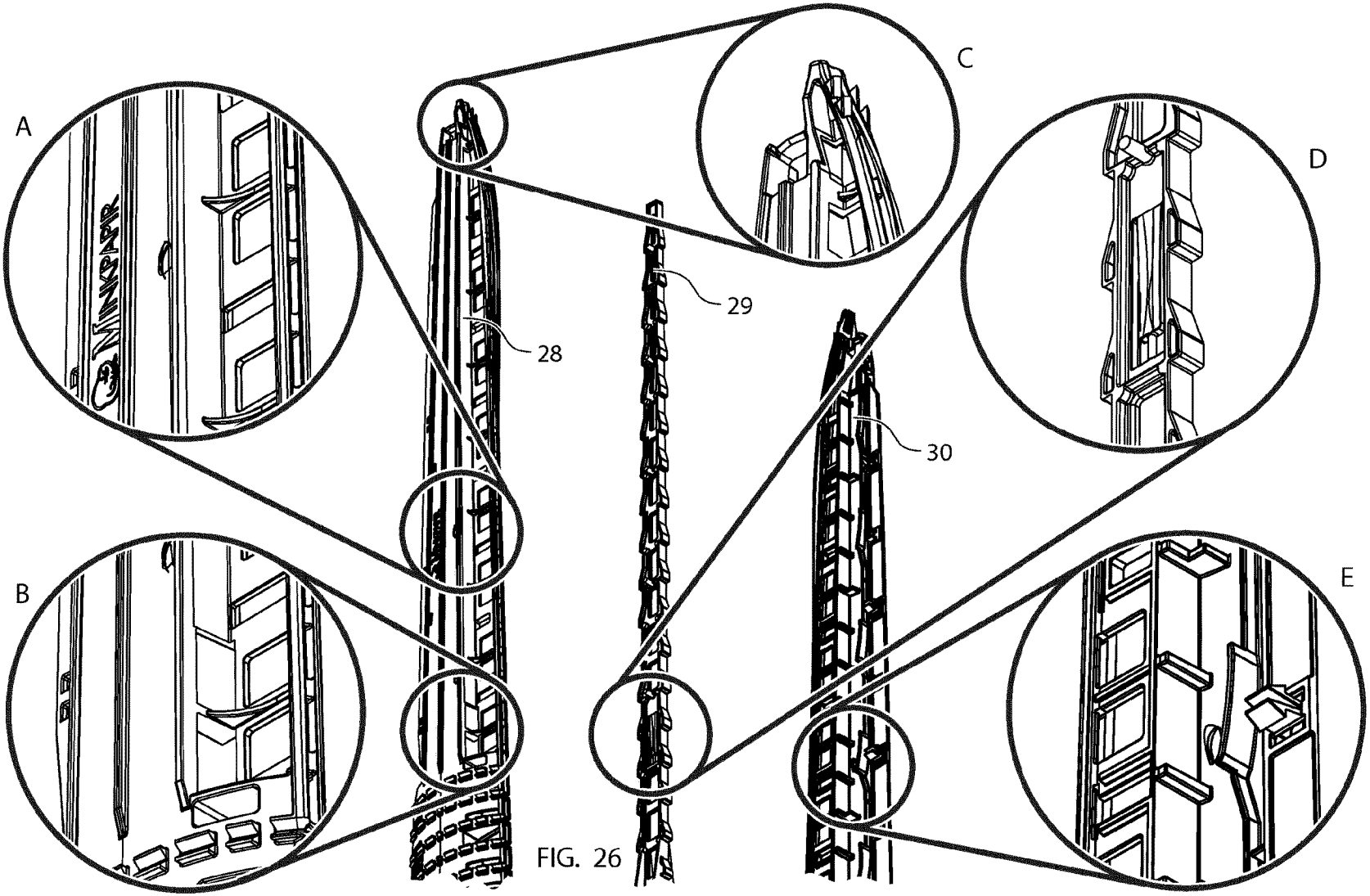
FIG. 26 illustrates details of the pelt board also shown in FIGS. 24 and 25.
Figure 27:
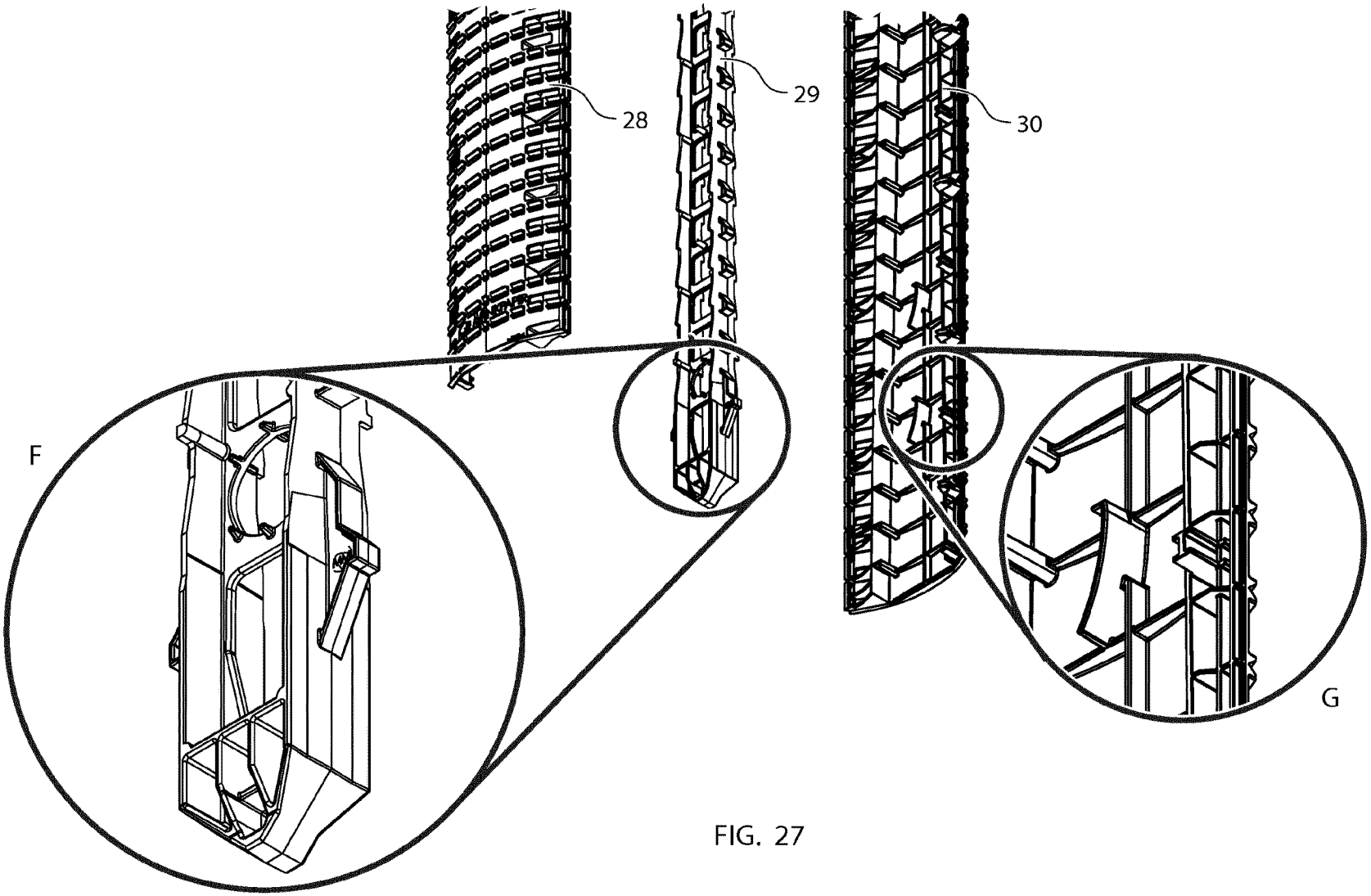
FIG. 27 illustrates further details of the pelt board, also shown in FIGS. 24-26.

In FIGS. 26 and 27, further details illustrated in enlarged views A-G of the pelt board is shown. In A and B, the outer surface of the top part of the pelt board is shown illustrating the longitudinal ridges of the pelt board and edgewise located apertures. In C, the upper end of the shell part 28 is shown illustrating the catching teeth, also shown in FIG. 24. In D, the cam surfaces of the elongated element 29 are shown in greater details and in E, the inner locking elements of the shell part 30 are shown. In F, the lower outwardly extending or protruding element constituting a so-called stubby element is shown, and in G, the locks of the shell part 30 are shown in greater details.

In general, the above described presently preferred embodiment $\mathbf{10}^{VI}$ of the pelt board according to the present invention fulfill the following features characteristic of the embodiment. The shell parts 28 and 30 are forcedly guided relative to the elongated core element 29 at a total of six locations along the shell parts, as the forcedly guiding or controlling is established during expansion of as well as during collapsing of the pelt board. The locks of the pelt board serve as a frictional lock preventing collapsing and expansion of the pelt board until an outer force generated by a pelt position on the pelt board activates the lock. The expansion in both transversal directions and likewise the collapsing in both transversal directions is forcedly controlled and guided. The above stubby elements together with the lower end of the shell parts serve to center the pelt board in a drying box or drying machine and provides a stop in the drying box. Further, the stubby element, as distinct from previously used stubby elements serving to catch and lock in the tanning machine and in the drying box or drying machine provides gripping flanges or elements for an improved fixation. For providing individual recordal of the pelt received on a specific pelt board, the pelt board is further provided with an internal holder for receiving an RFID (Radio Frequency Identification Device).

The shell parts further exhibit the following additional features by providing holes for the drying of the back part of the pelt and providing an increased air through flow as compared to conventional and commercially available pelt boards. In the longitudinal direction of the pelt board, the shell parts are reinforced every 60 mm and transversal bands are further provided every 30 mm. The overall surfaces of the two shell parts prevent vertical shifting of the pelt relative to the pelt board, and the teeth at the upper ends of the two shell parts fixate the upper end, i.e. the head of the pelt relative to the pelt board. The number of teeth for catching the head of the pelt may be constituted by any arbitrary numbers such as 2, 4, 6, 8 or even further teeth as the presently preferred embodiment exhibit a total of four teeth in each of the two shell parts 28 and 30. The assembled pelt board $\mathbf{10}^{VI}$ shown in FIGS. 24-27 further provide the advantage of collapsing the pelt board in its entire length and allows for machinery operated removal of the pelt from the pelt board. The overall cross section of the pelt board is similar to the geometry of an ellipse in the non-expanded or collapsed state, which provides an improved function as to easy mounting of the pelt and easy removal of the pelt after collapsing the pelt board. The high number of air apertures serving to allow air to circulate through the pelt board and further through the pelt allows for the drying air to be passed from the inside of the pelt board to the outside. The overall opening air layer of the overall transversal opening area of the pelt board is approximately 1200 $mm^2$ calculated as the open area. In the drying of the pelt, the air is, as is evident from FIGS. 25 and 26 guided inside the pelt board along approximately 60% of the overall length of the pelt board and then transferred to the outer surface of the pelt board through the apertures shown in the enlarged views A and B of FIG. 26.

Figure 28A:
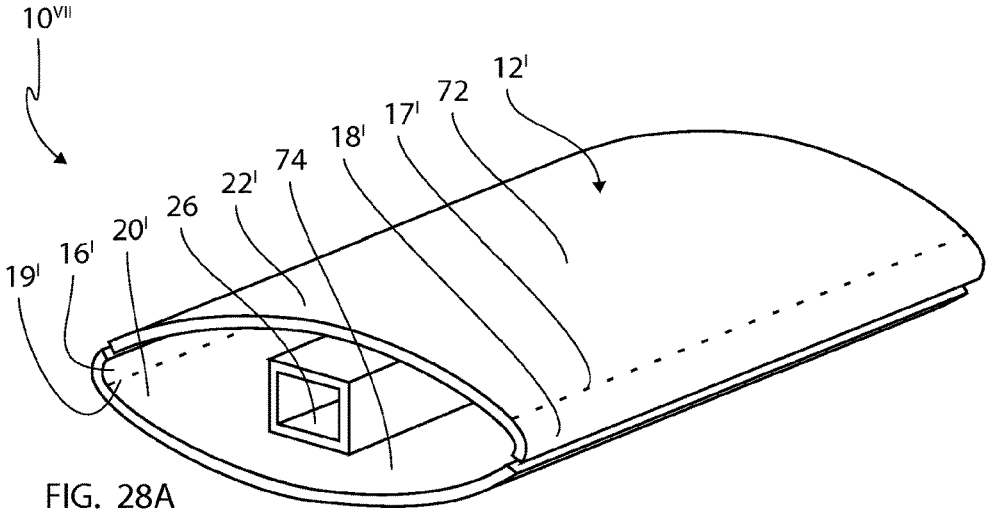
FIGS. 28A, 28B and 28C are a series illustrating schematically a first embodiment of a pelt board according to the present invention.
Figure 31A:
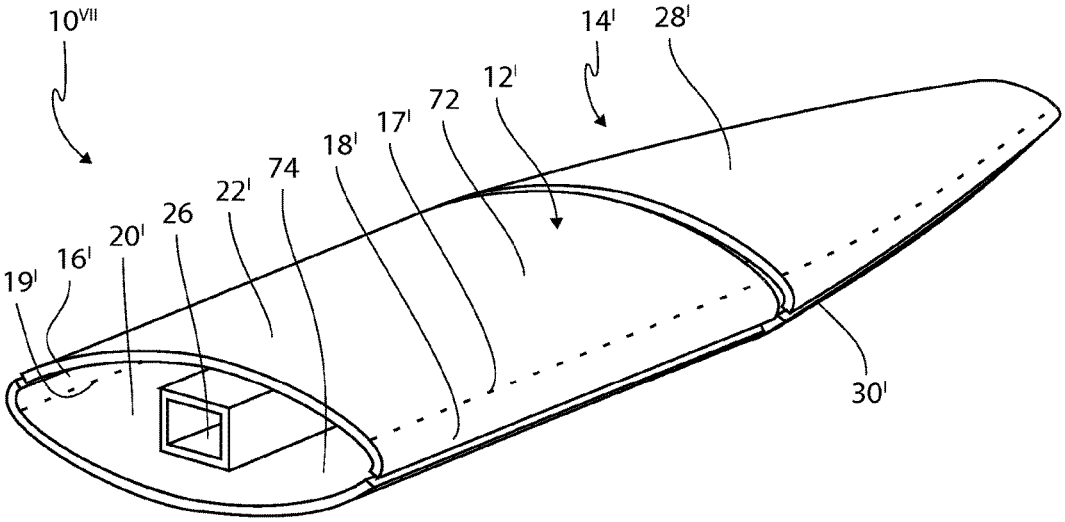
FIGS. 31A and 31B are illustrations similar to the illustrations of FIGS. 28A and 28B, respectively, of a complete pelt board.
Figure 31B:
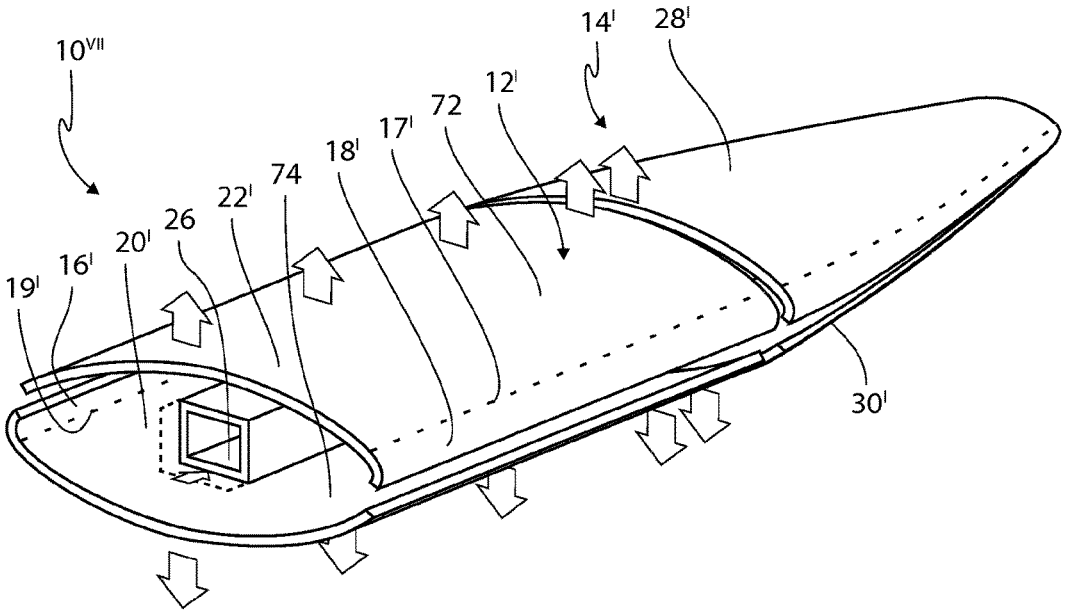

FIG. 28A shows a perspective view of a part of a further embodiment of a pelt board $\mathbf{10}^{VII}$ in its contracted or non-expanded state. The pelt board $\mathbf{10}^{VII}$ resembles the above described embodiments $\mathbf{10}^{VI}$ shown in FIGS. 20A, 20B, 20C, 21A, 21B, 22A, 22B, 23A, 23B and 23C. The part of the pelt board $\mathbf{10}^{VII}$ shown in FIG. 28A constitutes the lower part $\mathbf{12}^{I}$ of the pelt board, which is shown in FIGS. 31A and 31B, which will be described in greater details below.

The lower part $\mathbf{12}^{I}$ of the pelt board $\mathbf{10}^{VII}$ is composed of a total of three components, namely two identically shaped shell parts 72 and 74 and a central elongated core element 26.

Each of the shell parts 72 and 74 comprise a major low curvature wall part $\mathbf{22}^{I}$ and $\mathbf{20}^{I}$, respectively, and a minor high curvature wall part $18^I$ and $16^I$, respectively. The major low curvature wall parts $22^I$ and $20^I$ are joint to the minor high curvature parts $18^I$ and $16^I$, respectively, through imaginary lines $17^I$ and $19^I$, respectively.

The embodiment of the pelt board $10^{VII}$ shown in FIG. 28A is of a structure, in which the two identically shaped shell parts 72 and 74 in the contracted or non-expanded state shown in FIG. 28A constitute an almost perfectly configured elliptical cross sectional configuration as the longitudinal edges of the oppositely positioned shell parts 72 and 74 join one another in a basically unbroken elliptically cross sectional configuration. The elliptical cross sectional configuration of the pelt board $10^{VII}$ shown in FIG. 28A is believed to improve the ability of the pelt board to allow an easy removal of the pelt from the pelt board after the tanning of the pelt as the outer surface of the pelt board $10^{VII}$ in its contracted or collapsed state is almost "perfectly" uniform without any substantive discontinuities.

Figure 28B:
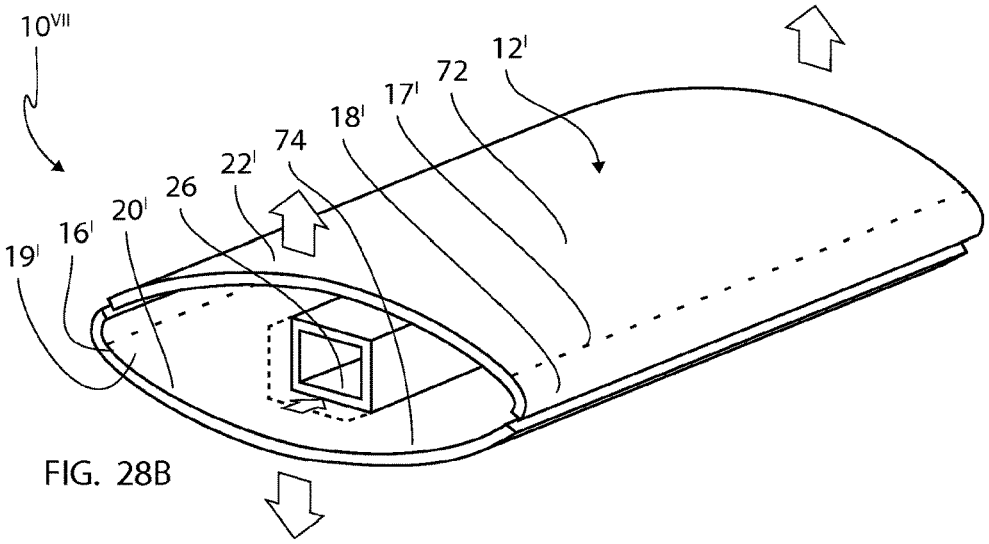

In FIG. 28B, the embodiment of the pelt board $10^{VII}$ is shown in its expanded state, in which the two shell parts 72 and 74 are caused to be shifted away from one another establishing a gap between the edges of the oppositely positioned shell parts 72 and 74. The shift of the shell parts 72 and 74 away from one another as illustrated in FIG. 28B and indicated by arrows is accomplished by shifting the central elongated core element 26 in a direction also indicated by an arrow inwardly into the interior of the pelt board $10^{VII}$ forcing the shell parts 72 and 74 away from one another.

Figure 28C:
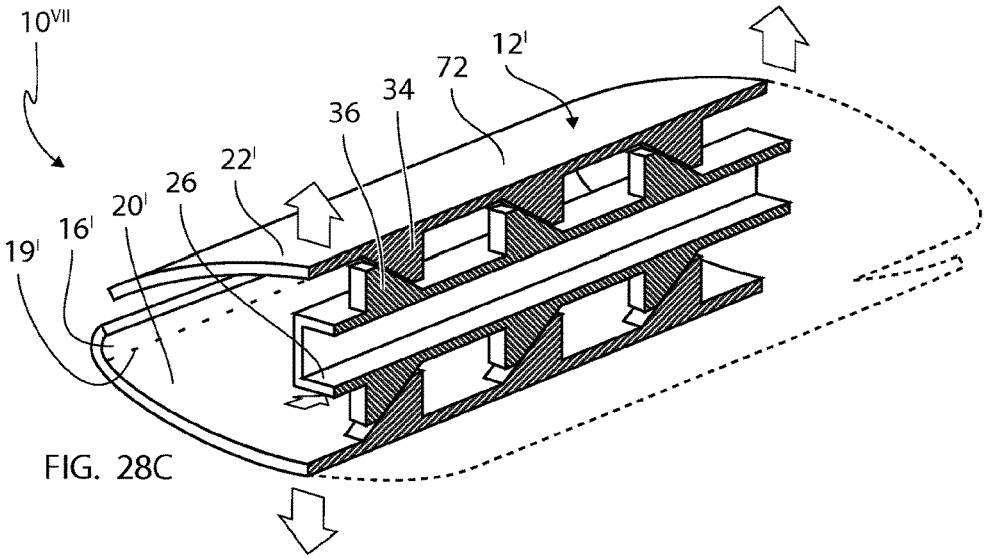

The separation or the shifting of the shell parts 72 and 74 is accomplished by means of cooperating actuator elements 34 and 36 shown in FIG. 28C identical to the actuator elements 34 and 36 shown in FIG. 21B and described above, the actuator elements 34 being constituted by triangularly shaped bodies extending inwardly from the central part of the major low curvature wall part $22^I$ of the shell part 72 and likewise from the major low curvature wall part $20^I$ of the shell part 74, and the central elongated rod 26 is provided with actuator members 36 defining cooperating sloping cam surfaces with which the actuator members 34 cooperate for pushing the shell parts 72 and 74 away from one another to the expanded state shown in FIG. 28C.

Figure 29A:
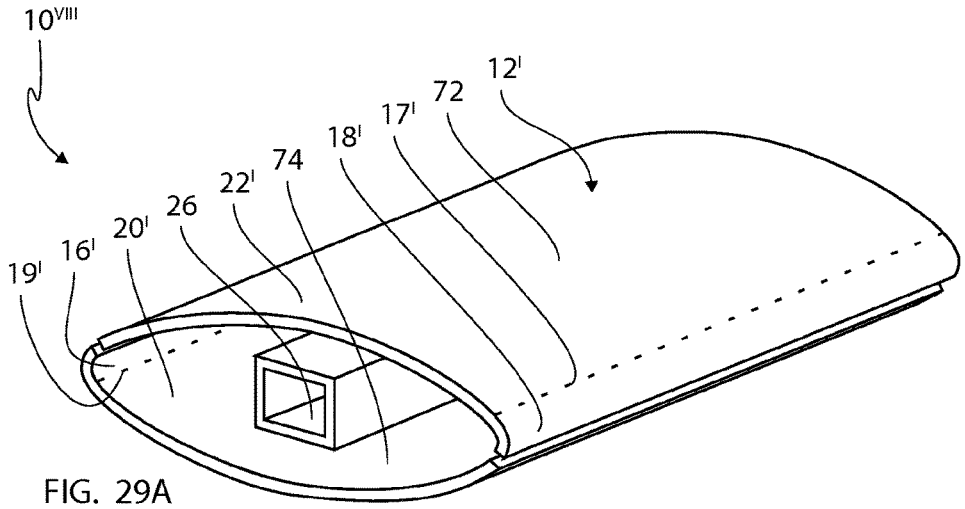
FIGS. 29A, 29B and 29C are a series similar to the series of FIGS. 28A, 28B and 28C, respectively, illustrating an alternative embodiment of the pelt board according to the present invention.
Figure 29B:
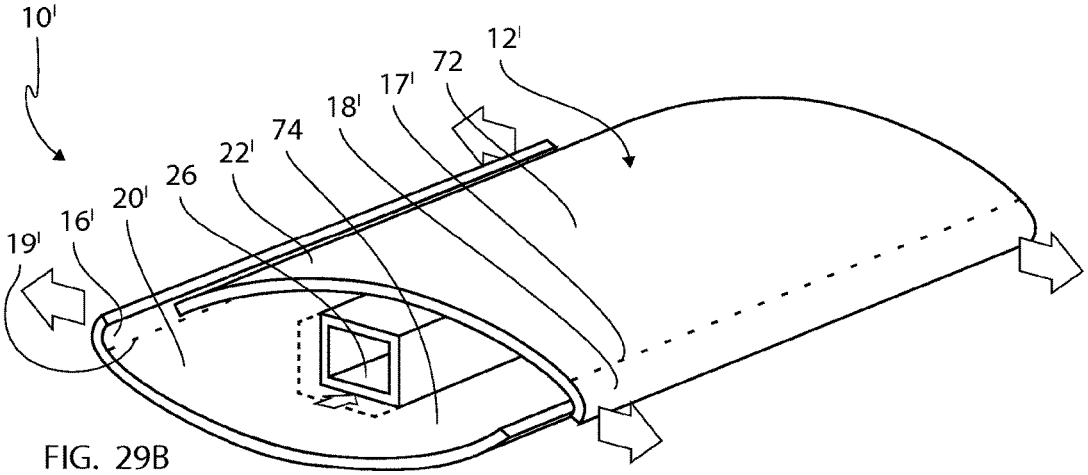
Figure 29C:
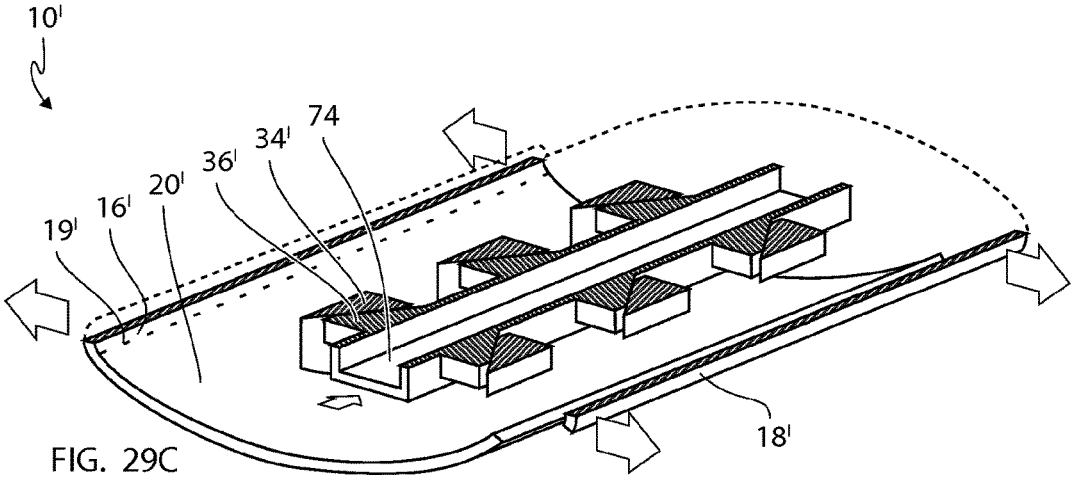

In FIGS. 29A, 29B and 29C, a further embodiment of the pelt board $10^{VIII}$ is shown having the same shell parts 72 and 74 as illustrated in FIGS. 28A, 28B and 28C as described above and the central elongated core element 26. Whereas in FIGS. 28B and 28C, the expansion of the pelt board is established as a vertical separation by pushing the shell parts away from one another, the second embodiment shown in FIGS. 29A, 29B and 29C establishes the expansion of the pelt board by shifting the shell parts 72 and 74 sidewise as illustrated in FIG. 29B and as accomplished by the cooperation between actuator members $34^I$ and $36^I$ shown in FIG. 29C. To be more precise, in FIG. 29B, the shell part 72 is shifted to the right and similarly, the shell part 74 is shifted to the left relative to the central elongated core elements 26.

Figure 30A:
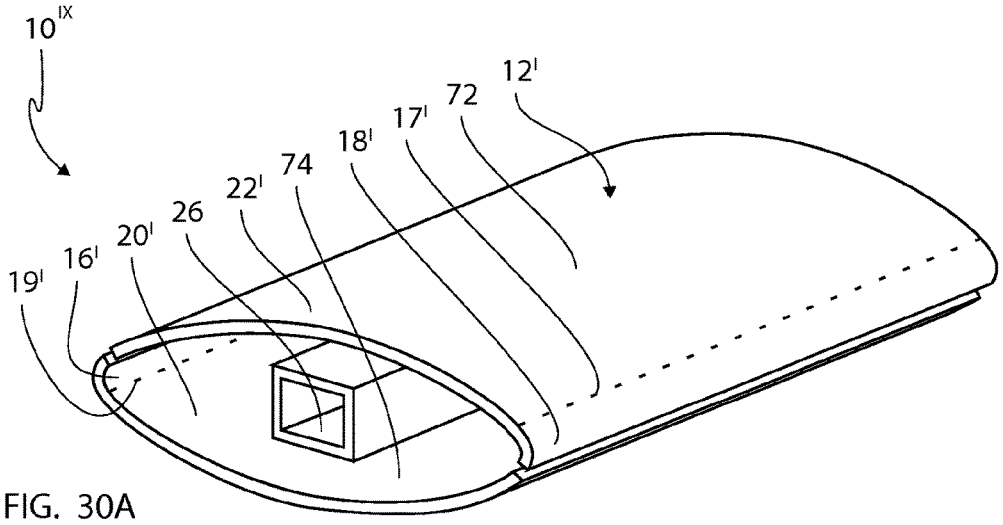
FIGS. 30A, 30B and 30C are a series similar to the series of FIGS. 29A, 29B and 29C, respectively, illustrating a modification of the embodiment shown in FIGS. 29A, 29B and 29C.
Figure 30B:
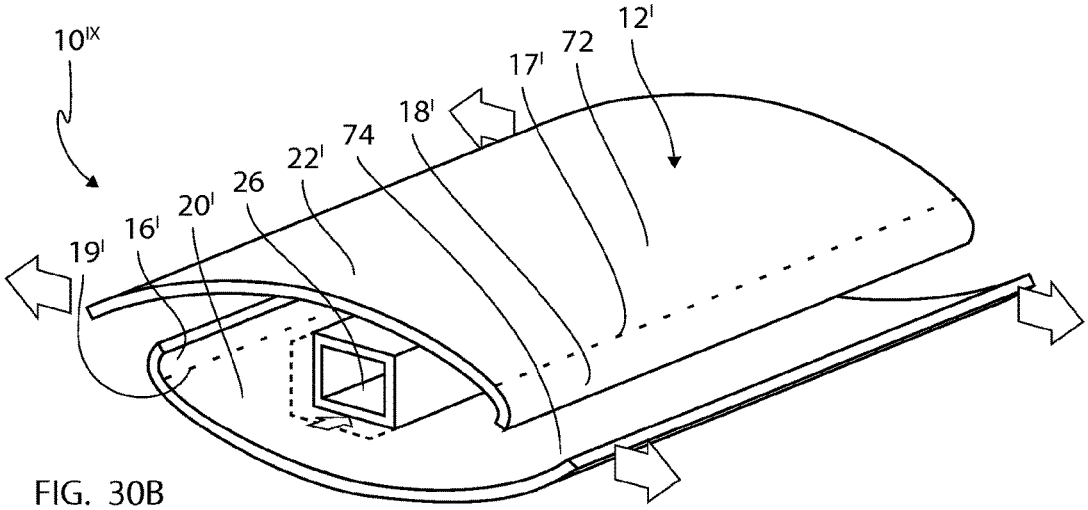
Figure 30C:
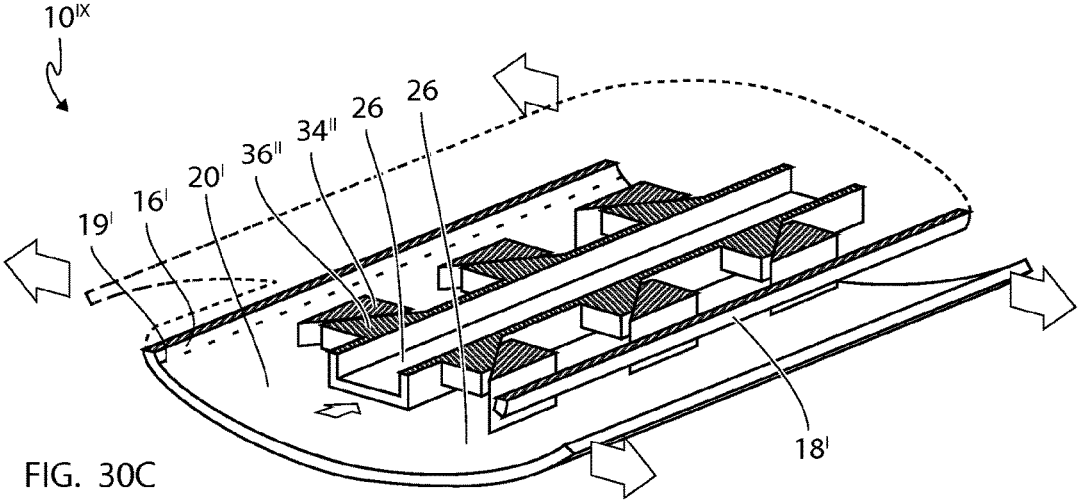

In FIGS. 30A, 30B and 30C, a modified or alternative embodiment of the further embodiment $10^{IX}$ shown in FIGS. 29A, 29B and 29C, respectively, is illustrated differing from the above described further embodiment $10^{VIII}$ in that the modified embodiment shifts the shell parts 72 and 74 in opposite directions as compared to the shifting shown in FIG. 29B and as illustrated in FIG. 30B, the shell part 72 is shifted to the left and simultaneously, the shell 74 is shifted to the right as accomplished by the modified cooperating actuator members $34^{II}$ and $36^{II}$.

In FIGS. 31A and 31B, the entire pelt board $10^{VII}$ is shown having in addition to the lower part $12^I$ shown in FIG. 28A, an upper part 14 constituting a geometrical extension and continuation of the lower part $12^I$ and having a tapering configuration. The upper part $14^I$ also comprises two shell parts $28^I$ and $30^I$ which, like the shell parts 72 and 74 of the lower part 12, are caused to be separated similar to the separation of the shell parts 72 and 74 of the embodiment $10^{VII}$ described above with reference to FIGS. 28A, 28B and 28C. It is readily understood that the separation of the two shell parts $28^I$ and $30^I$ of the upper part $28^I$ is accomplished in the same manner as described above with reference to FIGS. 28A, 28B and 28C in relation to the lower part $12^I$ of the pelt board $10^{VII}$, and like the further embodiment $10^{VIII}$ shown in FIGS. 29A, 29B and 29C and the modified embodiment $10^{IX}$ shown in FIGS. 30A, 30B and 30C, the complete pelt board $10^{VII}$ shown in FIGS. 31A and 31B may be modified into establishing the sidewise expansion described above with reference to FIGS. 29A, 29B and 29C and also FIGS. 30A, 30B and 30C.

Figure 32:
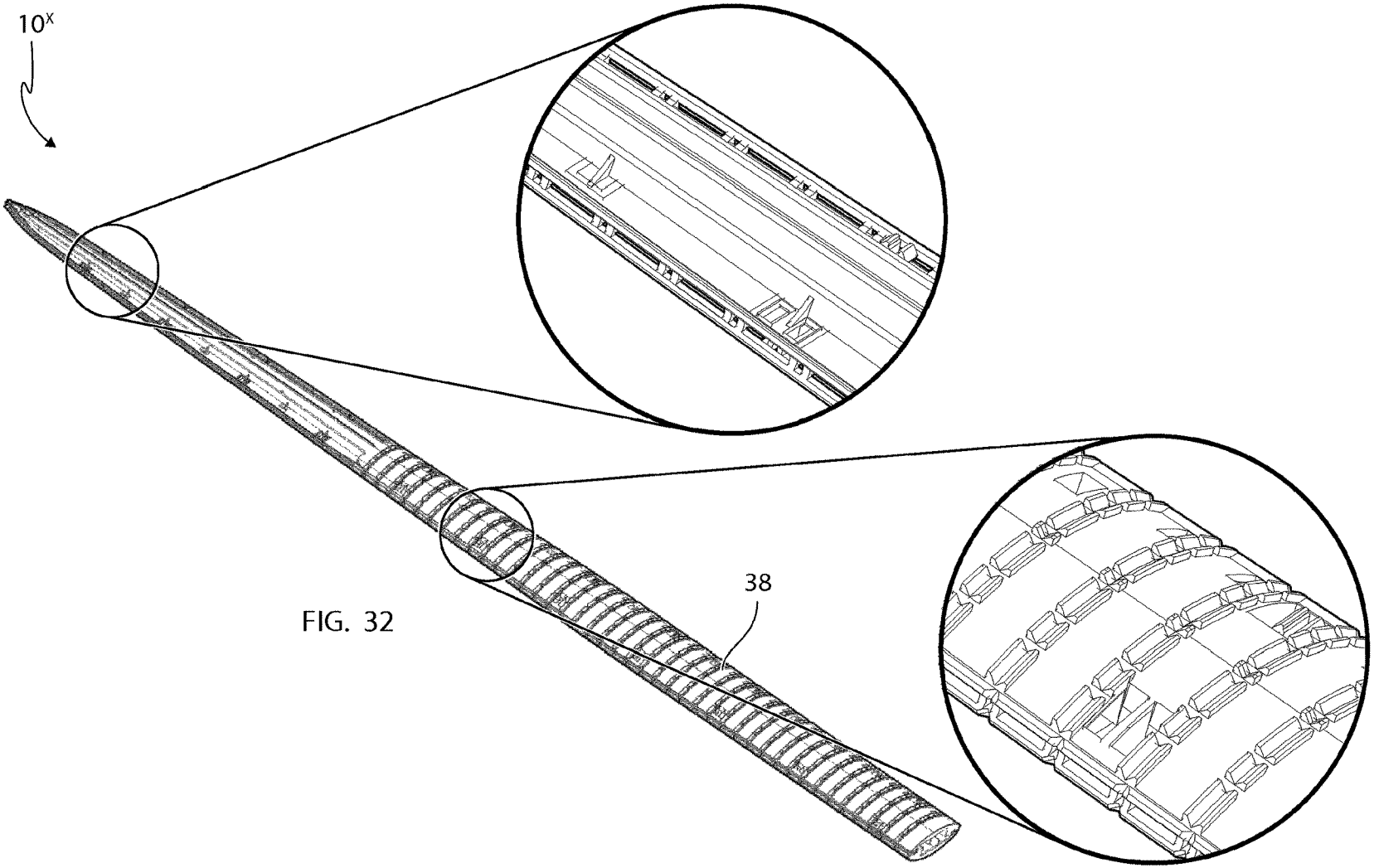
FIG. 32 illustrates details of the pelt board shown in FIGS. 28A-28C.
Figure 33:
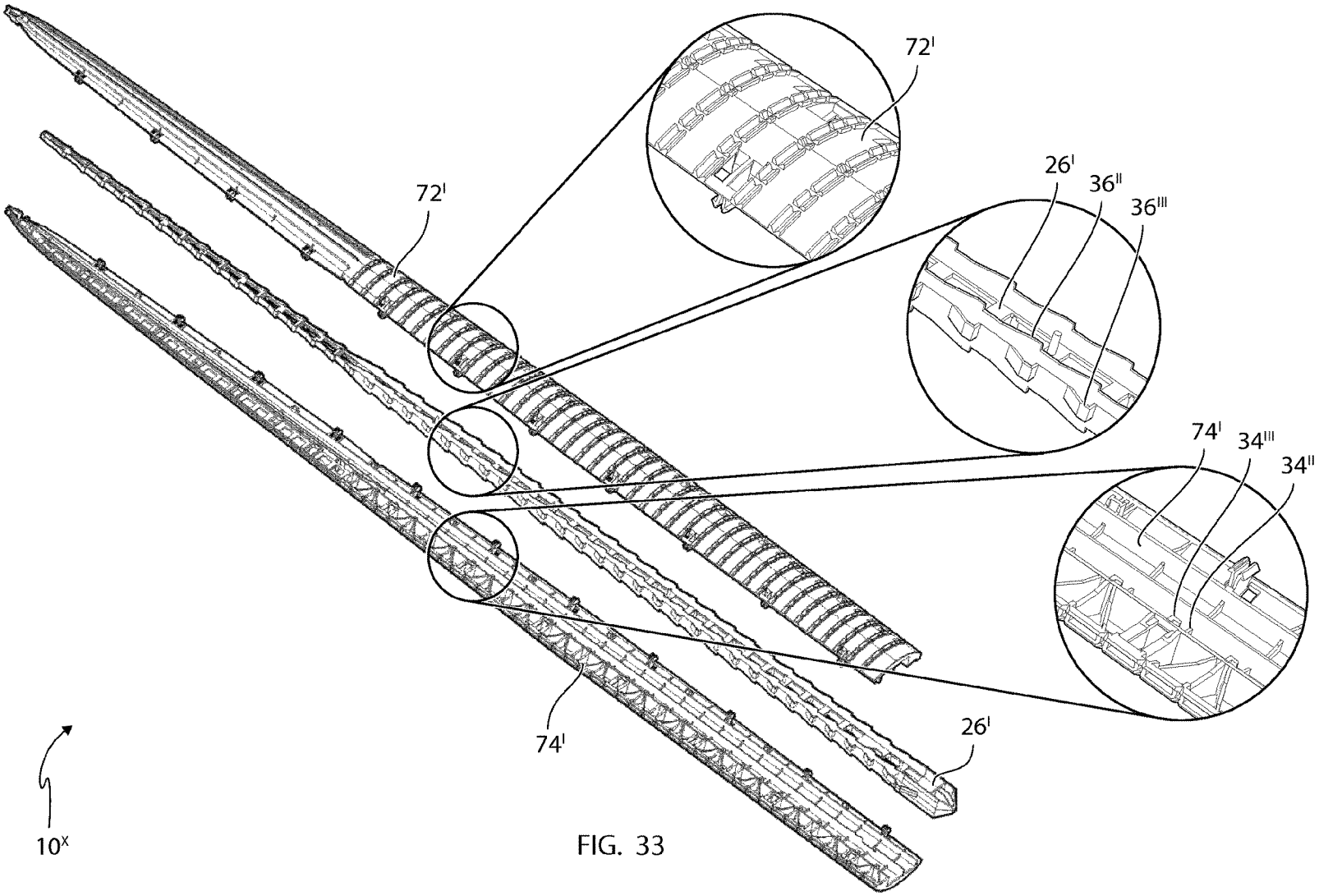
FIG. 33 illustrates further details of the assembling of the pelt board shown in FIG. 32.

FIG. 32 and FIG. 33 illustrate in greater details a further embodiment $10^X$ of the pelt board according to the present invention, which embodiment exhibits the highly advantageous feature of being composed of no more than three components, namely two identically shaped shell parts $72^I$ and $74^I$ and the central core element 36. The shell parts $72^I$ and $74^I$ integrally comprise the shell parts 72, 72 and $28^I$, 30, respectively, of the embodiment $10^{VII}$ of the pelt board, as the shell parts 72 and 72 and similarly the shell parts $28^I$ and $30^I$ of the lower and upper parts $12^I$ and $14^I$, respectively, of the pelt board $10^{VII}$ are constituted by a single integral component $72^I$ and $74^I$, respectively. Likewise, the central elongated core element serving to shift in a forced manner the shell parts $72^I$ and 74I from the contracted or non-expanded state to the expanded state and vice versa serve to engage with the actuator elements of the shell parts $72^I$ and $74^I$.

Figures 34, 34A:
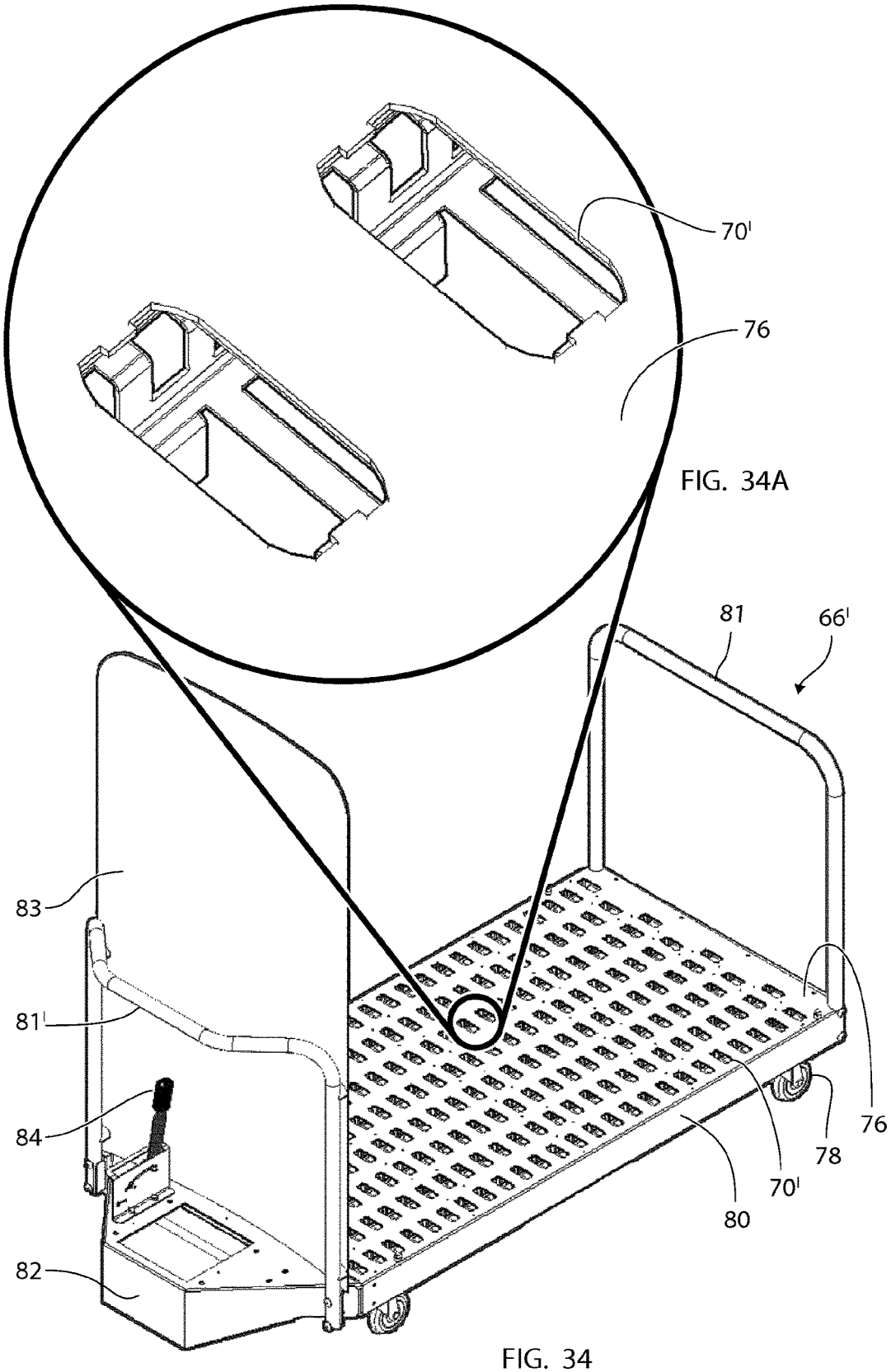
FIG. 34 illustrates a presently preferred embodiment of a drying unit in a first operational position and FIG. 34A illustrates two pelt board receiving apertures of the top plate of the drying unit.
Figures 35, 35A:
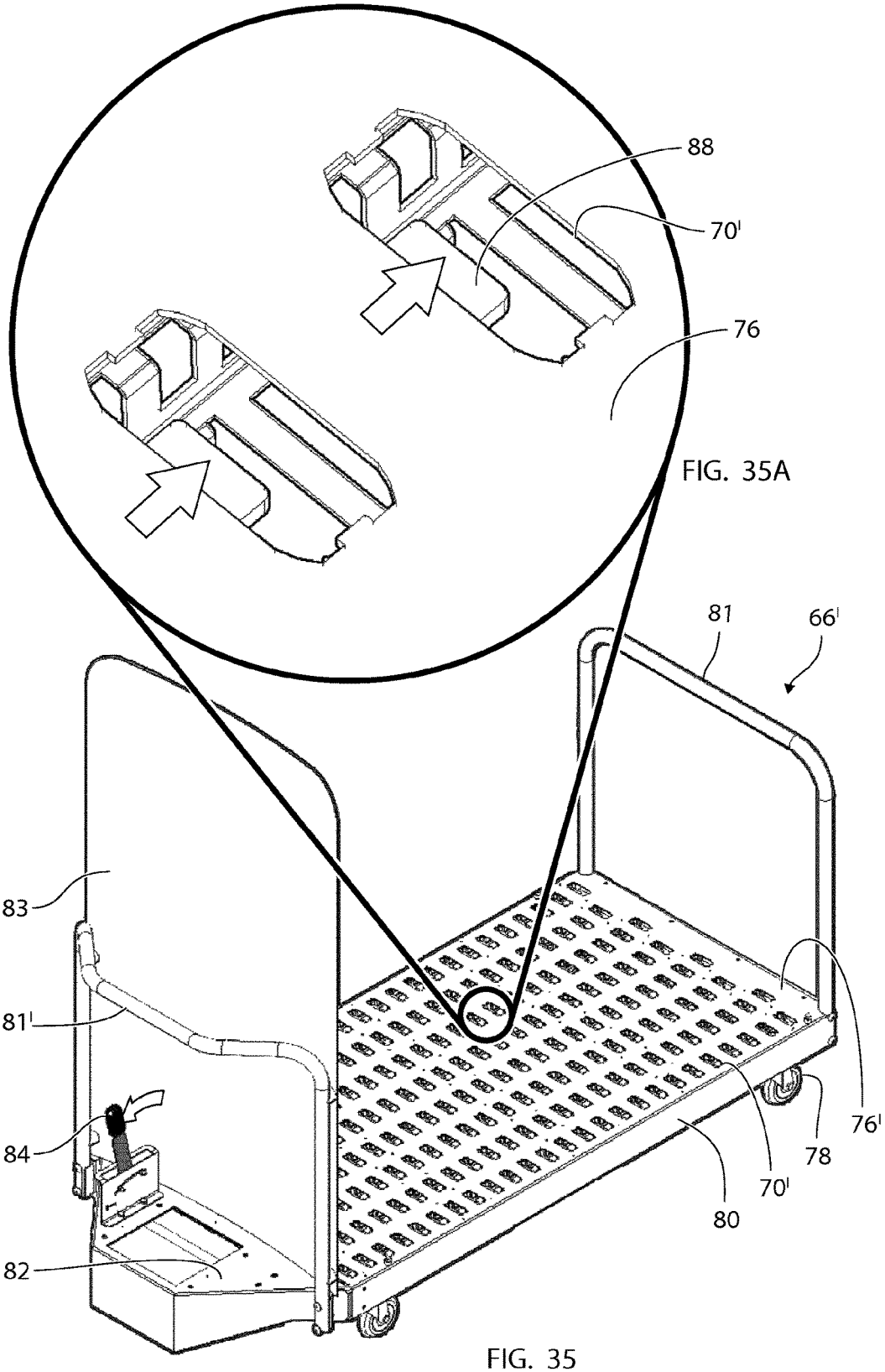
FIG. 35 illustrates, similar to FIG. 34, the drying unit in a second operational mode
FIG. 35A illustrates the two pelt board receiving apertures in the second operational mode of locking the pelt board relative to the drying unit.

In FIGS. 34 and 35, a presently preferred embodiment of a drying unit constituting a wheeled or movable carriage is shown designated the reference numerals $66^I$ in its entirety. The drying unit includes a housing constituting a shallow box 80 having an apertured plate 76 and sealed off or closed sidewalls. Below the housing 80, the drying unit is provided with four wheels, one of which is designated the reference numeral 78. At the left-hand end of the housing 80, a hollow and apertured housing extension 82 is provided, on which a ventilator is to be mounted in a position similar to the position of the ventilator 68 shown in FIG. 19. The wheeled or movable carriage constituting the presently preferred embodiment of the drying unit $66^I$ is further provided with two carriage handles 81 and $81^I$ positioned at opposite ends of the shallow box 80, the one carriage handle being composed of straight line bars, whereas the handle $81^I$ is a cranked carriage handle as the cranked carriage handle $81^I$ is positioned juxtaposed a separation wall 83, which is located between the aperture housing extension 82 and the housing 80 and serving the purpose of preventing air from being sucked into the ventilator not shown in the drawing from the pelt boards positioned and received in the drying unit, as the drying would be short-circuited by the re-entrance of air from the pelt boards into the ventilator and into the drying unit deteriorating, without the presence of the separation wall 83, the drying process. The ventilator is omitted in FIGS. 34 and 35 for disclosing the interior of the aperture housing extension 82.

On the housing extension 82, an operator handle 84 is provided, which may be shifted as indicated by an arrow in FIG. 35 from a first position shown in FIG. 34 into a second position shown in FIG. 35. FIGS. 34A and 35A are enlarged scale views of two apertures 70$^{I}$ of the top plate 76 of the drying unit 66$^{I}$ illustrated in FIG. 34, in which the handle 84 is in its first position, and free access through the apertures 70$^{I}$ of the top plate into the interior of the housing 80 is provided, whereas in FIG. 35A, in which the handle 84 is in its second position, a locking plate 88 is shifted into the free passage through the aperture 70$^{I}$ serving to lock a pelt board positioned on the top plate 76 of the drying unit in its intentional position and preventing the pelt board 10$^{X}$ from being disconnected from the drying unit per se in a way well known in the art.

Figure 36:
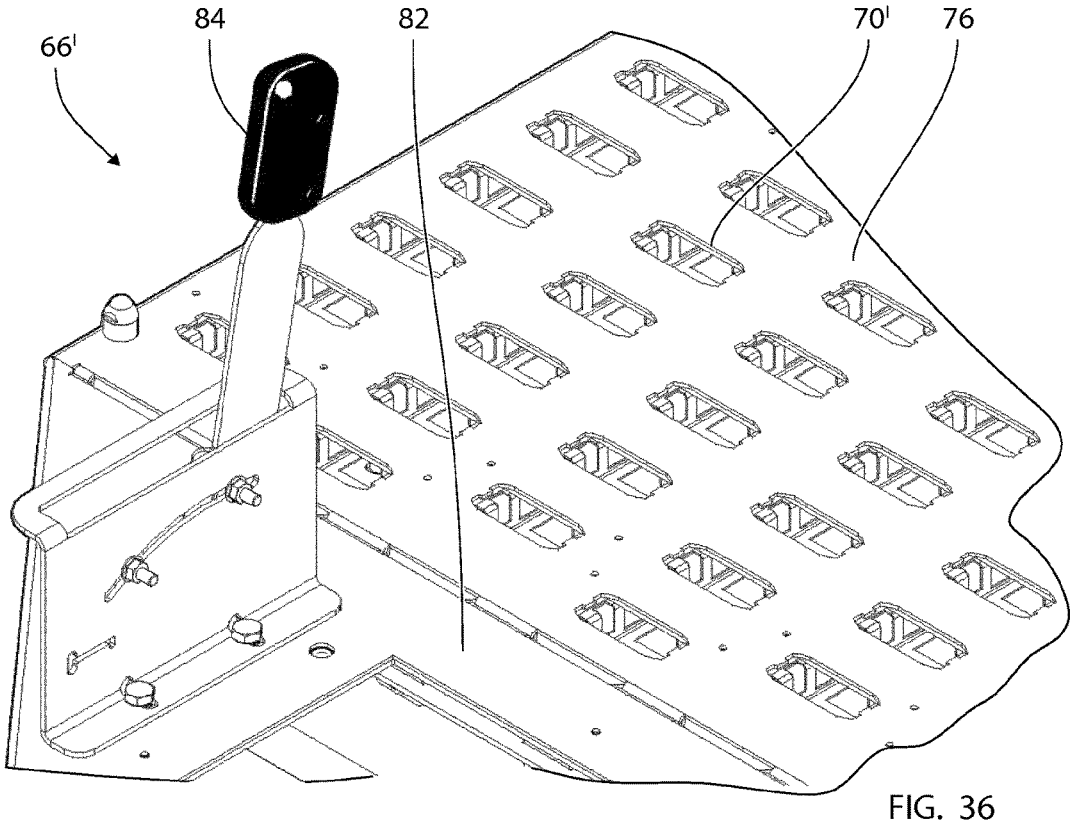
FIG. 36 illustrates in a larger scale the top plate of the drying unit in the first operational mode.
Figure 37:
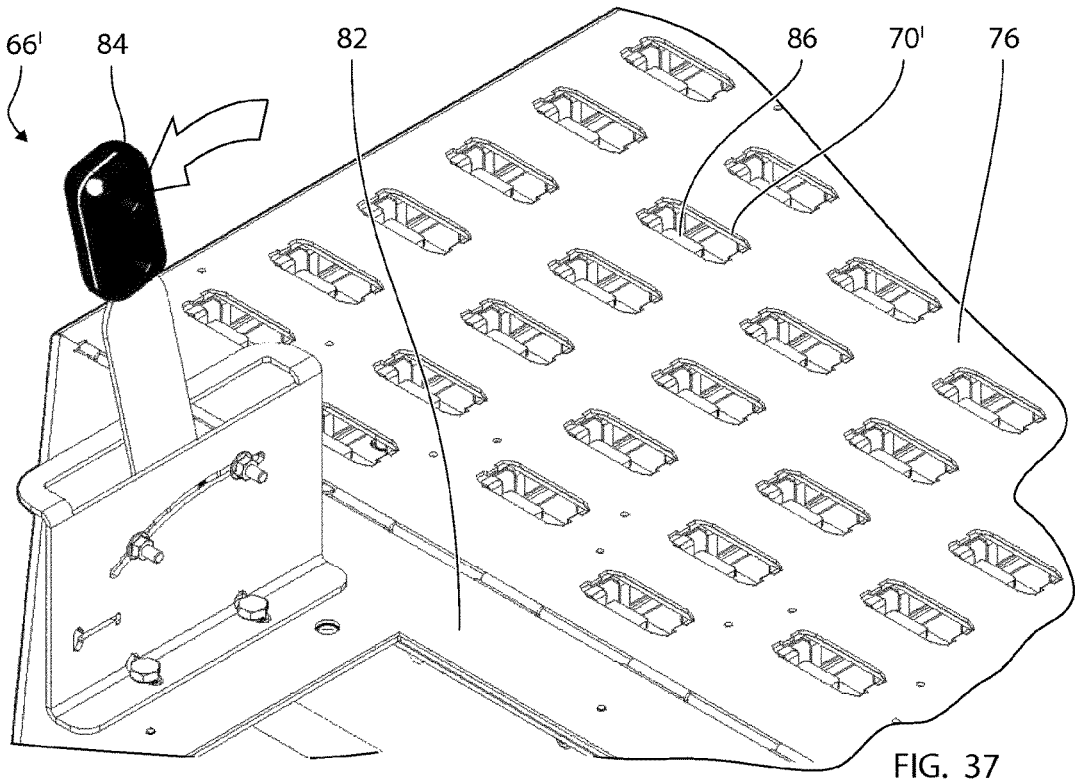
FIG. 37 illustrates, similar to FIG. 36, the top plate of the drying unit in the second operational mode.
Figure 41:
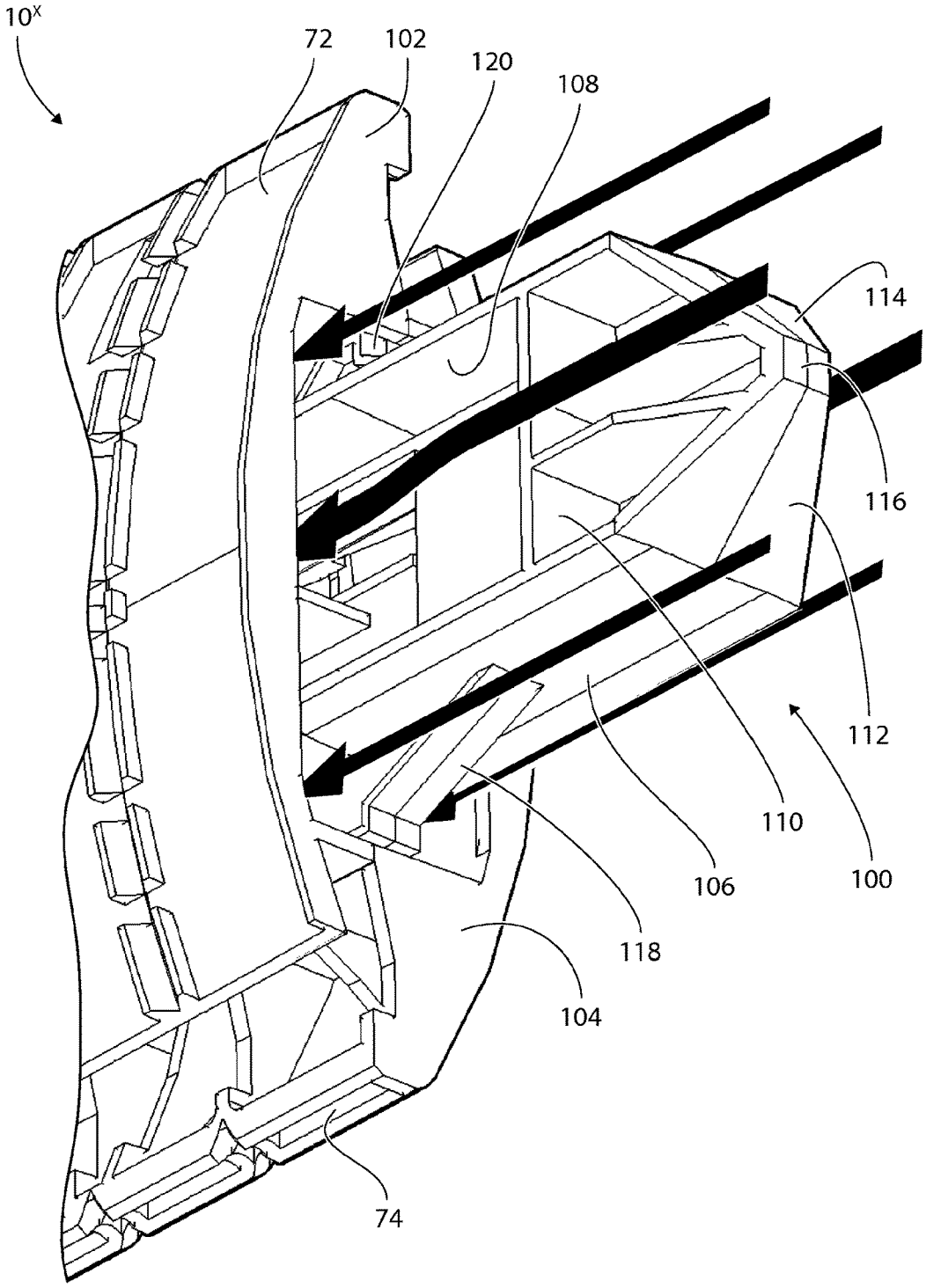
FIG. 41 illustrates the novel connector of the presently preferred embodiment of the pelt board illustrating the increased air inlet capability.

FIGS. 36 and 37 illustrate in greater details similar to the views of FIGS. 34 and 35, respectively, the top plate 76 of the drying unit, as the handle 84 is in FIG. 36 in its first position similar to the position shown in FIG. 34 and in FIG. 37 in the second position, similar to the position of FIG. 35, and establishing the locking of the pelt boards to the top surface of the drying unit by the locking plates, one of which is designated the reference numeral 86 by engagement with the connector of the pelt board, which connector will be described in greater details below with reference to FIG. 41. It is contemplated that the presently preferred embodiment of the drying unit 66$^{I}$ may be provided with closing off plates closing or sealing off the individual apertures 70$^{I}$ of the top plate 76 of the drying unit 66$^{I}$, which closing off plates are journalled at the one side of the apertures opposite to the side from which the locking plate 86 are pushed into engagement with the connector of the pelt board, as the locking plates are spring biased and seal off the apertures 70$^{I}$, which are not opened by the introduction of a connector of a pelt board, and the apertures, which are not opened by the introduction of the cooperating connector of the pelt board are kept sealed off as the forward motion of the locking plate 86 to the positions shown in FIGS. 35A and 37 prevents the locking plates from being pushed aside after the handle 84 has been moved to its second position shown in FIGS. 35 and 37.

Figure 38:
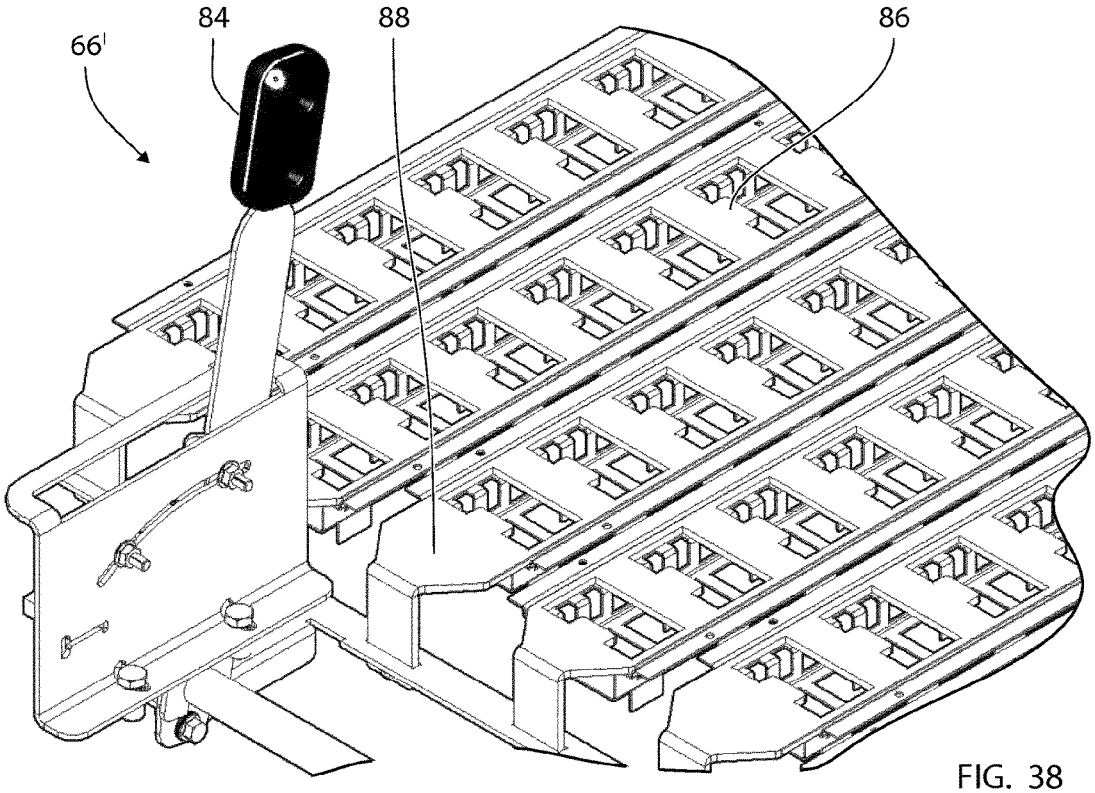
FIG. 38 illustrates the locking elements positioned below the top plate of the drying unit in the first operational mode.
Figure 39:
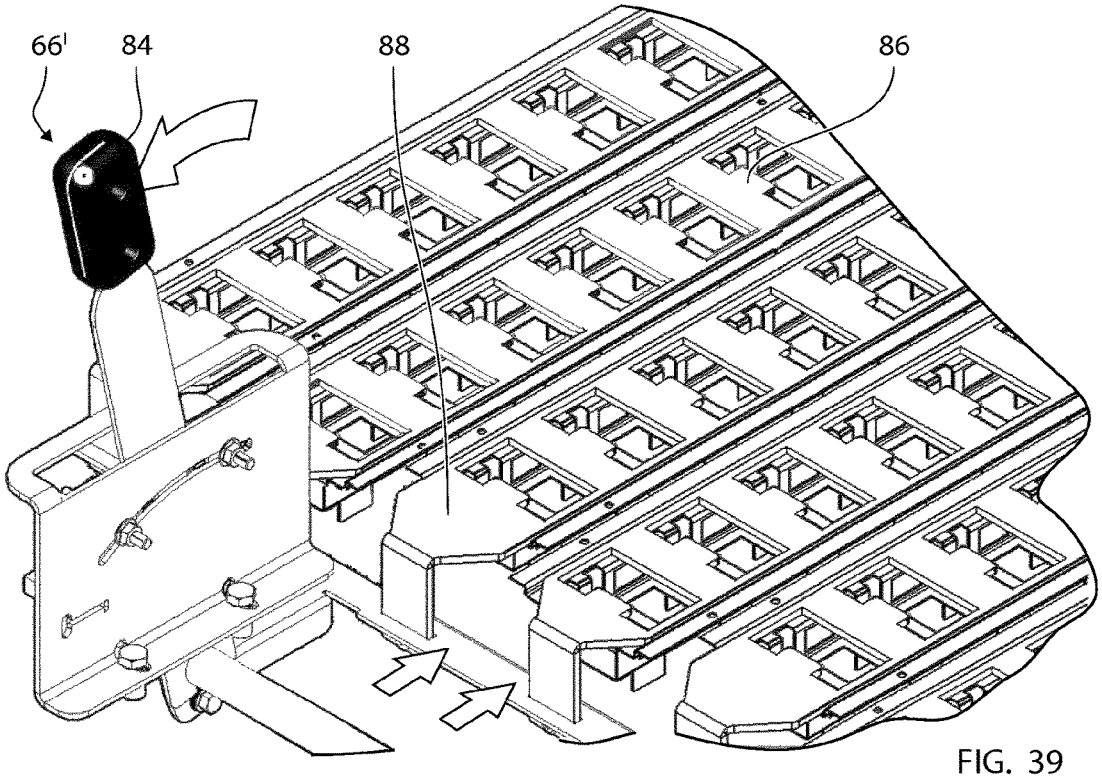
FIG. 39 illustrates, similar to FIG. 38, the locking elements in the second operational mode.

In FIGS. 38 and 39, sets of locking plate assemblies 88 having individual locking plates 86 for catching and locking a connector received within a top plate aperture 70$^{I}$ are shown. In FIG. 38, the locking plate assemblies are shifted to their first position similar to the position of the handle 84 being in its first position and, as illustrated in FIG. 39, the locking assemblies 88 are moved as indicated by arrows by shifting the handle 84 to its second position also shown and indicated by an arrow for shifting the locking plate 86 from the positions shown in FIGS. 34 and 36 to the positions shown in FIGS. 35 and 37.

Figures 40, 40A, 40B, 40C:
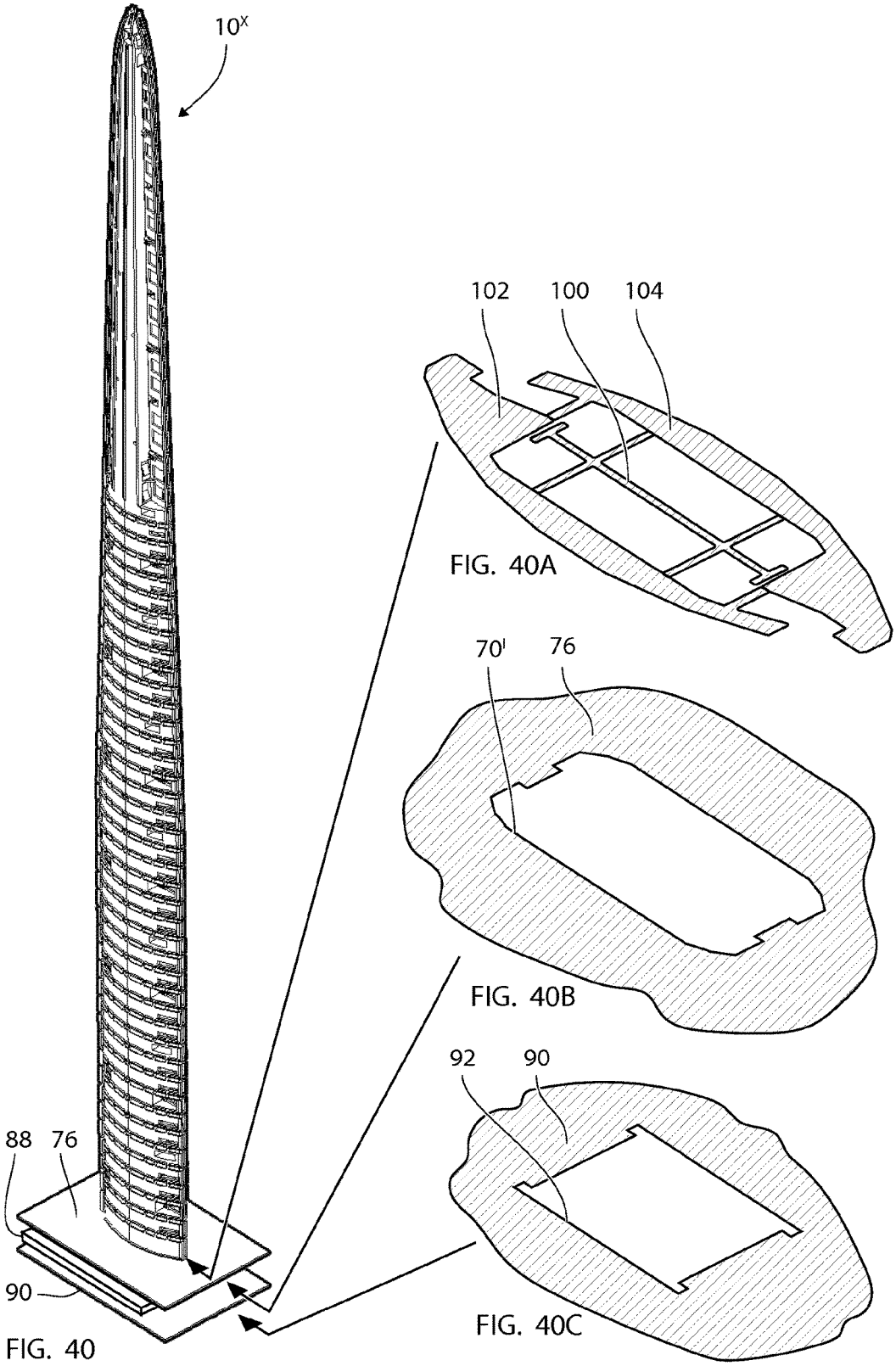
FIG. 40 illustrates the presently preferred embodiment of the pelt board positioned on the top plate of the drying unit and 40A, 40B and 40C illustrate schematically the openings or apertures of the individual plates of the drying unit.

In FIG. 40, the presently preferred embodiment of the pelt board 10$^{X}$ is shown mounted on the top plate 76 of the presently preferred embodiment of the drying unit 66$^{I}$ described above with reference to FIGS. 34-37. The pelt board 10$^{X}$ mounted on the top plate 76 is shown in the left hand side of FIG. 40 and along with the top plate 76, the locking plate assembly 88 is shown together with a further plate 90, which is positioned below the locking assemblies 88 and serves to align the pelt board 10$^{X}$ in its intentional vertical position as the pelt board is locked to the top surface 76 by the locking plate 86 catching into the connector of the pelt board 10$^{X}$, which connector is shown in FIG. 41 and designated the reference numeral 100. Likewise, in FIG. 41, the bottom surfaces of the shell parts 42 and 74 are designated the reference numerals 102 and 104, respectively.

In FIG. 40A, the contour of the bottom surface or a horizontal sectional view through the bottom end of the pelt board 10$^{X}$ is shown indicating the size of the bottom surfaces 102 and 104 and the fairly small area of the bottom end covered by the connector 100 within the through-going aperture defined or delimited between the shell parts 72 and 74.

In FIG. 40B, the aperture 70$^{I}$ of the top plate 76 is shown and likewise, in FIG. 40C, the plate 90 having a through-going aperture 92 is shown, which aperture is aligned with the aperture 70$^{I}$ of the top plate and also the free through-going area delimited between the inner surfaces of the shell parts 72 and 74, into which the connector 100 extends.

Turning to FIG. 41, the lower end of the presently preferred embodiment of the pelt board 10$^{X}$ is shown illustrating the bottom surfaces 102 and 104 of the shell parts 72 and 74, respectively, and further, the free area delimited at the bottom end, in which the connector 100 is received. As is evident from FIG. 41, a total of six air passages are provided into the interior of the pelt board 10$^{X}$ as distinct from the air inlet into a conventional connector of the kind described in the prior art as a "stubby element" and implemented in the commercial products produced by the applicant company and known as a 'FIX-tane 2' and also by the competitor company Jasopels A/S, which competitor company's product is known as 'XL tane'. In the conventional connector of the kind described in the prior art as a "stubby element" and implemented in the products from the applicant company and the competitor company Jasopels A/S, the overall cross sectional area of the connector giving access into the interior of the pelt board via inlet passages or slots in the prior art connector measures 400 mm$^2$ as the peripheral length of the aperture is 80 mm. As distinct from this conventional and fairly small aperture limiting the air capability into the interior of the pelt board via inlet passages or slots in the prior art connector, the aperture into the interior of the presently preferred embodiment of the pelt board 10$^{X}$ through the bottom surfaces 102 and 104 measures 1518 mm$^2$, i.e. measures approximately four times the area of the conventional pelt board products.

In the connector 100 shown in FIG. 41, two side walls 106 and 108 are provided, which are interconnected by a transversal wall 110, the top surface of which serves to cooperate with the locking plate 86 described above, as the connector is received in its intentional position relative to the top plate 76 of the drying unit 66$^{I}$. The side walls 106 and 108 are further continued into a bottom pointed end part constituted by two sloping and tapering walls 112 and 114, which are joined by a small planar end wall 116. At the outer faces of the side walls 106 and 108, sloping guiding element 118 and 120, respectively, are provided.

Figure 42:
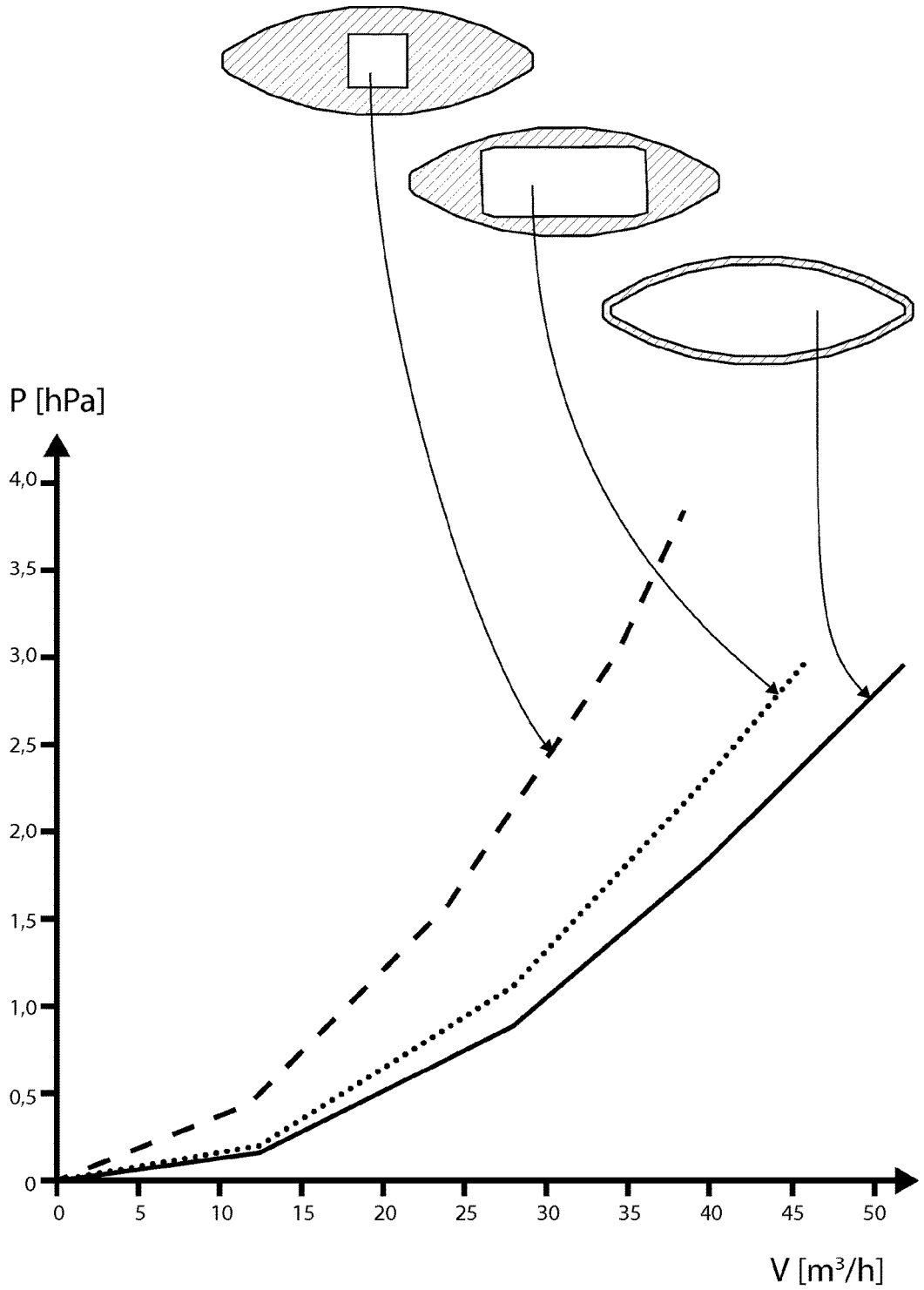
FIG. 42 is a diagram comparing the air inlet capability of a conventional pelt board, a pelt board according to the presently preferred embodiment of the pelt board, and a pelt board having a large entry.

The advantage of the large cross sectional area access into the interior of the pelt board 10$^{X}$ generated by the presence of the fairly large connector 100 and the large area air inlet is illustrated in FIG. 42, which illustrates three curves, a dashed line, a dotted line and a solid line, illustrating the pressure needed for generating a specific flow of air into the pelt board in question, as the dashed line illustrates the correspondence between the pressure needed for generating the air inlet into a conventional pelt board, such as the above mentioned 'FIX-2 tane' produced by the applicant company and similarly, the 'XL tane' produced by the competitor company Jasopels A/S, the dotted line illustrates the results obtained by measurement on a prototype of the pelt board 10$^{X}$ described above with reference to FIGS. 32, 33 and 41 and finally, the solid line curve illustrates the "ideal" curve of a pelt board having an inlet area of 90% as compared to the outer contour of the pelt board 10$^{X}$.

It is to be understood that the outer contour of the pelt boards is determined by the standard of the company Kopenhagen Fur, for which reason the conventional pelt board produced by the applicant company and the competitor company Jasopels A/S, and the new pelt board according to the present invention in any embodiment described herein before or afterwards and also the pelt board shown as indicated referring to the solid line of FIG. 42 all have an outer area of approximately 3300 $mm^2$.

Consequently, the "ideal" pelt board having an inlet area of 90% (delimited by the wall thickness of the pelt board) will have an inlet area of approximately 3000 $mm^2$, i.e. less than twice the inlet area of the presently preferred embodiment of the pelt board $\mathbf{10}^{X}$ having an inlet area of 1518 $mm^2$. It is to be understood that the solid line of FIG. 42 was recorded by using the outer shell of the presently preferred embodiment of the pelt board $\mathbf{10}^{X}$, i.e. without the presence of the bottom surfaces 102 and 104, and the air inlet limitation consequently is generated by the air transmission capability through the interior of the pelt board and the outlet apertures air transmission capability rather than the actual size of the inlet area, as the increase of the inlet area from 1518 $mm^2$ to approximately 3000 $mm^2$ does not generate any substantive increase in the volumetric input at any specific pressure, as is illustrated in FIG. 42. FIG. 42 illustrates the shortcoming of the conventional pelt boards as is evident from FIG. 42, the increase of a volume above 20 $m^3/h$ to a double volumetric input, such as an input of 40 $m^3/h$ necessitates the increase of the pressure by a factor 4 and in addition, as is evident from FIG. 42, the dashed line becomes above 40 $m^3/h$ fairly steep indicating that the limit as to the maximum volume input into the pelt board by increasing the pressure is about to be reached at 4 hPa.

As distinct from the conventional pelt board, the prototype of the presently preferred embodiment of the pelt board according to the present invention clearly allows for a far larger air input than the conventional pelt board as the curve at its right hand end is still far from being steep and exhibits a fairly linear relation between the pressure increase and the volume input increase, as the pressure of approximately 1.5 hPa generates a volumetric input of 25-30 $m^3/h$ at an increase to 3.0 hPa of the inlet pressure almost doubles the air input.

As is evident from FIG. 42, the dotted line is fairly close to the "ideal" solid line indicating that any further increase of the inlet area into the interior of the pelt board will have minor influence on the drying capability of the pelt board as compared to the substantive change from the conventional "stubby element" delimiting the air inlet of the conventional pelt boards as compared to the improved new pelt board according to the present invention.

In FIGS. 43-48, a further embodiment of the drying unit designated the reference numeral $\mathbf{66}^{II}$ is shown, which drying unit is of a configuration similar to the one described above with reference to FIGS. 34-39, however, differing from the above described presently preferred embodiment in that the drying unit $\mathbf{66}^{II}$ constitutes a universal drying unit, which may be modified or adapted to a specific pelt board by the use of an adaptor constituting an interface between the pelt board and the drying unit. The universal drying unit $\mathbf{66}^{II}$ comprises a top plate $\mathbf{76}^{I}$ differing from the top plate 76 of the above described presently preferred embodiment of the drying unit in that the top plate is provided with fairly large apertures, one of which is designated the reference numeral $\mathbf{70}^{II}$, which apertures serve to receive a replaceable adaptor, which constitutes an interface between the universal drying unit and the pelt board in question, as the adaptor is adapted to the pelt board in question and is receivable within the aperture $\mathbf{70}^{II}$ of the universal drying unit $\mathbf{66}^{II}$.

Figures 43, 43A, 43B, 43C:
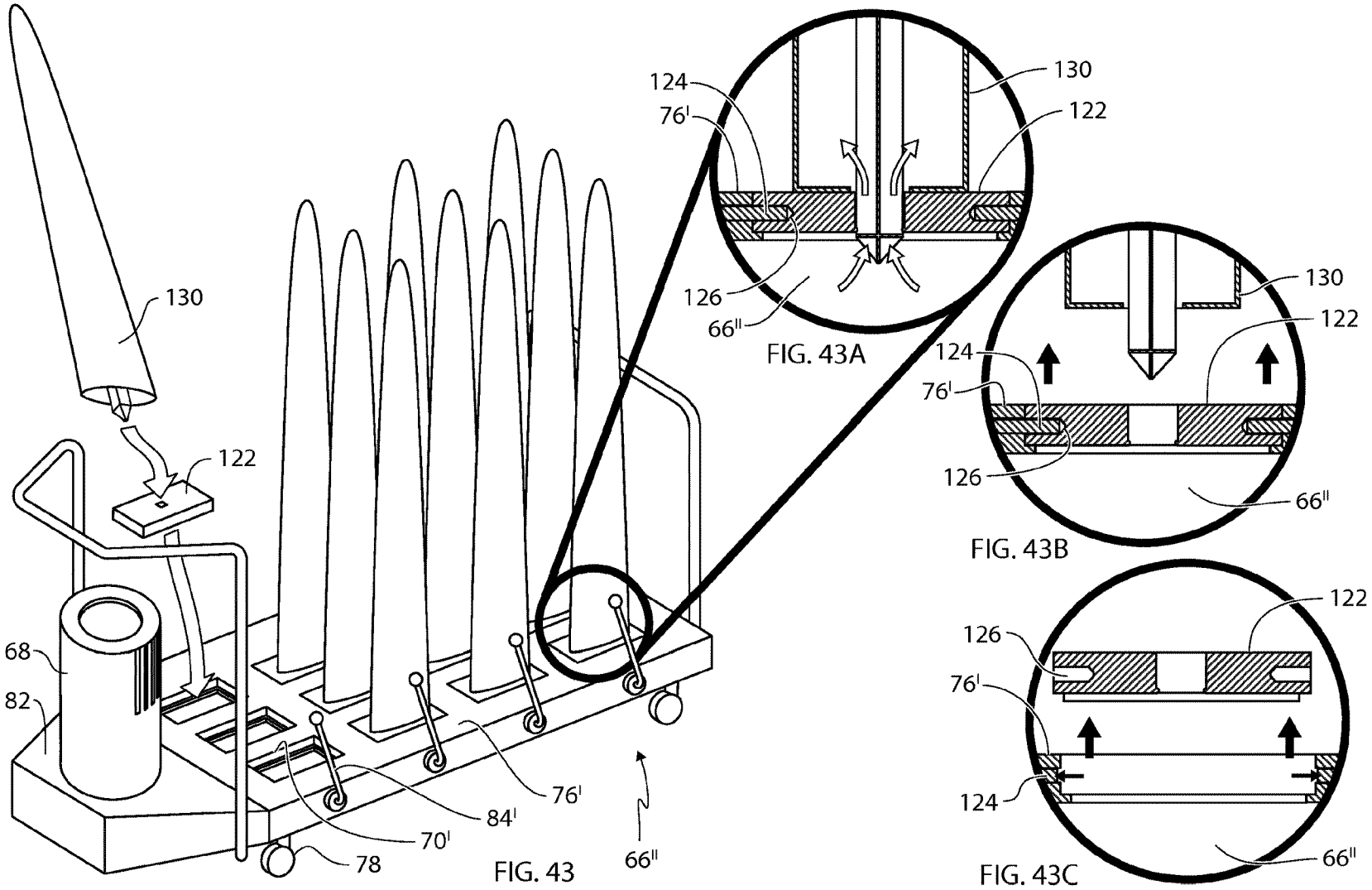
FIG. 43 illustrates a universal drying unit for use with an adaptor allowing the use of the drying unit in combination with a conventional pelt board and FIGS. 43A, 43B and 43C are details of the adaptor.

In FIG. 43, the adaptor 22 is configured for cooperating with a conventional pelt board, such as the pelt board produced by the applicant company and named 'FIX-tane 2' and also the pelt board manufactured and sold by the competitor company Jasopels A/S. The pelt board commercially exploited by the applicant company is described in several patent applications, among others European patent 1 680 520, corresponding U.S. Pat. No. 7,690,228. Like the above described presently preferred embodiment of the drying unit 66 shown in FIGS. 34-39, the universal drying unit $\mathbf{66}^{II}$ has a handle $\mathbf{84}^{I}$ serving to operate the adaptors positioned in a row juxtaposed the handle in question. The universal drying unit $\mathbf{66}^{II}$ shown in FIGS. 43-48 includes a total of four handles $\mathbf{84}^{I}$ for the cooperation with three adaptors in each row operated by the handle in question. The operation of the handle $\mathbf{84}^{I}$ allows the adaptor 122 to be blocked to the universal drying unit $\mathbf{66}^{II}$ as is illustrated in FIGS. 43A and 43C, as the connector 122 is in the enlarged cross sectional view of FIG. 43A locked in position as two opposing tongues 124 operated by the handle $\mathbf{84}^{I}$ are introduced into and locks within a corresponding recess 126 in the adaptor 122. In FIG. 43C, the locking tongues 122 are shifted to a position concealed below the top plate $\mathbf{76}^{I}$ of the universal drying unit $\mathbf{66}^{II}$ allowing the adaptor 122 to be removed from the universal drying unit $\mathbf{66}^{II}$. In FIG. 43B, the conventional pelt board 130 is removed from its position received within the adaptor 122 as shown in FIG. 43A, in which position shown in FIG. 43 the limited air inlet capability of the conventional pelt board 130 is illustrated by the arrows indicating the flow through the so-called "stubby element" of the conventional pelt board. The removal of the conventional pelt board 130 is, as is illustrated in FIG. 43B, simply accomplished by lifting the conventional pelt board off the adaptor 122.

Figures 44, 44A, 44B, 44C:
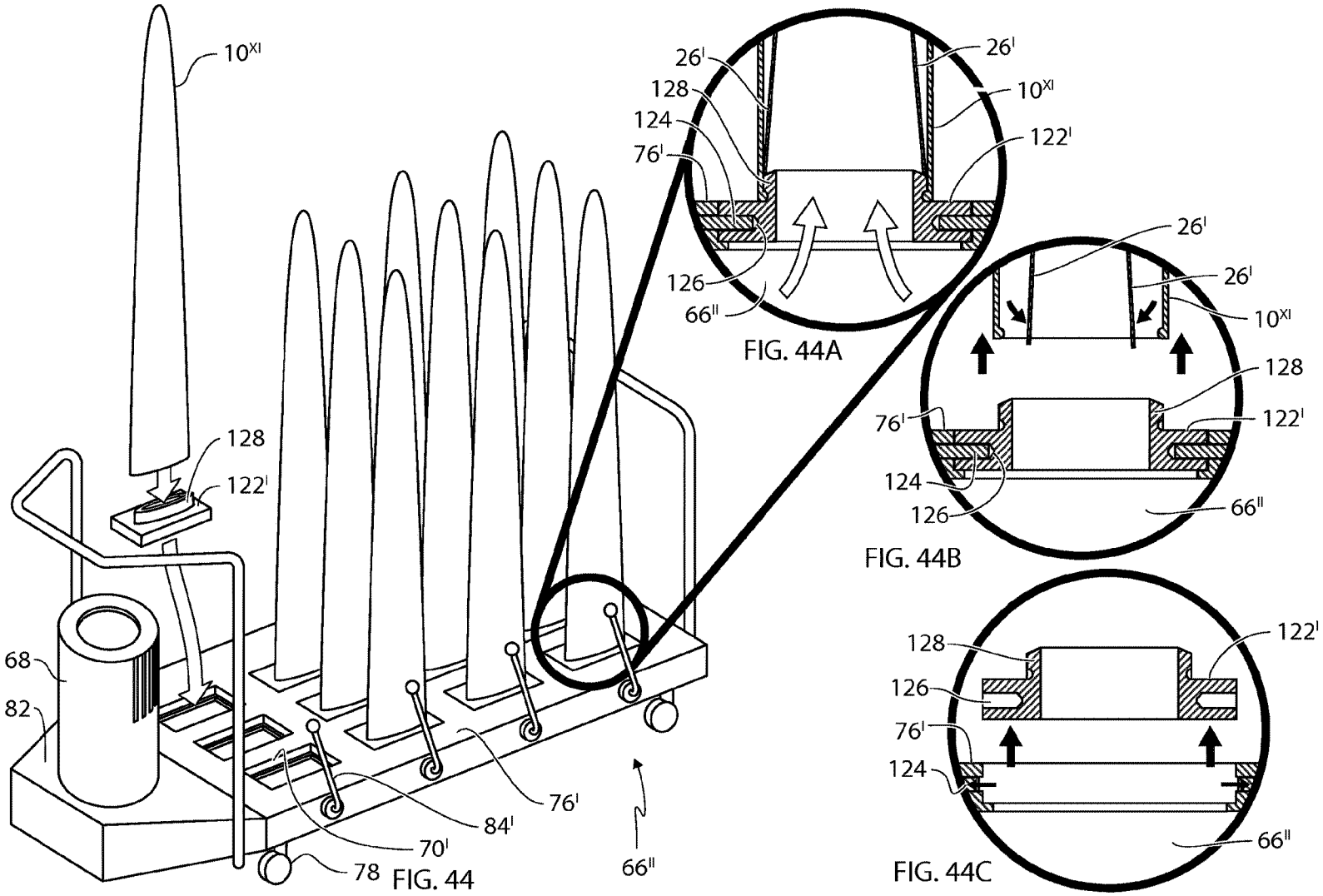
FIG. 44 illustrates, similar to FIG. 43, the universal drying unit with an adaptor for use with a large entry pelt board
FIGS. 44A, 44B and 44C are details similar to the details of FIGS. 43A, 43B and 43C, respectively.
Figures 45, 45A, 45B, 45C:
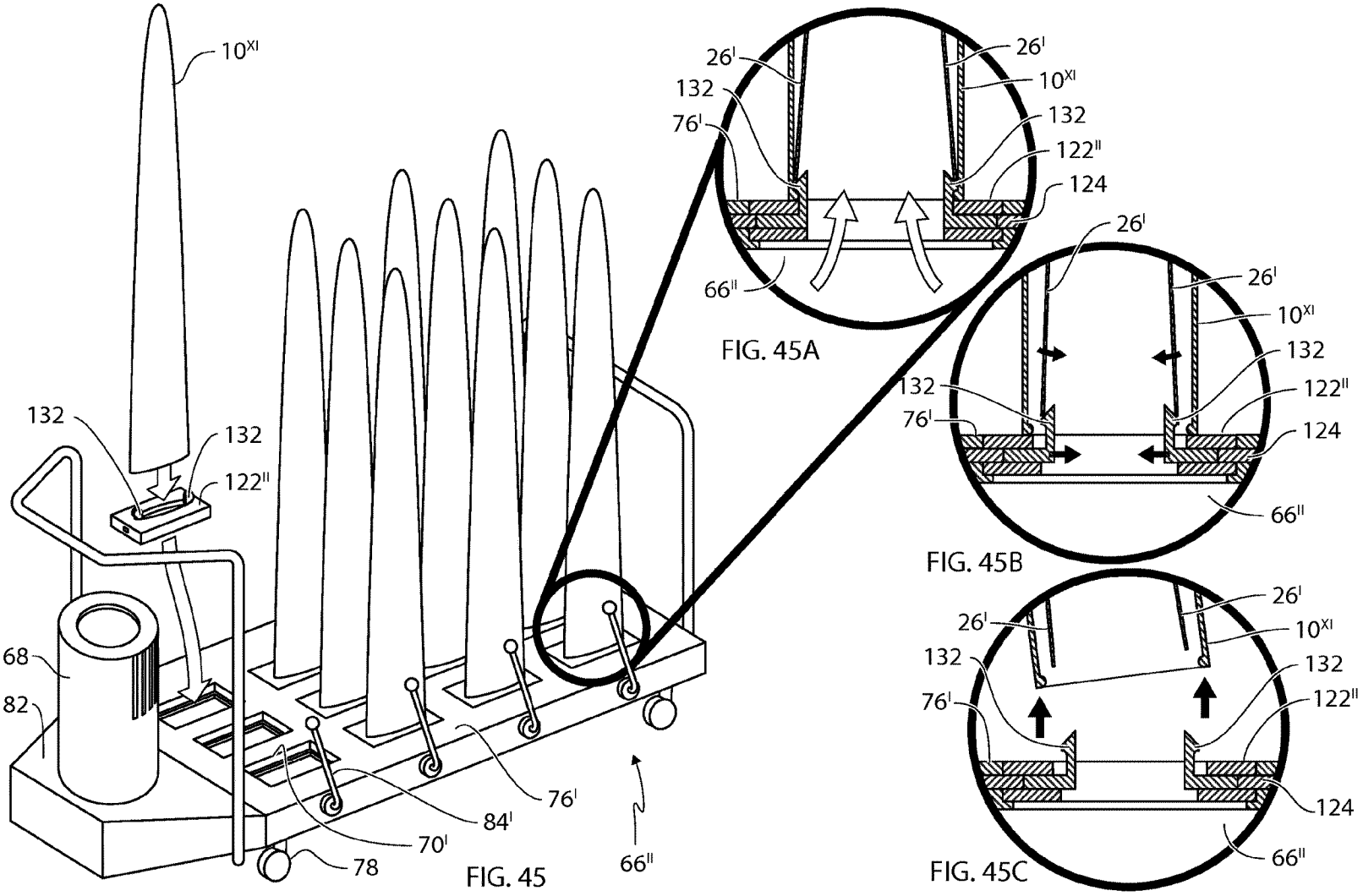
FIG. 45 illustrates, similar to FIG. 44, the universal drying unit with a modified adaptor for use with a large entry pelt board having a large entry.
FIGS. 45A, 45B and 45C are details similar to the details of FIGS. 44A, 44B and 44C, respectively.

In FIG. 44, the universal drying unit $\mathbf{66}^{II}$ is shown, however, including an alternative embodiment of the adaptor, which adaptor is designated the reference numeral $\mathbf{122}^{I}$ and is configured and adapted to cooperate with a further embodiment of the pelt board $\mathbf{10}^{XI}$ according to the present invention, which pelt board is a hollow structure in which the central elongated core element 26 described above is substituted by two actuator pins $\mathbf{26}^{I}$, which are acted by of a top inner flange 128 of the adaptor $\mathbf{122}^{I}$, which flange 128 serves the additional purpose of firstly arresting the pelt board $\mathbf{10}^{XI}$ relative to the adaptor $\mathbf{122}^{I}$, as an inner circumferential bead of the pelt board $\mathbf{10}^{XI}$ catches into a circumferential recess of the flange 128 of the adaptor $\mathbf{122}^{I}$. In FIG. 44B, the disconnection of the pelt board $\mathbf{10}^{XI}$ from the universal drying unit $\mathbf{66}^{II}$ is accomplished by the lifting of the pelt board relative to the universal drying unit $\mathbf{66}^{II}$ and in doing so, disconnecting the circumferential inner bead of the pelt board from the circumferential recess of the flange 128 of the adaptor $\mathbf{122}^{I}$. In FIG. 44C, the disconnection of the adaptor $\mathbf{122}^{I}$ from the universal drying unit $\mathbf{66}^{II}$ is illustrated similar to the view of FIG. 43C. In FIG. 45, a variant or modified version of the universal drying unit is shown, in which a three position handle $\mathbf{84}^{II}$ is included, which handle defines three positions: A first position, in which the adaptor $\mathbf{122}^{II}$ is disconnected from the universal drying unit, as the locking tongues 124 are retracted from their catching into the recesses 126 of the adaptor $\mathbf{122}^{II}$. In a second position of the handle $\mathbf{84}^{II}$, the adaptor $\mathbf{122}^{I}$ is arrested relative to the universal drying unit similar to the above disclosure of the first and second embodiments of the adaptors shown in FIGS. 43 and 44, respectively, and illustrated and described with reference to FIGS. 43A and 44A, respectively.

As distinct from the above described second embodiment of the adaptor 122$^{I}$ shown in FIG. 44, the third embodiment of the adaptor 122$^{II}$ has a pair of arresting catchers 132, which may be shifted from their position shown in FIG. 45A, in which the catchers serve the same purpose as the top flange 128 of the second embodiment of the adaptor 122$^{I}$ described above with reference to FIG. 44 and may be shifted, as the handle 84$^{II}$ is shifted to its third position so as to disengage the catchers from the circumferential bead of the inner surface of the pelt board 10$^{XI}$ and in doing so, also disengaging the actuators 26$^{I}$ for shifting the pelt board from its expanded position to a non-expanded position. As the catchers 132 are moved from their position shown in FIG. 45A arresting the pelt board 10$^{XI}$ relative to the drying unit 66$^{II}$ to its position shown in FIG. 45B, the pelt board may, as is illustrated in FIG. 45C, easily be lifted and removed from the universal drying unit 66$^{II}$ as shown in FIG. 45C.

Figures 46, 46A, 46B, 46C:
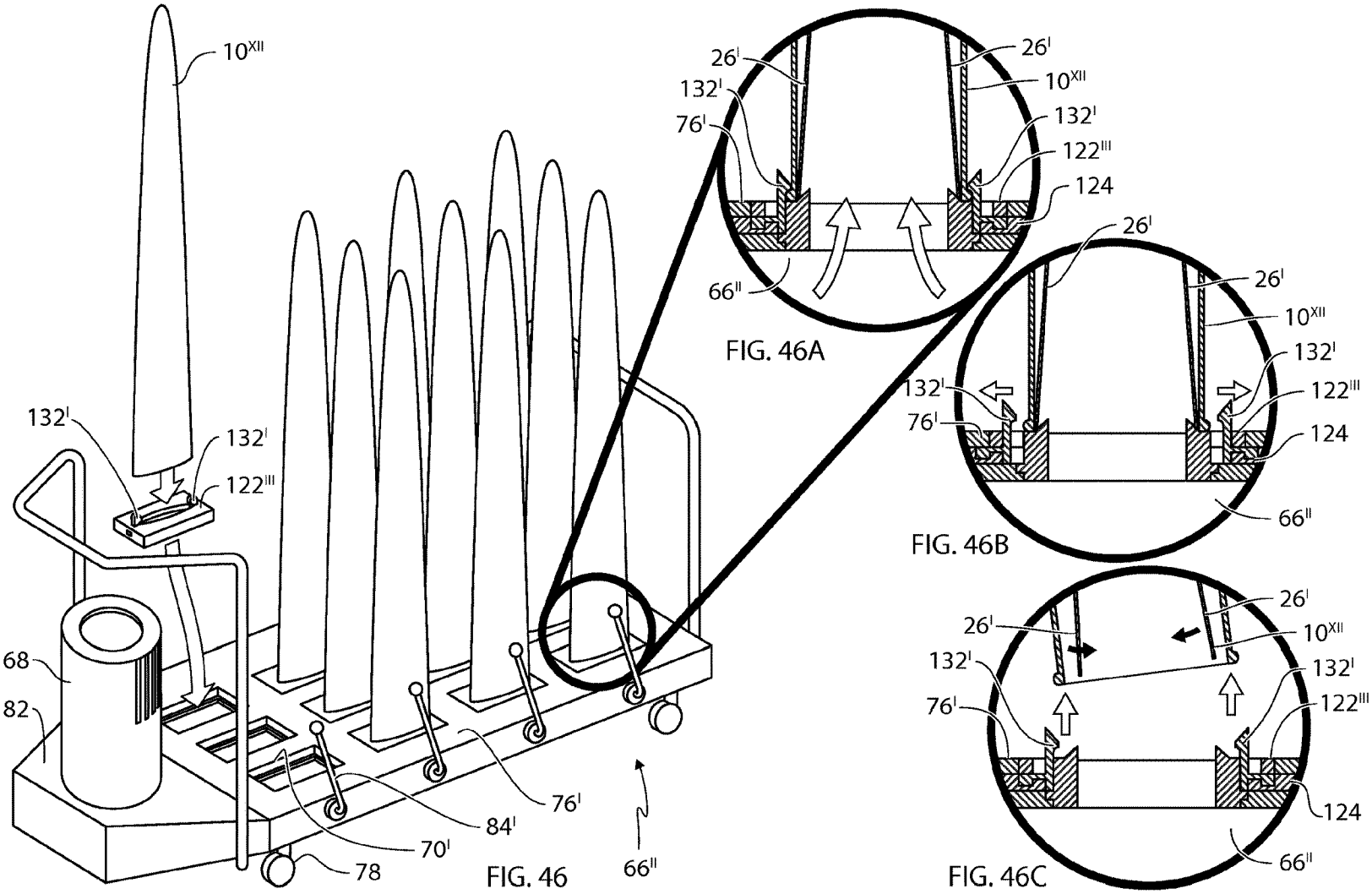
FIG. 46 illustrates, similar to FIG. 45, the universal drying unit with an alternative adaptor for use with the pelt board shown in FIGS. 44 and 45, and FIGS. 46A, 46B and 46C are details similar to the details of FIGS. 45A, 45B and 45C, respectively.

In FIGS. 44 and 45, the pelt board 10$^{XI}$ is, as described above, arrested by the catching of a circumferential bead at the inner surface of the pelt board at its lower end within a circumferential recess or recess of catchers, whereas in FIG. 46, the arresting of the pelt board relative to its cooperating adaptor 122$^{III}$ is established by a circumferential bead extending outwardly from the lower end of the pelt board cooperating with an external set of catchers 132$^{I}$. Whereas the disconnection of the pelt board 10$^{XI}$ from the adaptor 122$^{II}$ is established by shifting the handle 84$^{II}$ of the second embodiment of the universal drying unit 66$^{II}$ shown in FIGS. 43-45 to its third position, the operation of the handle 84$^{III}$ of the third embodiment of the universal drying unit 66$^{II}$ shown in FIG. 46 to its third position provides shifting of the catchers 132$^{I}$ outwardly relative to the pelt board 10$^{XII}$ as is illustrated in FIG. 46B. By the shifting of the catchers 132$^{I}$ from their position shown in FIG. 46A to their positions shown in FIG. 46B, the pelt board 10$^{XII}$ is easily lifted off the connector 122$^{III}$ as is shown in FIG. 46C. The disconnection of the adaptors 122$^{II}$ and 122$^{III}$ shown in FIGS. 45 and 46, respectively, is as described above established by the shifting of the handle designated the reference numeral 84$^{II}$ and 84$^{III}$, respectively, to the above described third position.

Figures 47, 47A, 47B, 47C:
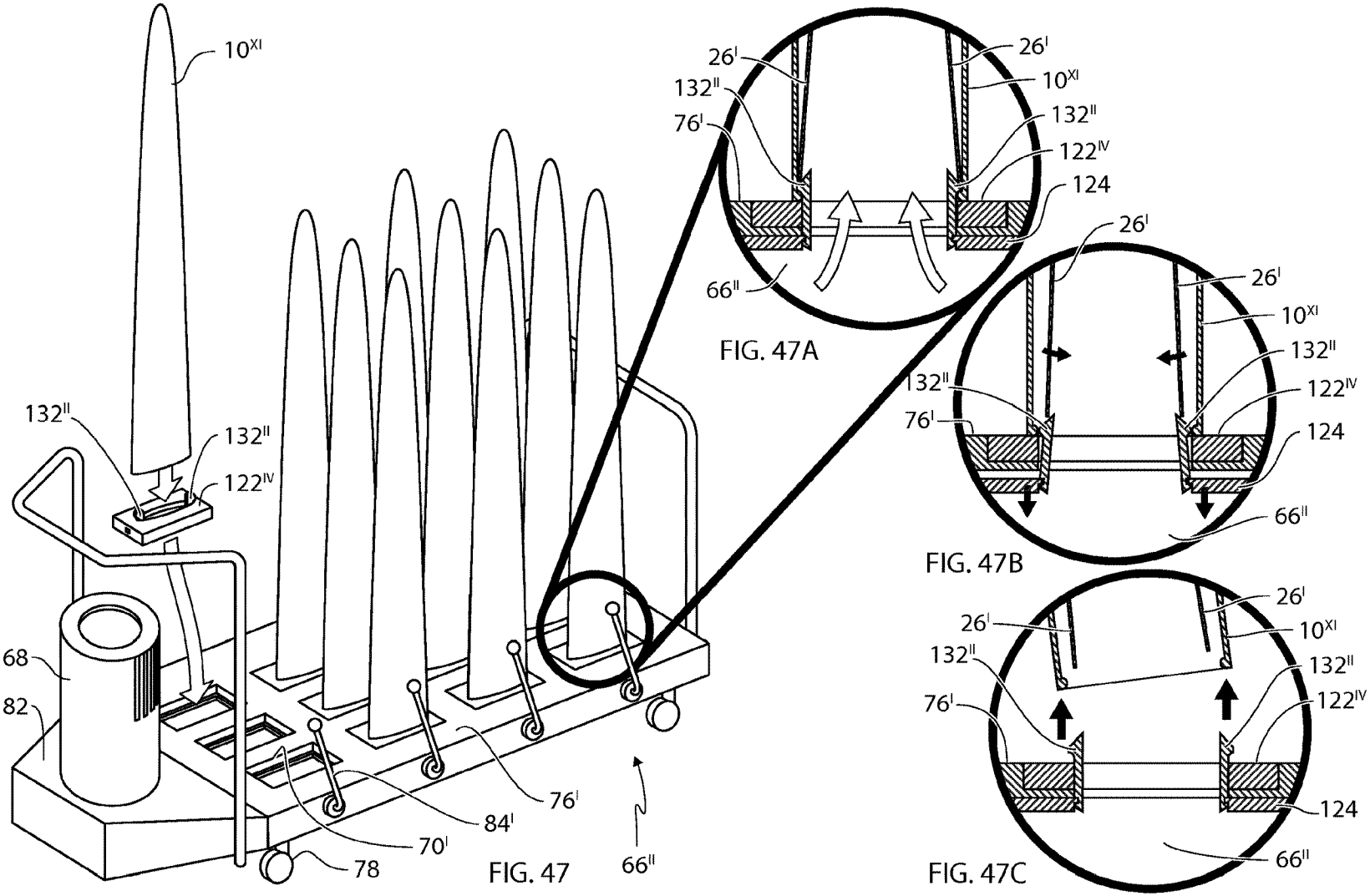
FIG. 47 illustrates, similar to FIG. 46, the universal drying unit with a further alternative adaptor for use with the large entry pelt board of FIGS. 44, 45 and 46, and FIGS. 47A, 47B and 47C illustrate details similar to the details of FIGS. 46A, 46B and 46C, respectively.

In FIG. 47, the technique illustrated in FIG. 45 is slightly modified in that the disconnection of the arresting catchers 132 shown in FIGS. 44A, 45B and 45C by shifting the catchers inwardly, is in FIGS. 47A and 47B modified into a tilting of the catchers, as is illustrated in FIG. 47B, which tilting from FIG. 47A to FIG. 47B is accomplished by shifting the handle 84$^{I}$ of the fourth embodiment of the universal drying unit 66$^{II}$ shown in FIG. 47 to its third position and in doing so, disconnecting the catchers from the inwardly protruding circumferential bead of the inner surface of the pelt board 10$^{XI}$. The tilting catchers shown in FIGS. 47A-47C are designated the reference numeral 132$^{II}$.

Figures 48, 48A, 48B, 48C:
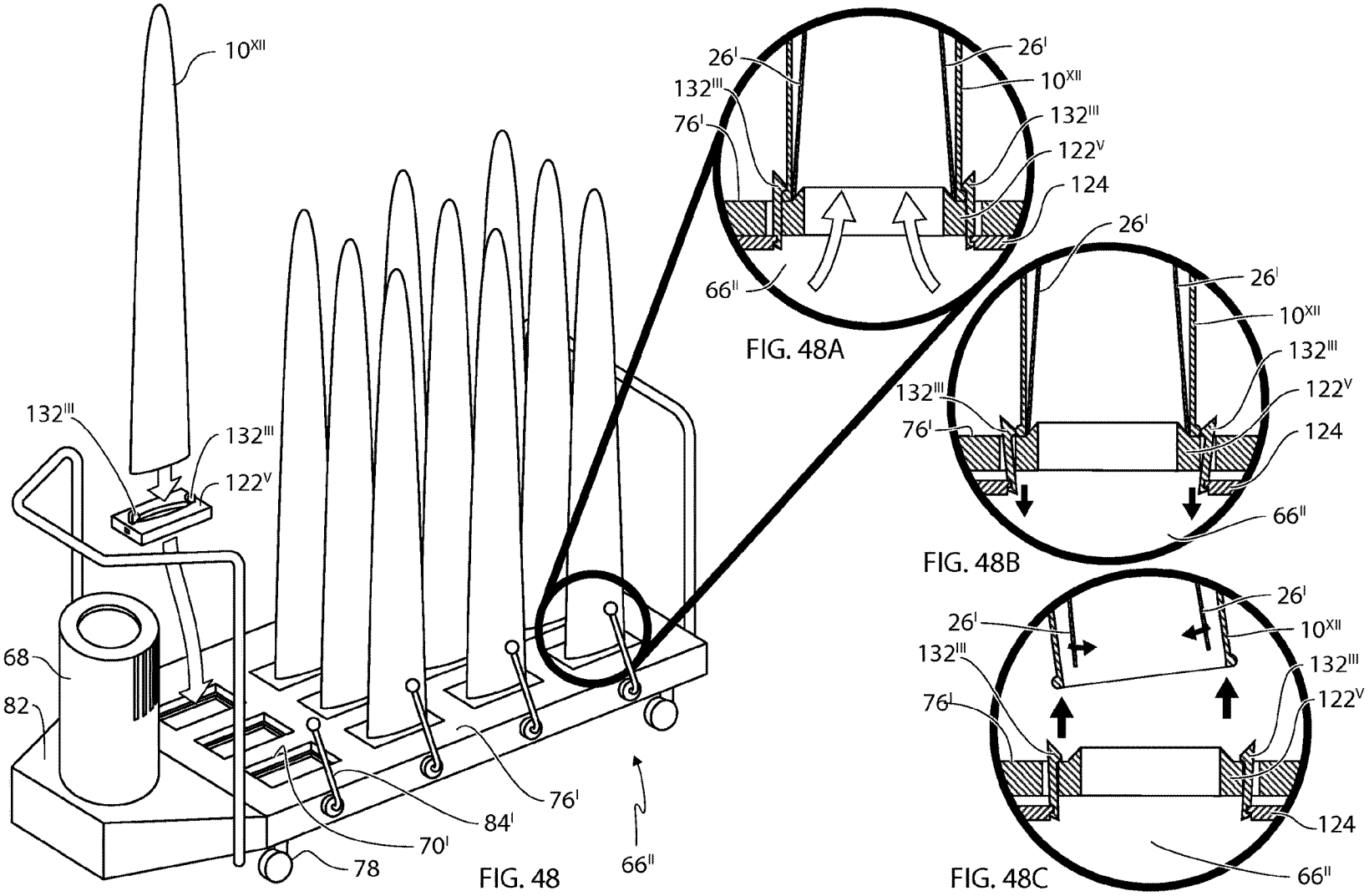
FIG. 48 illustrates, similar to FIG. 47, the universal drying unit with a further alternative adaptor for use with the large entry pelt board of FIGS. 44, 45, 46 and 47, and FIGS. 47A, 47B and 47C illustrate details similar to the details of 47A, 47B and 47C, respectively.

In FIG. 48, a fifth embodiment of the universal drying unit 66$^{V}$ is shown, in which the operation of the handle 84$^{V}$ to its third position establishes a slightly modified function as compared to the function of the outwardly shiftable catchers 132$^{I}$ described above with reference to FIG. 46, as the catchers 132$^{I}$ shown in FIG. 46 are modified in accordance with the technique described above with reference to FIG. 47, as the catchers 132$^{III}$ shown in FIG. 48 are tiltable for causing the catchers to disengage from the outwardly extending circumferential bead of the pelt board 10$^{XII}$.

In FIGS. 49, 50, 51 and 52 are shown a sixth, seventh, eighth and ninth embodiment of the drying unit according to the present invention and designated the reference numeral 66$^{VI}$, 66$^{VII}$, 66$^{VIII}$ and 66$^{IX}$. The sixth, seventh, eighth and ninth embodiments of the drying unit according to the present invention differ from the above described universal drying unit shown in FIGS. 43-46, as the drying units shown in FIGS. 49, 50, 51 and 52 are dedicated to a specific pelt board configuration and implementing the arresting technique described above with reference to FIGS. 45, 46, 47 and 48, respectively. No further description of the sixth, seventh, eighth and ninth embodiments of the drying unit is to be presented.

Figures 53, 53A, 53B:
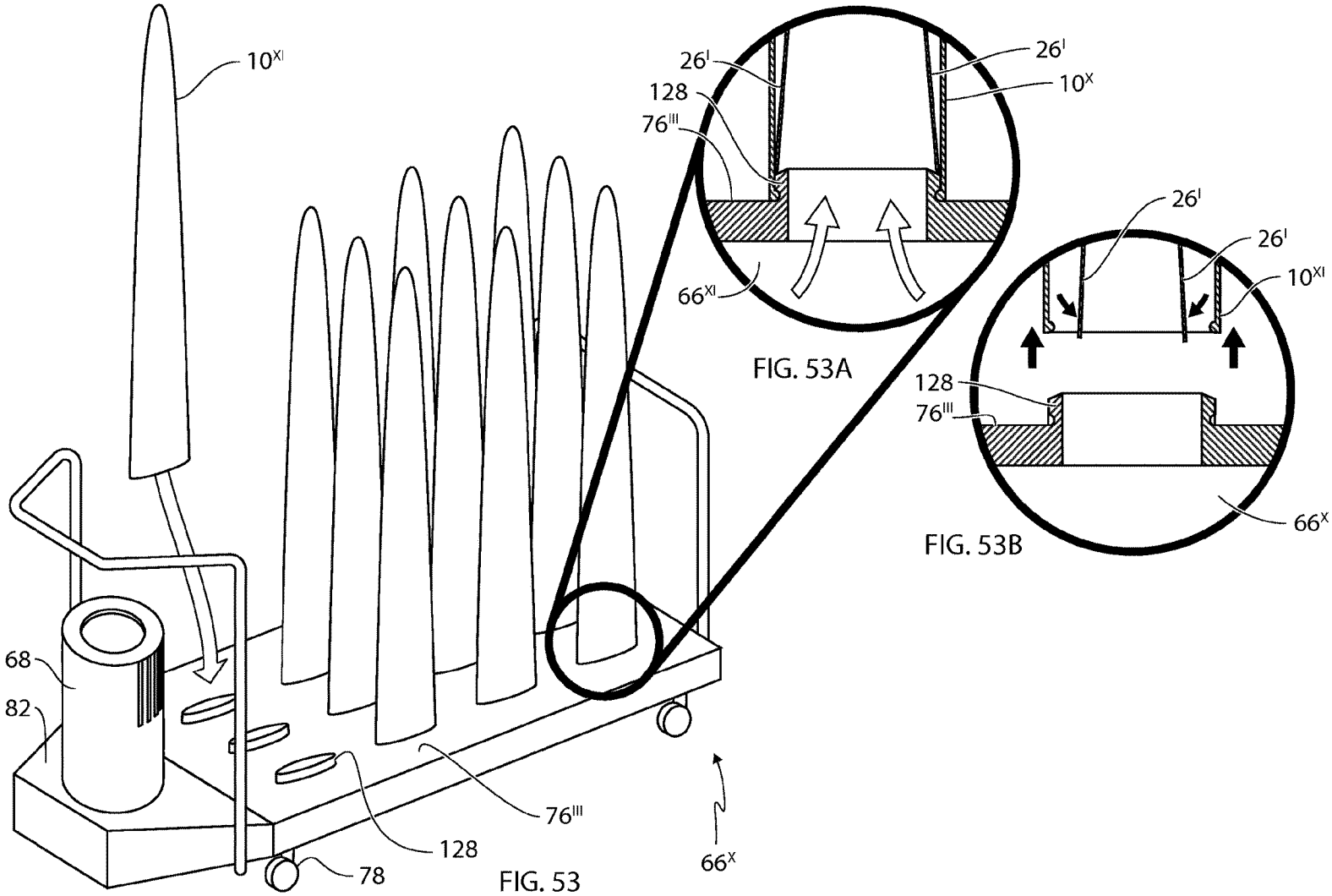
FIG. 53 illustrates a further variant of the drying unit, in which the locking of the large entry pelt board is accomplished by the simple connection of the large entry pelt board to the integral adaptor of the drying unit.
FIGS. 53A and 53B illustrate the details of the connector and the locking and unlocking.
Figures 54, 54A, 54B:
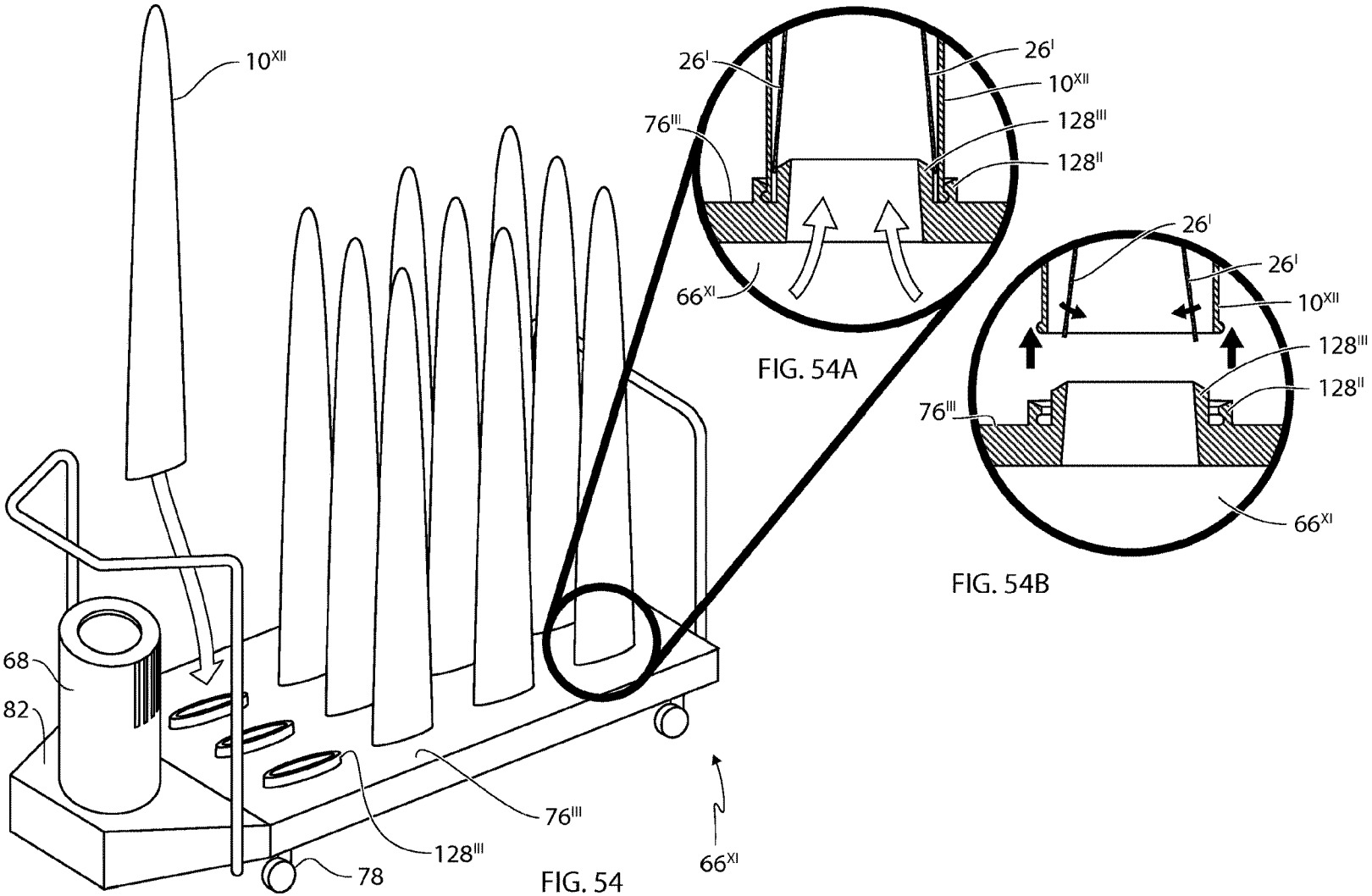
FIG. 54 illustrates a further variant of the drying unit shown in FIG. 53 and FIGS. 54A and 54B illustrate details of the modified connector.

In FIGS. 53 and 54, a tenth and eleventh embodiment of the drying unit according to the present invention is shown, in which tenth embodiment designated the reference numeral 66$^{X}$ is a dedicated drying unit implementing the technique described above with reference to FIG. 44, i.e. a technique according to which the pelt board 10$^{XI}$ is fixated to a fixed circumferential flange 128 by the catching of an inner circumferential bead of the pelt board 10$^{XI}$ within a recess of the flange 128. The eleventh embodiment of the drying unit 66$^{XI}$ shown in FIG. 54 is modified relative to the tenth embodiment shown in FIG. 53 in that the embodiment of FIG. 54 is dedicated for the use with the pelt board 10$^{XII}$ having an outwardly protruding circumferential bead, as is illustrated in FIG. 46 for catching behind an inner circumferential recess of a further upwardly extending flange 128$^{II}$, which is supplemented by an inner circumferential flange 128$^{III}$ serving to cooperate with the actuators 26$^{I}$.

Figures 55, 55A, 55B:
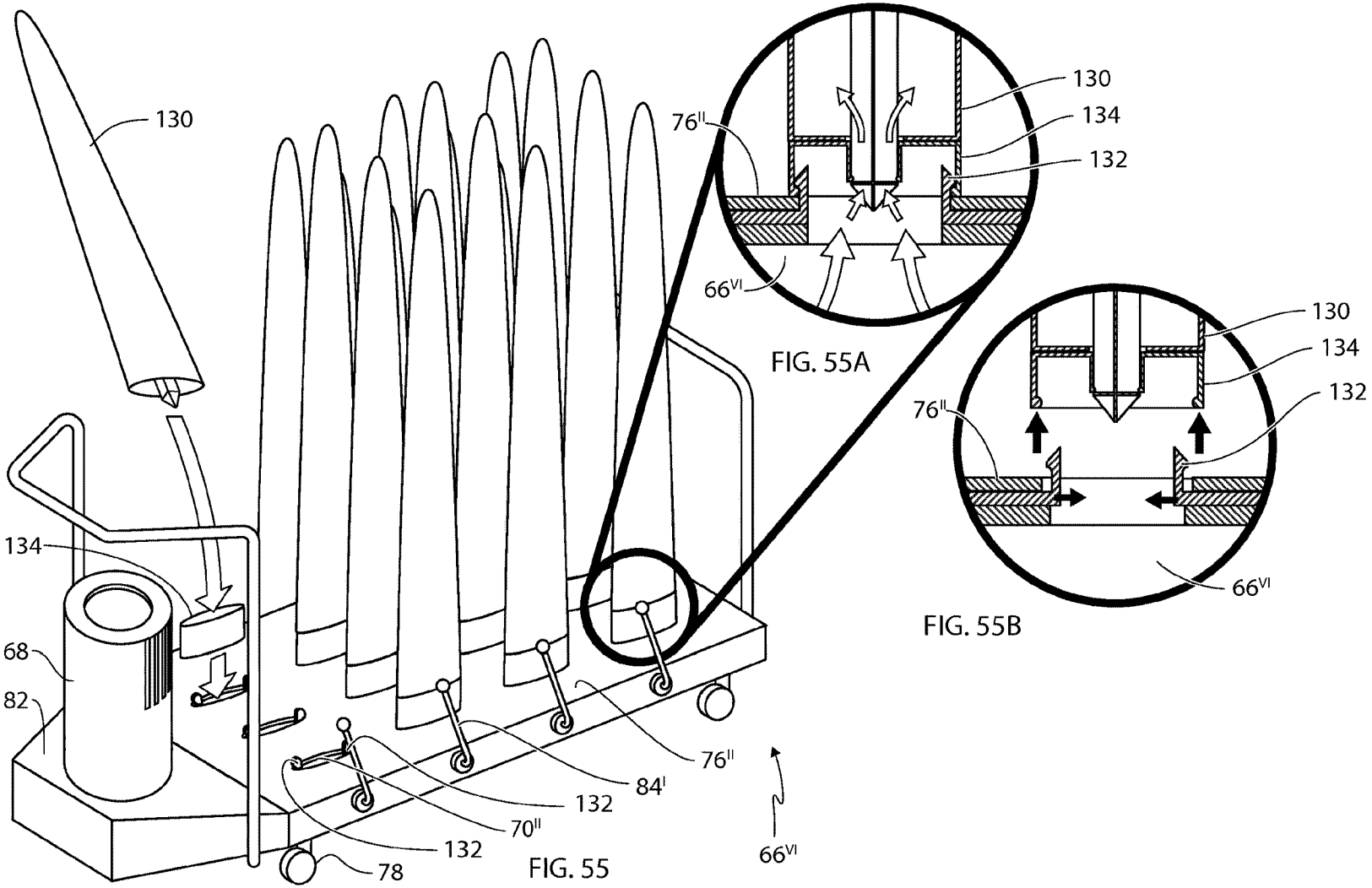
FIG. 55 illustrates the drying unit shown in FIGS. 49-52 including an adaptor for allowing the use of a drying unit in combination with a conventional pelt board.

In FIG. 55, the above described sixth embodiment of the drying unit 66$^{VI}$ is shown in combination with an adaptor allowing the sixth embodiment 66$^{VI}$ of the drying unit according to the present invention to be used in combination with a conventional pelt board 130 of the kind described above and commercially exploited by the applicant company, as the adaptor designated the reference numeral 134 serves to cooperate with the arresting catchers 132 of the drying unit as described above with reference to FIG. 49. The adaptor 134 has a configuration resembling the lower end of the conventional pelt board 130 and also the pelt boards according to the present invention, as the configuration of the pelt boards is as mentioned above determined according to the requirements defined by the company Kopenhagen Fur. The outer peripheral wall of the adaptor 134 consequently constitutes an extension of the wall of the conventional pelt board 130 and has at its lower end an inwardly protruding bead similar to the inwardly protruding bead of the eleventh embodiment of the pelt board 10$^{XI}$ according to the present invention catching with the arresting catchers 132 of the drying unit 66$^{VI}$. The conventional pelt board 130 has a downwardly extending so-called "stubby element" or connector, which is received within a circumferential wall extending downwardly from a top surface of the connector and serving to contact the connector of the conventional pelt board 130 as is illustrated in FIG. 55A.

The disconnection of the assembly of the conventional pelt board 130 and its cooperating adaptor 134 is established as is illustrated in FIG. 55B in the same manner as described above with reference to FIG. 49C.

Figures 49, 49A, 49B, 49C:
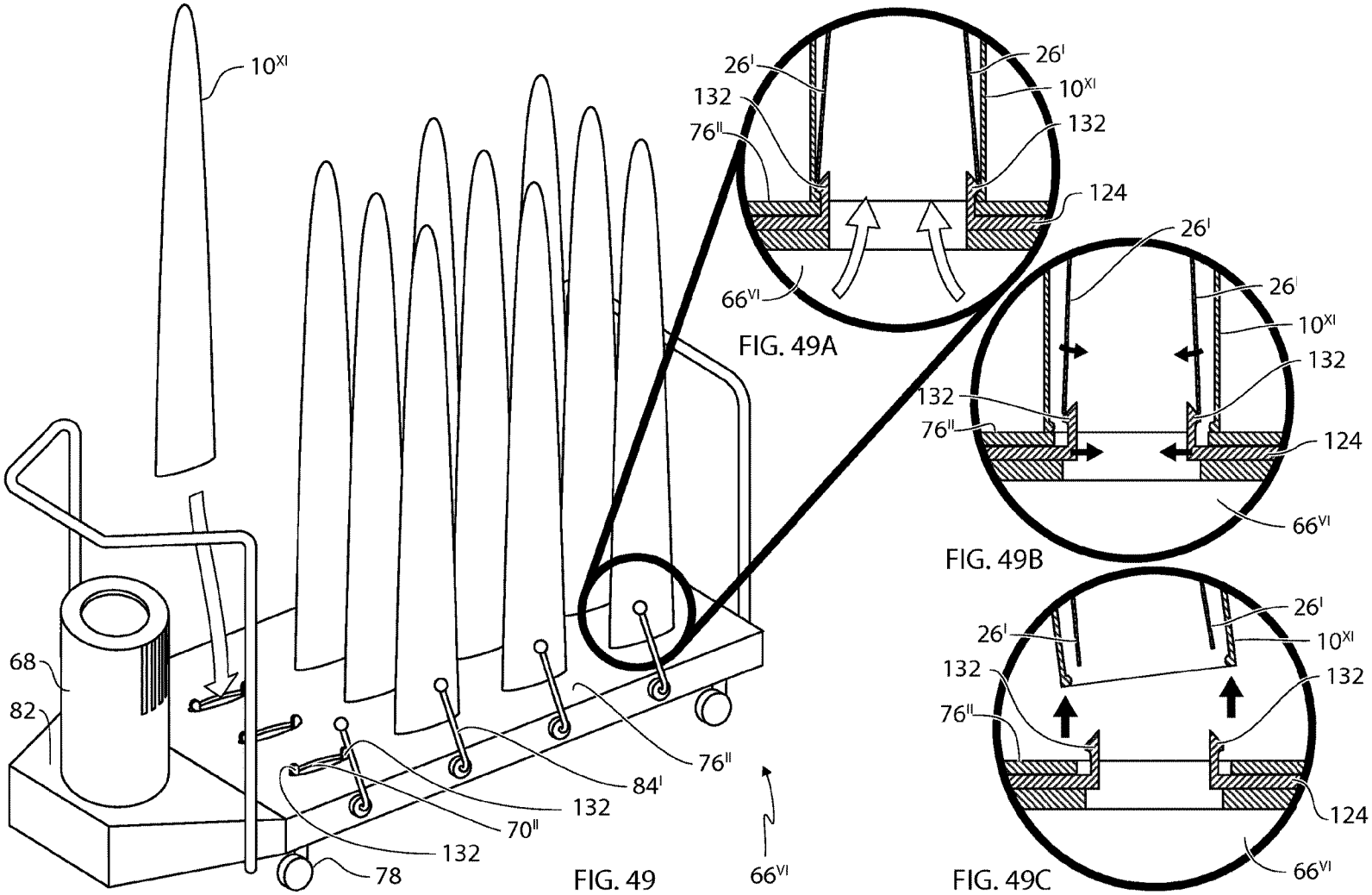
FIG. 49 illustrates a further embodiment of the drying unit for use with the large entry pelt board shown in FIGS. 44, 45, 46, 47 and 48 and FIGS. 49A, 49B and 49C illustrate details of the adaptor identical to the details shown in FIGS. 45A, 45B and 45C, respectively.
Figure 50:
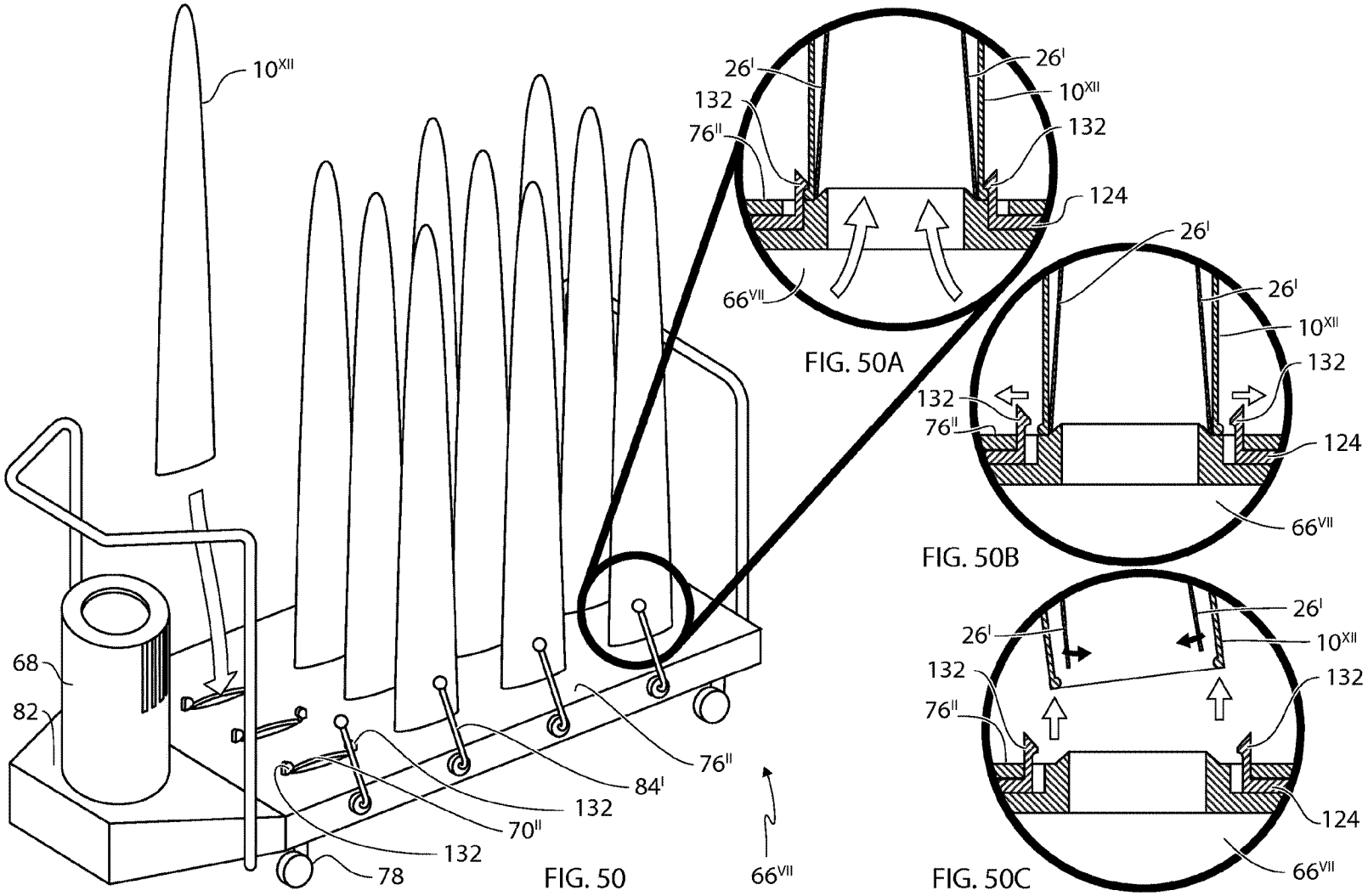
FIG. 50 illustrates a further embodiment of the drying unit for use with the large entry pelt board shown in FIGS. 44, 45, 46, 47, 48 and 49, and FIGS. 50A, 50B and 50C illustrate details of the adaptor identical to the details shown in FIGS. 46A, 46B and 46C, respectively.
Figure 51:
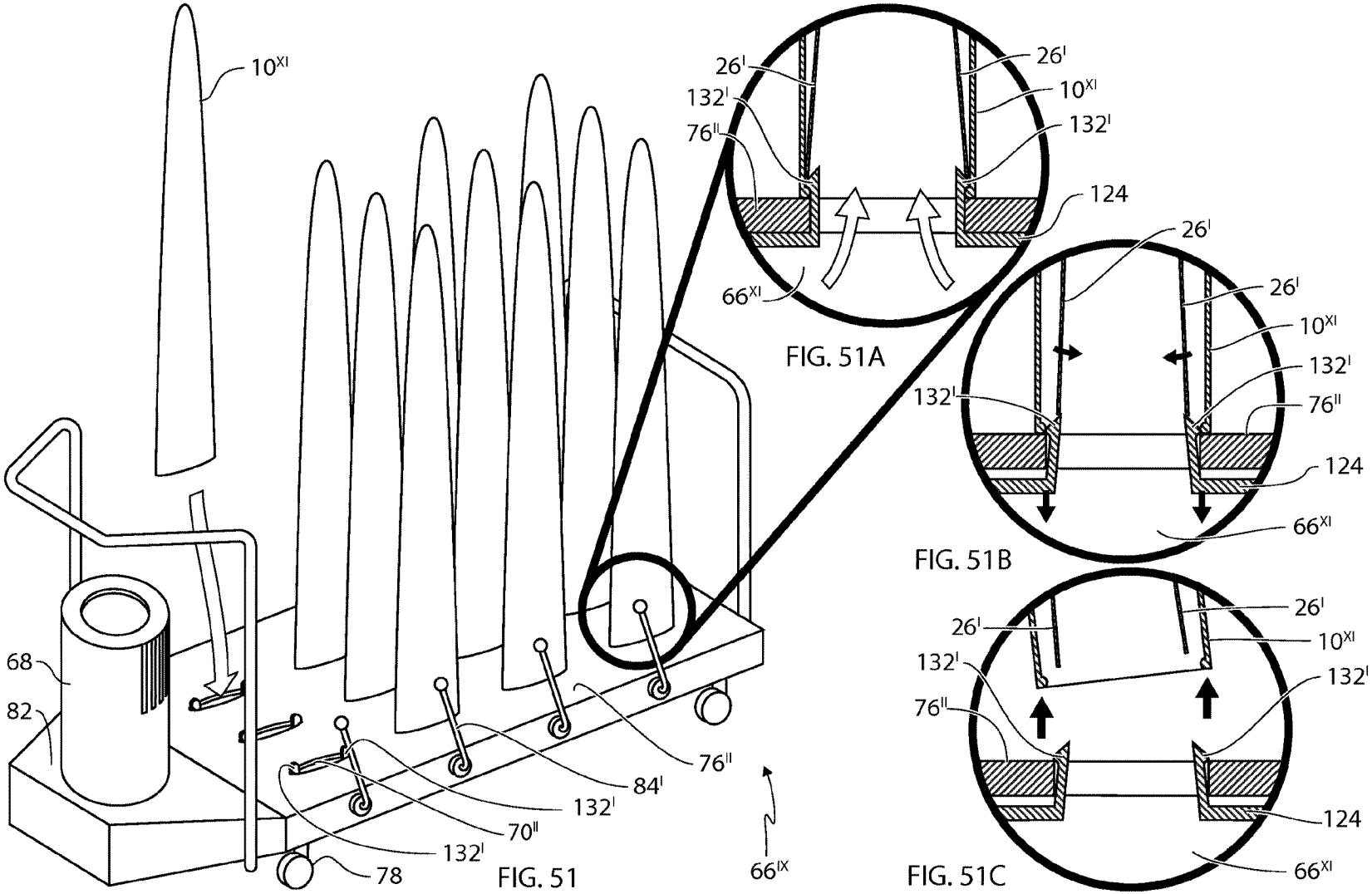
FIG. 51 illustrates a further embodiment of the drying unit for use with the large entry pelt board shown in FIGS. 44, 45, 46, 47, 48, 49 and 50, and FIGS. 51A, 51B and 51C illustrate details of the adaptor identical to the details shown in FIGS. 47A, 47B and 47C, respectively.
Figures 52, 52A, 52B, 52C:
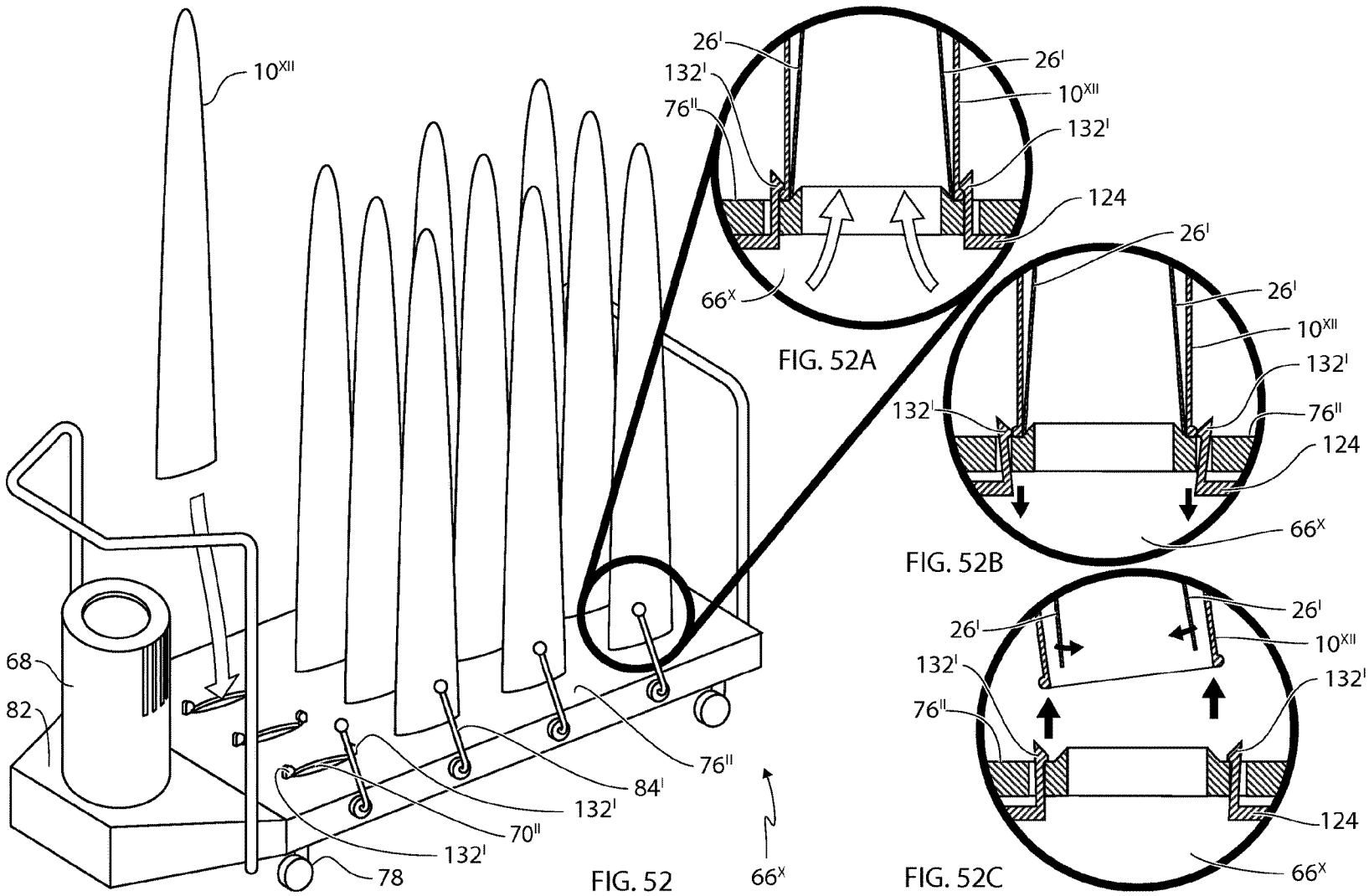
FIG. 52 illustrates a further embodiment of the drying unit for use with the large entry pelt board shown in FIGS. 44, 45, 46, 47, 48, 49, 50 and 51, and FIGS. 52A, 52B and 52C illustrate details of the adaptor identical to the details shown in FIGS. 48A, 48B and 48C, respectively.
Figures 56, 56A, 56B, 56C:
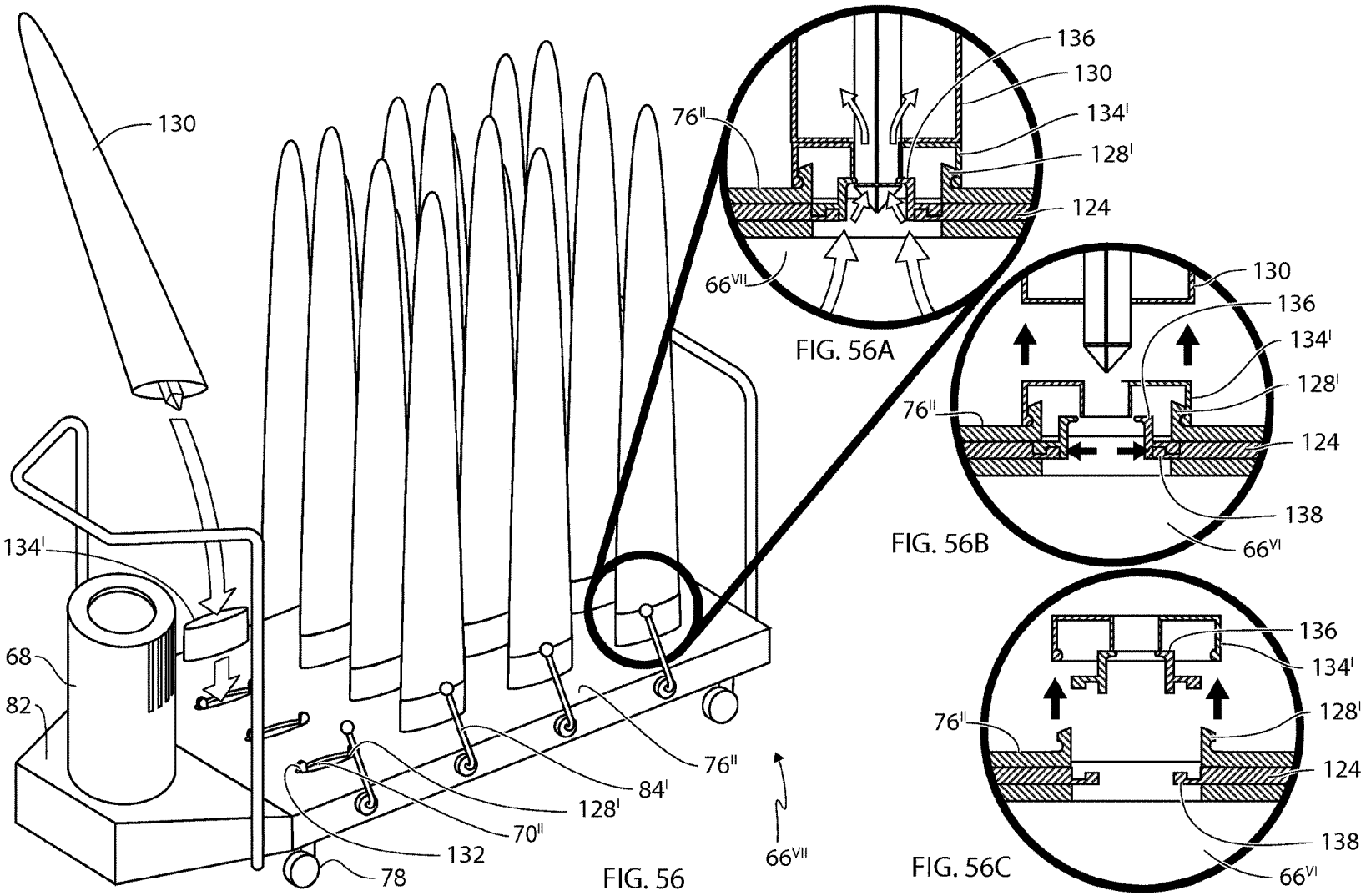
FIG. 56 illustrates the drying unit shown in FIG. 55 including a modified adaptor allowing the separation of the conventional pelt board from the adaptor.

In FIG. 56, a twelfth embodiment 56$^{XII}$ of the drying unit according to the present invention is shown, which drying unit constitutes a combination of the techniques of the tenth embodiment 66$^{X}$ of the drying unit according to the present invention shown in FIG. 53 and the engaging/disengaging technique of the sixth embodiment 66$^{VI}$ of the drying unit according to the version shown in FIG. 49. Whereas in FIG. 55, the adaptor 134 is permanently connected with the conventional pelt board 130, as the adaptor is preferably glued to the lower side surface of the conventional pelt board 130 in order to establish a permanent fixation of the adaptor 134 to the conventional pelt board 130, the technique shown in FIG. 56 allows the conventional pelt board 130 to be disconnected from its cooperating adaptor $134^{I}$ which in itself is fixated to the drying unit in accordance with the technique described above with reference to FIG. 53. The twelfth embodiment $66^{XI}$ of the drying unit includes, as distinct from the above described embodiments, a pair of catching elements 166 serving to be engaged with the cooperating lower end of the connector of the conventional pelt board 130 and catching behind a planar bottom wall of the connector, as is illustrated in FIG. 56A. When the handle $84^{XII}$ of the twelfth embodiment $66^{XII}$ of the drying unit of the present invention is shifted to its third position, the catching elements 166 are retracted for disconnection from the connector of the conventional pelt board 130 and allowing the conventional pelt board 130 to be raised from its position received within the adaptor $134^{I}$ as is illustrated in FIG. 56B. The adaptor $134^{I}$ may itself be disconnected from its arresting contact with the drying unit as is illustrated in FIG. 56C by clicking off the adaptor in accordance with the technique described above with reference to FIG. 53.

The catching elements 136 are, as is illustrated in FIG. 56C raised from the drying unit $66^{XI}$ leaving a pair of inwardly protruding arms 138 free from contact with the catching elements 136. By mounting an alternative embodiment of the adaptor $134^{I}$ onto the click-on coupling with the catching elements 132, the embodiment shown in FIG. 56 may be modified from the technique described with reference to FIG. 53 into the operable disconnection techniques described above with reference to FIGS. 49-52.

Figures 57, 57A:
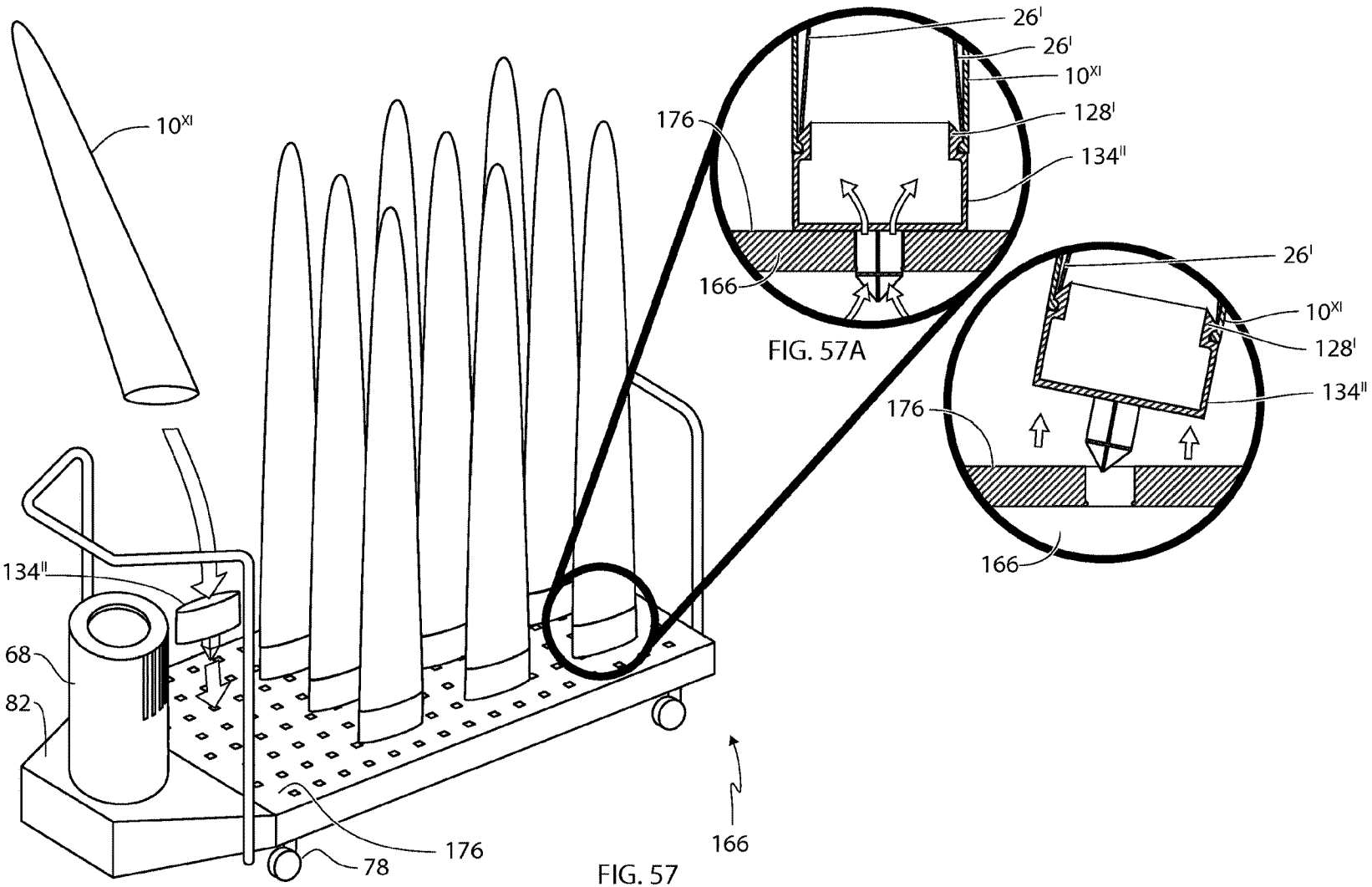
FIG. 57 illustrates a conventional drying unit having a small air outlet aperture and an adaptor allowing the use of the large entry pelt board shown in FIGS. 44-54 to be used in combination with the conventional drying unit.

In order to allow the pelt boards according to the present invention, such as the eleventh and twelfth embodiments of the pelt boards designated the reference numerals $10^{XI}$ and 10 $X^{II}$, respectively, to be used in combination with a conventional drying unit, a further adaptor is deduced in accordance with the teachings of the present invention. In FIG. 57, a conventional drying unit 166 is shown, in which the top plate 76 is provided with fairly small 20 mm×20 mm holes for receiving and fixating the connector of the conventional prior art pelt boards, such as the FIX-tane 2 produced by the applicant company, and the corresponding competitive product of the competitor company Jasopels A/S. The adaptor $134^{II}$ allowing the use of the pelt board according to the present invention in combination with a conventional drying unit 166 may be implemented in accordance with any of the above described catching techniques described with reference to FIGS. 43-54, however, in FIG. 57, the catching and arresting technique described above with reference to FIG. 44, and similarly FIG. 53, is implemented as the adaptor $134^{II}$ is at its upper end provided with a circumferential flange $128^{I}$ having a recess for cooperating with the inwardly protruding bead at the lower end of the pelt board $10^{XI}$. At its bottom end, the adaptor $134^{II}$ is provided with a connector similar to the connector of the conventional or prior art pelt board 130 described above with reference to FIGS. 55 and 56.

Although the present invention has above been described with reference to several advantageous embodiments, it would be evident to a person having ordinary skill in the art that numerous modifications and variants of the above technical disclosure may be deduced without deviating from the overall inventive concept as defined in the appending claims, and it would be evident to a person having ordinary skill in the art to deduce variants of the above described advantageous embodiments by combining the embodiments, i.e. by including features of one embodiment into a different embodiment.

REFERENCE NUMERALS USED IN THE DRAWINGS

10. Pelt board
12. Lower part
14. Upper part
16. First wall element
18. Second wall element
20. Third wall element
22. Fourth wall element
24. Cavity
26. Elongated core element
28. Fifth wall element
30. Sixth wall element
32. Extension element
34. Actuator member
36. Cooperating member
38. Ribs
40. Ventilation holes
42. Snap fit mechanism
44. Peripheral part
46. Fastening member
48. Track
50. Clip-on mechanism
52. Intermediate sections
54. Fixed wall elements
56. Ribs
58. Opening
60. Connecting element
62. First locking protrusion
64. Second locking protrusion
66. Drying unit
68. Ventilator
70. Apertures
72. Shell part
74. Shell part
76. Top plate
78. Wheel
80. Housing
82. Housing extension
84. Handle
86. Locking plate
88. Locking plate
90. Plate
92. Aperture
100. Connector
102. Bottom surface
104. Bottom surface
106. Side wall
108. Side wall
110. Transversal wall
112. Sloping and tapering end wall
114. Sloping and tapering end wall
116. Planar end wall
118. Guiding element
120. Guiding element
122. Adaptor
124. Locking tongues
126. Recess
128. Flange
130. Conventional pelt board
132. Arresting catches
134. Adaptor
136. Catching element First Set of Points Defining Features of the Invention 1. An elongated pelt board for accommodating an animal pelt, said pelt board defining a longitudinal direction, a first radial direction perpendicular to said longitudinal direction and a second radial direction perpendicular to said longitudinal direction and said first radial direction, said pelt board comprising:

a first wall element extending along said longitudinal direction and defining a first outwardly oriented surface, a first inwardly oriented surface, a first set of oppositely located longitudinal edges and a first actuator member, a second wall element extending along said longitudinal direction and defining a second outwardly oriented surface, a second inwardly oriented surface facing said first inwardly oriented surface, a second set of oppositely located longitudinal edges and a second actuator member, said first and second wall elements being spaced apart in said first radial direction, a third wall element extending along said longitudinal direction and defining a third outwardly oriented surface, a third inwardly oriented surface, a third set of oppositely located longitudinal edges and a third actuator member, a fourth wall element extending along said longitudinal direction and defining a fourth outwardly oriented surface, a fourth inwardly oriented surface facing said third inwardly oriented surface, a fourth set of oppositely located longitudinal edges and a fourth actuator member, said third wall element and said fourth wall element being spaced apart in said second radial direction, said first inwardly oriented surface, said second inwardly oriented surface, said third inwardly oriented surface and said fourth inwardly oriented surface together defining a cavity along said longitudinal direction, said first wall element, said second wall element, said third wall element and said fourth wall element defining:

a contracted state in which said first radial distance between said first inwardly oriented surface and said second inwardly oriented surface is reduced, and, said second radial distance between said third inwardly oriented surface and said fourth inwardly oriented surface is reduced, and an expanded state in which said first radial distance between said first inwardly oriented surface and said second inwardly oriented surface is increased, and, said second radial distance between said third inwardly oriented surface and said fourth inwardly oriented surface is increased, and an elongated core element extending within said cavity along said longitudinal direction between a top end and a bottom end and being movable in relation to each of said first wall element, second wall element, third wall element and fourth wall element, said elongated core element comprising a first cooperating member interacting with said first actuator member of said first wall element, a second cooperating member interacting with said second actuator member of said second wall element, a third cooperating member interacting with said third actuator member of said third wall element and a fourth cooperating member interacting with said fourth actuator member of said fourth wall element for allowing said first wall element, said second wall element, said third wall element and said fourth wall element to selectively define said contracted state or said expanded state by moving said elongated core element in said longitudinal direction relative to said first wall element, said second wall element, said third wall element and said fourth wall element.

2. The pelt board according to point 1, wherein when in said contracted state, said first and second sets of oppositely located longitudinal edges overlapping respective edges of said third and fourth sets of oppositely located longitudinal edges or alternatively said third and fourth sets of oppositely located longitudinal edges overlapping respective edges of said first and second sets of oppositely located longitudinal edges, and, when in said expanded state said first and second sets of oppositely located longitudinal edges are substantially flush with respective edges of said third and fourth sets of oppositely located longitudinal edges.

3. The pelt board according to point 2, wherein any of said first wall element, said second wall element, said third wall element and/or said fourth wall element define a central part and a peripheral part, said peripheral part encompassing said set of edges, said central part and said peripheral part being flexibly joined together and when said first wall element, said second wall element, said third wall element and said fourth wall element define said contracted state said peripheral part assume an inwardly oriented position, whereas when said first wall element, said second wall element, said third wall element and said fourth wall element define said expanded state said peripheral part assume an outwardly oriented position.

4. The pelt board according to any of the preceding points, wherein said first actuator member and said second actuator member constitute pins and said first cooperating member and said second cooperating member constitute grooves, e.g. linear or curved grooves, in which said pins are guided between said contracted state and said expanded state, or, wherein said first cooperating member and said second cooperating member constitute pins and said first actuator member and said second actuator member constitute grooves, e.g. linear or curved grooves, in which said pins are guided between said contracted state and said expanded state.

5. The pelt board according to any of the preceding points, wherein said third actuator member and said fourth actuator member constitute wedge members for contacting said third cooperating member and said fourth cooperating member, or, wherein said third cooperating member and said fourth cooperating member constitute wedge members for contacting said third actuator member and said fourth actuator member.

6. The pelt board according to point 5, wherein said third actuator member and said fourth actuator members further engage said cooperating members opposite said elongated core element.

7. The pelt board according to any of the preceding points, wherein any of said first wall element, second wall element, third wall element and fourth wall element comprise ventilation grooves between said cavity and the outside of said pelt board, and/or, wherein said first wall element, said second wall element, said third wall element and said fourth wall element define an opening between said cavity and the outside of said pelt board at said bottom end for allowing ventilation air to enter said cavity, and/or wherein said third wall element and said fourth wall element are fixedly connected at said bottom end.

8. The pelt board according to any of the preceding points, wherein any of said first wall element, second wall element, third wall element and fourth wall element have an arched shape such that any of said first outwardly oriented surface, second outwardly oriented surface, third outwardly oriented surface and fourth outwardly oriented surface define a convex shape.

9. The pelt board according to any of the preceding points, wherein said first wall element defines a first radial edge adjacent said top end of said elongated core, said second wall element comprising a second radial edge adjacent said top edge of said elongated core, said pelt board further comprising:

a fifth wall element adjacent to said first wall element at said first radial edge, said fifth wall element extending along said longitudinal direction and away from said second wall element, said fifth wall element defining a fifth outwardly oriented surface and a fifth actuator member, a sixth wall element adjacent to said second wall element at said second radial edge, said sixth wall element extending along said longitudinal direction and away from said second wall element, said sixth wall element defining a sixth outwardly oriented surface and a sixth actuator member, said fifth and sixth wall elements being spaced apart in said first radial direction, and a core extension element connected to said top end of said elongated core element and extending along said longitudinal direction away from said elongated core element, said core extension element being movable in relation to said fifth wall element and sixth wall element, said core extension element comprising a fifth cooperating member interacting with said fifth actuator member of said fifth wall element and a sixth cooperating member interacting with said sixth actuator member of said sixth wall element for allowing said fifth wall element and said sixth wall element to change between said contracted state and said expanded states by moving said elongated core element and said core extension element in said longitudinal direction relative to said first wall element, said second wall element, said third wall element, said fourth wall element, said fifth wall element and said sixth wall element.

10. The pelt board according to point 9, wherein said third wall element and said fourth wall element comprise opposing extension elements partially enclosing said core extension element.

11. The pelt board according to any of the points 9-10, wherein said pelt board comprises:

a lower section including said first wall element, said second wall element, said third wall element, said fourth wall element and said elongated core element, an upper section comprising said fifth wall element, said sixth wall element and said core extension element, and an intermediate section located between said lower section and said upper section and comprising a core connecting element interconnecting said elongated core element and said core extension element, and a number of substantially elliptic cylindrical elements surrounding said core connecting element.

12. The pelt board according to any of the points 9-11, wherein said fifth cooperating member and said sixth cooperating member constitute pins and said fifth actuator member and said sixth actuator member constitute grooves, e.g. linear or curved grooves, in which said pins are guided between said contracted state and said expanded state, or, said fifth actuator member and said sixth actuator member constitute pins and said fifth cooperating member and said sixth cooperating member constitute grooves, e.g. linear or curved grooves, in which said pins are guided between said contracted state and said expanded state.

13. The pelt board according to any of the point 9-12, wherein said fifth wall element being connected to said first wall element at said first radial edge and said sixth wall element being connected to said second wall element at said second radial edge.

14. The pelt board according to any of the preceding points, wherein said elongated core element comprises a first protrusion adjacent said bottom end, said elongated core element being spring-loaded at said bottom end and defines a centralized relaxed position and a non-centralized loaded position in said first radial direction and/or second radial direction, said first wall element, said second wall element, said third wall element or said fourth wall element comprise a second protrusion cooperating with said first protrusion such that when said first wall element, said second wall element, said third wall element and said fourth wall element define said expanded state and said elongated core element define said centralized related position, said first and second protrusions prevent any longitudinal movement of said elongated core element, whereas when said elongated core element define said non-centralized loaded position, said first and second protrusions allow longitudinal movement of said elongated core element.

15. A method of manufacturing a pelt board for accommodating an animal pelt, said method comprising:

providing a first wall element defining a first outwardly oriented surface, a first inwardly oriented surface, a first set of oppositely located longitudinal edges and a first actuator member, providing a second wall element defining a second outwardly oriented surface, a second inwardly oriented surface, a second set of oppositely located longitudinal edges and a second actuator member, providing a third wall element defining a third outwardly oriented surface, a third inwardly oriented surface, a third set of oppositely located longitudinal edges and a third actuator member, providing a fourth wall element defining a fourth outwardly oriented surface, a fourth inwardly oriented surface, a fourth set of oppositely located longitudinal edges and a fourth actuator member, providing an elongated core element comprising a first cooperating member, a second cooperating member, a third cooperating member and a fourth cooperating member, positioning said first wall element, said second wall element, said third wall element and said fourth wall element along a longitudinal direction such that said first inwardly oriented surface is facing said second inwardly oriented surface and spaced apart along a first radial direction perpendicular to said longitudinal direction, said third inwardly oriented surface facing said fourth inwardly oriented surface and spaced apart along a second radial direction perpendicular to said longitudinal direction and said first radial direction, such that said first inwardly oriented surface, said second inwardly oriented surface, said third inwardly oriented surface and said fourth inwardly oriented surface together define a cavity along said longitudinal direction, interacting said first cooperating member, said second cooperating member, said third cooperating member and said fourth cooperating member with said first actuator member of said first wall element, said second actuator member of said second wall element, said third actuator member of said third wall element and said fourth actuator member of said fourth wall element, respectively, and moving said elongated core element in said longitudinal direction relative to said first wall element, said second wall element, said third wall element and said fourth wall element thereby causing said first wall element, said second wall element, said third wall element and said fourth wall element to move between a contracted state and an expanded state, when in said contracted state said first radial distance and said second radial distance between said first inwardly oriented surface and said second inwardly oriented surface, and, said third inwardly oriented surface and said fourth inwardly oriented surface, respectively, are reduced, whereas, when in said expanded state said first radial distance and said second radial distance between said first inwardly oriented surface and said second inwardly oriented surface, and, said third inwardly oriented surface and said fourth inwardly oriented surface, respectively, are increased.

Second Set of Points Defining Features of the Invention

1. An elongated pelt board for accommodating an animal pelt, said pelt board defining a longitudinal direction, a first radial direction perpendicular to said longitudinal direction and a second radial direction perpendicular to said longitudinal direction and said first radial direction, said pelt board comprising:

a first wall element extending along said longitudinal direction and defining a first outwardly oriented surface, a first inwardly oriented surface, a first set of oppositely located longitudinal edges and a first actuator member, a second wall element extending along said longitudinal direction and defining a second outwardly oriented surface, a second inwardly oriented surface facing said first inwardly oriented surface, a second set of oppositely located longitudinal edges and a second actuator member, said first and second wall elements being spaced apart in said first radial direction, a third wall element extending along said longitudinal direction and defining a third outwardly oriented surface, a third inwardly oriented surface, a third set of oppositely located longitudinal edges and a third actuator member, a fourth wall element extending along said longitudinal direction and defining a fourth outwardly oriented surface, a fourth inwardly oriented surface facing said third inwardly oriented surface, a fourth set of oppositely located longitudinal edges and a fourth actuator member, said third wall element and said fourth wall element being spaced apart in said second radial direction, said first inwardly oriented surface, said second inwardly oriented surface, said third inwardly oriented surface and said fourth inwardly oriented surface together defining a cavity along said longitudinal direction, said first wall element, said second wall element, said third wall element and said fourth wall element defining:

a contracted state in which said first radial distance between said first inwardly oriented surface and said second inwardly oriented surface is reduced, and, said second radial distance between said third inwardly oriented surface and said fourth inwardly oriented surface is reduced, and an expanded state in which said first radial distance between said first inwardly oriented surface and said second inwardly oriented surface is increased, and, said second radial distance between said third inwardly oriented surface and said fourth inwardly oriented surface is increased, and an elongated core element extending within said cavity along said longitudinal direction between a top end and a bottom end and being movable in relation to each of said first wall element, second wall element, third wall element and fourth wall element, said elongated core element comprising a first cooperating member interacting with said first actuator member of said first wall element, a second cooperating member interacting with said second actuator member of said second wall element, a third cooperating member interacting with said third actuator member of said third wall element and a fourth cooperating member interacting with said fourth actuator member of said fourth wall element for allowing said first wall element, said second wall element, said third wall element and said fourth wall element to selectively define said contracted state or said expanded state by moving said elongated core element in said longitudinal direction relative to said first wall element, said second wall element, said third wall element and said fourth wall element.

2. The pelt board according to point 1, wherein when in said contracted state, said first and second sets of oppositely located longitudinal edges overlapping respective edges of said third and fourth sets of oppositely located longitudinal edges or alternatively said third and fourth sets of oppositely located longitudinal edges overlapping respective edges of said first and second sets of oppositely located longitudinal edges, and, when in said expanded state said first and second sets of oppositely located longitudinal edges are substantially flush with respective edges of said third and fourth sets of oppositely located longitudinal edges.

3. The pelt board according to point 2, wherein any of said first wall element, said second wall element, said third wall element and/or said fourth wall element define a central part and a peripheral part, said peripheral part encompassing said set of edges, said central part and said peripheral part being flexibly joined together and when said first wall element, said second wall element, said third wall element and said fourth wall element define said contracted state said peripheral part assume an inwardly oriented position, whereas when said first wall element, said second wall element, said third wall element and said fourth wall element define said expanded state said peripheral part assume an outwardly oriented position.

4. The pelt board according to any of the preceding points, wherein said first actuator member and said second actuator member constitute pins and said first cooperating member and said second cooperating member constitute grooves, e.g. linear or curved grooves, in which said pins are guided between said contracted state and said expanded state, or, wherein said first cooperating member and said second cooperating member constitute pins and said first actuator member and said second actuator member constitute grooves, e.g. linear or curved grooves, in which said pins are guided between said contracted state and said expanded state.

5. The pelt board according to any of the preceding points, wherein said third actuator member and said fourth actuator member constitute wedge members for contacting said third cooperating member and said fourth cooperating member, or, wherein said third cooperating member and said fourth cooperating member constitute wedge members for contacting said third actuator member and said fourth actuator member.

6. The pelt board according to point 5, wherein said third actuator member and said fourth actuator members further engage said cooperating members opposite said elongated core element.

7. The pelt board according to any of the preceding points, wherein any of said first wall element, second wall element, third wall element and fourth wall element comprise ventilation grooves between said cavity and the outside of said pelt board, and/or, wherein said first wall element, said second wall element, said third wall element and said fourth wall element define an opening between said cavity and the outside of said pelt board at said bottom end for allowing ventilation air to enter said cavity, and/or wherein said third wall element and said fourth wall element are fixedly connected at said bottom end.

8. The pelt board according to any of the preceding points, wherein any of said first wall element, second wall element, third wall element and fourth wall element have an arched shape such that any of said first outwardly oriented surface, second outwardly oriented surface, third outwardly oriented surface and fourth outwardly oriented surface define a convex shape.

9. The pelt board according to any of the preceding points, wherein said first wall element defines a first radial edge adjacent said top end of said elongated core, said second wall element comprising a second radial edge adjacent said top edge of said elongated core, said pelt board further comprising:

a fifth wall element adjacent to said first wall element at said first radial edge, said fifth wall element extending along said longitudinal direction and away from said second wall element, said fifth wall element defining a fifth outwardly oriented surface and a fifth actuator member, a sixth wall element adjacent to said second wall element at said second radial edge, said sixth wall element extending along said longitudinal direction and away from said second wall element, said sixth wall element defining a sixth outwardly oriented surface and a sixth actuator member, said fifth and sixth wall elements being spaced apart in said first radial direction, and a core extension element connected to said top end of said elongated core element and extending along said longitudinal direction away from said elongated core element, said core extension element being movable in relation to said fifth wall element and sixth wall element, said core extension element comprising a fifth cooperating member interacting with said fifth actuator member of said fifth wall element and a sixth cooperating member interacting with said sixth actuator member of said sixth wall element for allowing said fifth wall element and said sixth wall element to change between said contracted state and said expanded states by moving said elongated core element and said core extension element in said longitudinal direction relative to said first wall element, said second wall element, said third wall element, said fourth wall element, said fifth wall element and said sixth wall element.

10. The pelt board according to point 9, wherein said third wall element and said fourth wall element comprise opposing extension elements partially enclosing said core extension element.

11. The pelt board according to any of the points 9-10, wherein said pelt board comprises:

a lower section including said first wall element, said second wall element, said third wall element, said fourth wall element and said elongated core element, an upper section comprising said fifth wall element, said sixth wall element and said core extension element, and an intermediate section located between said lower section and said upper section and comprising a core connecting element interconnecting said elongated core element and said core extension element, and a number of substantially elliptic cylindrical elements surrounding said core connecting element.

12. The pelt board according to any of the points 9-11, wherein said fifth cooperating member and said sixth cooperating member constitute pins and said fifth actuator member and said sixth actuator member constitute grooves, e.g. linear or curved grooves, in which said pins are guided between said contracted state and said expanded state, or, said fifth actuator member and said sixth actuator member constitute pins and said fifth cooperating member and said sixth cooperating member constitute grooves, e.g. linear or curved grooves, in which said pins are guided between said contracted state and said expanded state.

13. The pelt board according to any of the point 9-12, wherein said fifth wall element being connected to said first wall element at said first radial edge and said sixth wall element being connected to said second wall element at said second radial edge.

14. The pelt board according to any of the preceding points, wherein said elongated core element comprises a first protrusion adjacent said bottom end, said elongated core element being spring-loaded at said bottom end and defines a centralized relaxed position and a non-centralized loaded position in said first radial direction and/or second radial direction, said first wall element, said second wall element, said third wall element or said fourth wall element comprise a second protrusion cooperating with said first protrusion such that when said first wall element, said second wall element, said third wall element and said fourth wall element define said expanded state and said elongated core element define said centralized related position, said first and second protrusions prevent any longitudinal movement of said elongated core element, whereas when said elongated core element define said non-centralized loaded position, said first and second protrusions allow longitudinal movement of said elongated core element.

15. The elongated pelt board according to any of the preceding points, said first wall element, said second wall element, said third wall element and said fourth wall element further defining a first intermediate state in which said first radial distance between said first inwardly orientated surface and said second inwardly orientated surface is increased as compared to said contracted state.

16. The elongated pelt board according to any of the preceding points, said first wall element, said second wall element, said third wall element and said fourth wall element further defining a second intermediate state in which said second radial distance between third inwardly orientated surface and said fourth inwardly orientated surface is increased as compared to said contracted state.

17. The pelt board according to any of the preceding points, said first wall element defining a first edge among said first set of oppositely located longitudinal edges and said second wall element defining a second edge among said second set of oppositely located longitudinal edges, said first and second edges being positioned adjacent one another, and said first wall element and said second wall element being integrally connected along said first and second edges, and said third wall element defining a third edge among said third set of oppositely located longitudinal edges and said fourth wall element defining a fourth edge among said fourth set of oppositely located longitudinal edges, said third and fourth edges being positioned adjacent one another, and said third wall element and said fourth wall element being integrally connected along said third and fourth edges.

18. The pelt board according to point 17, said first actuator member and said second actuator member being constituted by a single first integral actuator member, and said third actuator member and said fourth actuator member being constituted by a single second integral actuator member.

19 A method of manufacturing a pelt board for accommodating an animal pelt, said method comprising:

providing a first wall element defining a first outwardly oriented surface, a first inwardly oriented surface, a first set of oppositely located longitudinal edges and a first actuator member, providing a second wall element defining a second outwardly oriented surface, a second inwardly oriented surface, a second set of oppositely located longitudinal edges and a second actuator member, providing a third wall element defining a third outwardly oriented surface, a third inwardly oriented surface, a third set of oppositely located longitudinal edges and a third actuator member, providing a fourth wall element defining a fourth outwardly oriented surface, a fourth inwardly oriented surface, a fourth set of oppositely located longitudinal edges and a fourth actuator member, providing an elongated core element comprising a first cooperating member, a second cooperating member, a third cooperating member and a fourth cooperating member, positioning said first wall element, said second wall element, said third wall element and said fourth wall element along a longitudinal direction such that said first inwardly oriented surface is facing said second inwardly oriented surface and spaced apart along a first radial direction perpendicular to said longitudinal direction, said third inwardly oriented surface facing said fourth inwardly oriented surface and spaced apart along a second radial direction perpendicular to said longitudinal direction and said first radial direction, such that said first inwardly oriented surface, said second inwardly oriented surface, said third inwardly oriented surface and said fourth inwardly oriented surface together define a cavity along said longitudinal direction, interacting said first cooperating member, said second cooperating member, said third cooperating member and said fourth cooperating member with said first actuator member of said first wall element, said second actuator member of said second wall element, said third actuator member of said third wall element and said fourth actuator member of said fourth wall element, respectively, and moving said elongated core element in said longitudinal direction relative to said first wall element, said second wall element, said third wall element and said fourth wall element thereby causing said first wall element, said second wall element, said third wall element and said fourth wall element to move between a contracted state and an expanded state, when in said contracted state said first radial distance and said second radial distance between said first inwardly oriented surface and said second inwardly oriented surface, and, said third inwardly oriented surface and said fourth inwardly oriented surface, respectively, are reduced, whereas, when in said expanded state said first radial distance and said second radial distance between said first inwardly oriented surface and said second inwardly oriented surface, and, said third inwardly oriented surface and said fourth inwardly oriented surface, respectively, are increased.

Third Set of Points Defining Features of the Invention

1. An elongated pelt board for accommodating an animal pelt, said pelt board defining a longitudinal direction, a first radial direction perpendicular to said longitudinal direction and a second radial direction perpendicular to said longitudinal direction and said first radial direction, said pelt board comprising:

a first wall element extending along said longitudinal direction and defining a first outwardly oriented surface, a first inwardly oriented surface, a first set of oppositely located longitudinal edges and a first actuator member, a second wall element extending along said longitudinal direction and defining a second outwardly oriented surface, a second inwardly oriented surface facing said first inwardly oriented surface, a second set of oppositely located longitudinal edges and a second actuator member, said first wall element and said second wall element being of identical configuration and each having a low curvature part and a high curvature part joint together along a line of junction extending generally in said longitudinal direction, said low curvature part of said first wall element defining a first longitudinal edge of said first set of oppositely located longitudinal edges, said high curvature part of said first wall element defining a second longitudinal edge of said first set of oppositely located longitudinal edges, said low curvature part of said second wall element defining a first longitudinal edge of said second set of oppositely located longitudinal edges, said high curvature part of said second wall element defining a second longitudinal edge of said second set of oppositely located longitudinal edges, said first edge of said first wall element being positioned juxtaposed said second edge of said second wall element and said first edge of said second wall element being positioned juxtaposed said second edge of said first wall element, said first inwardly oriented surface and said second inwardly oriented surface together defining a cavity along said longitudinal direction, said first wall element and said second wall element defining:

a contracted state in which said first radial distance between said first inwardly oriented surface and said second inwardly oriented surface is reduced, in which said first edge of said first wall element is positioned closely against said second edge of said second wall element, and in which said first edge of said second wall element is positioned closely against said second edge of said first wall element, and an expanded state in which said first radial distance between said first inwardly oriented surface and said second inwardly oriented surface is increased, in which said first edge of said first wall element and said second edge of said second wall element is positioned in spaced apart relationship in said first radial direction, and in which said first edge of said second wall element and said second edge of said first wall element are positioned in spaced apart relationship and said first radial direction and an elongated core element extending within said cavity along said longitudinal direction between a top end and a bottom end and being movable in relation to said first wall element and second wall element, said elongated core element comprising a first cooperating member interacting with said first actuator member of said first wall element and second cooperating member interacting with said second actuator member of said second wall element, for allowing said first wall element and said second wall element, to selectively define said contracted state or said expanded state by moving said elongated core element in said longitudinal direction relative to said first wall element and said second wall element.

2. An elongated pelt board for accommodating an animal pelt, said pelt board defining a longitudinal direction, a first radial direction perpendicular to said longitudinal direction and a second radial direction perpendicular to said longitudinal direction and said first radial direction, said pelt board comprising:

a first wall element extending along said longitudinal direction and defining a first outwardly oriented surface, a first inwardly oriented surface, a first set of oppositely located longitudinal edges and a first actuator member, a second wall element extending along said longitudinal direction and defining a second outwardly oriented surface, a second inwardly oriented surface facing said first inwardly oriented surface, a second set of oppositely located longitudinal edges and a second actuator member, said first wall element and said second wall element being of identical configuration and each having a low curvature part and a high curvature part joint together along a line of junction extending generally in said longitudinal direction, said low curvature part of said first wall element defining a first longitudinal edge of said first set of oppositely located longitudinal edges, said high curvature part of said first wall element defining a second longitudinal edge of said first set of oppositely located longitudinal edges, said low curvature part of said second wall element defining a first longitudinal edge of said second set of oppositely located longitudinal edges, said high curvature part of said second wall element defining a second longitudinal edge of said second set of oppositely located longitudinal edges, said first edge of said first wall element being positioned juxtaposed said second edge of said second wall element and said first edge of said second wall element being positioned juxtaposed said second edge of said first wall element, said first inwardly oriented surface and said second inwardly oriented surface together defining a cavity along said longitudinal direction, said first wall element and said second wall element defining:

a contracted state in which said first radial distance between said first inwardly oriented surface and said second inwardly oriented surface is reduced, in which said first edge of said first wall element is positioned closely against said second edge of said second wall element, and in which said first edge of said second wall element is positioned closely against said second edge of said first wall element, and an expanded state in which said first radial distance between said first inwardly oriented surface and said second inwardly oriented surface is increased, in which said first edge of said first wall element and said second edge of said second wall element is positioned in spaced apart relationship in said second radial direction, and in which said first edge of said second wall element and said second edge of said first wall element are positioned in spaced apart relationship and said second radial direction and an elongated core element extending within said cavity along said longitudinal direction between a top end and a bottom end and being movable in relation to said first wall element and second wall element, said elongated core element comprising a first cooperating member interacting with said first actuator member of said first wall element and second cooperating member interacting with said second actuator member of said second wall element, for allowing said first wall element and said second wall element, to selectively define said contracted state or said expanded state by moving said elongated core element in said longitudinal direction relative to said first wall element and said second wall element.

3. The pelt board according to any of the preceding points, wherein said first actuator member and said second actuator member constitute pins and said first cooperating member and said second cooperating member constitute grooves, e.g. linear or curved grooves, in which said pins are guided between said contracted state and said expanded state, or, wherein said first cooperating member and said second cooperating member constitute pins and said first actuator member and said second actuator member constitute grooves, e.g. linear or curved grooves, in which said pins are guided between said contracted state and said expanded state.

4. The pelt board according to any of the preceding points, wherein said first wall element and said second wall element comprise ventilation grooves between said cavity and the outside of said pelt board.

5. The pelt board according to any of the preceding points, wherein said first wall element and said second wall element define an opening between said cavity and the outside of said pelt board at said bottom end for allowing ventilation air to enter said cavity.

6. The pelt board according to any of the preceding points, wherein said first wall element and said second wall element have an arched shape such that said first outwardly oriented surface and said second outwardly oriented surface define a convex shape.

7. The pelt board according to any of the preceding points, wherein said first wall element defines a first radial edge adjacent said top end of said elongated core and said second wall element defines a second radial edge adjacent said top edge of said elongated core, said pelt board further comprising:

a third wall element adjacent to said first wall element at said first radial edge, said third wall element extending along said longitudinal direction and away from said second wall element, said third wall element defining a third outwardly oriented surface and a third actuator member, a fourth wall element adjacent to said second wall element at said second radial edge, said fourth wall element extending along said longitudinal direction and away from said second wall element, said fourth wall element defining a fourth outwardly oriented surface and a fourth actuator member, said third and fourth wall elements being spaced apart in said first radial direction, and a core extension element connected to said top end of said elongated core element and extending along said longitudinal direction away from said elongated core element, said core extension element being movable in relation to said third wall element and fourth wall element, said core extension element comprising a third cooperating member interacting with said third actuator member of said third wall element and a fourth cooperating member interacting with said fourth actuator member of said fourth wall element for allowing said third wall element and said fourth wall element to change between said contracted state and said expanded states by moving said elongated core element and said core extension element in said longitudinal direction relative to said first wall element, said second wall element, said third wall element and said fourth wall element.

8. The pelt board according to point 7, said first wall element and said third wall element being constituted by a first unitary wall element structure, said second wall element and said fourth wall element being constituted by a second unitary wall element structure and said core element and said core extension element being constituted by a single unitary core element structure.

9. The pelt board according to any of the points 7-8, wherein said pelt board comprises:

a lower section including said first wall element and said second wall element and said elongated core element, an upper section comprising said third wall element, said fourth wall element and said core extension element, and an intermediate section located between said lower section and said upper section and comprising a core connecting element interconnecting said elongated core element and said core extension element.

10. The pelt board according to any of the point 7-9, wherein said third wall element being connected to said first wall element at said first radial edge and said fourth wall element being connected to said second wall element at said second radial edge.

11. The pelt board according to any of the points 7-9, wherein said third cooperating member and said fourth cooperating member constitute pins and said third actuator member and said fourth actuator member constitute grooves, e.g. linear or curved grooves, in which said pins are guided between said contracted state and said expanded state, or wherein said third actuator member and said fourth actuator member constitute pins and said third cooperating member and said fourth cooperating member constitute grooves, e.g. linear or curved grooves, in which said pins are guided between said contracted state and said expanded state.

12. The pelt board according to any of the preceding points, wherein said elongated core element comprises a first protrusion adjacent said bottom end, said elongated core element being spring-loaded at said bottom end and defines a centralized relaxed position and a non-centralized loaded position in said first radial direction and/or second radial direction, said first wall element and said second wall element comprise a second protrusion cooperating with said first protrusion such that when said first wall element and said second wall element define said expanded state and said elongated core element define said centralized related position, said first and second protrusions prevent any longitudinal movement of said elongated core element, whereas when said elongated core element define said non-centralized loaded position, said first and second protrusions allow longitudinal movement of said elongated core element.

13. A method of manufacturing a pelt board for accommodating an animal pelt, said method comprising:

providing a first wall element defining a first outwardly oriented surface, a first inwardly oriented surface, a first set of oppositely located longitudinal edges and a first actuator member, providing a second wall element defining a second outwardly oriented surface, a second inwardly oriented surface, a second set of oppositely located longitudinal edges and a second actuator member, said first wall element and said second wall element being of identical configuration and each having a low curvature part and a high curvature part joint together along a line of junction extending generally in said longitudinal direction, said low curvature part of said first wall element defining a first longitudinal edge of said first set of oppositely located longitudinal edges, said high curvature part of said first wall element defining a second longitudinal edge of said first set of oppositely located longitudinal edges, said low curvature part of said second wall element defining a first longitudinal edge of said second set of oppositely located longitudinal edges, said high curvature part of said second wall element defining a second longitudinal edge of said second set of oppositely located longitudinal edges, said first edge of said first wall element being positioned juxtaposed said second edge of said second wall element and said first edge of said second wall element being positioned juxtaposed said second edge of said first wall element, said first inwardly oriented surface and said second inwardly oriented surface together defining a cavity along said longitudinal direction, providing an elongated core element comprising a first cooperating member and a second cooperating member, positioning said first wall element and said second wall element along a longitudinal direction such that said first inwardly oriented surface is facing said second inwardly oriented surface and spaced apart along a first radial direction perpendicular to said longitudinal direction, such that said first inwardly oriented surface and said second inwardly oriented surface together define a cavity along said longitudinal direction, interacting said first cooperating member and said second cooperating member with said first actuator member of said first wall element and said second actuator member of said second wall element, respectively, and moving said elongated core element in said longitudinal direction relative to said first wall element and said second wall element causing said first wall element and said second wall element to move between a contracted state in which said first radial distance between said first inwardly oriented surface and said second inwardly oriented surface is reduced, in which said first edge of said first wall element is positioned closely against said second edge of said second wall element, and in which said first edge of said second wall element is positioned closely against said second edge of said first wall element, and an expanded state in which said first radial distance between said first inwardly oriented surface and said second inwardly oriented surface is increased, in which said first edge of said first wall element and said second edge of said second wall element is positioned in spaced apart relationship in said first radial direction, and in which said first edge of said second wall element and said second edge of said first wall element are positioned in spaced apart relationship and said first radial direction.

14. A method of manufacturing a pelt board for accommodating an animal pelt, said method comprising:

providing a first wall element defining a first outwardly oriented surface, a first inwardly oriented surface, a first set of oppositely located longitudinal edges and a first actuator member, providing a second wall element defining a second outwardly oriented surface, a second inwardly oriented surface, a second set of oppositely located longitudinal edges and a second actuator member, said first wall element and said second wall element being of identical configuration and each having a low curvature part and a high curvature part joint together along a line of junction extending generally in said longitudinal direction, said low curvature part of said first wall element defining a first longitudinal edge of said first set of oppositely located longitudinal edges, said high curvature part of said first wall element defining a second longitudinal edge of said first set of oppositely located longitudinal edges, said low curvature part of said second wall element defining a first longitudinal edge of said second set of oppositely located longitudinal edges, said high curvature part of said second wall element defining a second longitudinal edge of said second set of oppositely located longitudinal edges, said first edge of said first wall element being positioned juxtaposed said second edge of said second wall element and said first edge of said second wall element being positioned juxtaposed said second edge of said first wall element, said first inwardly oriented surface and said second inwardly oriented surface together defining a cavity along said longitudinal direction, providing an elongated core element comprising a first cooperating member and a second cooperating member, positioning said first wall element and said second wall element along a longitudinal direction such that said first inwardly oriented surface is facing said second inwardly oriented surface and spaced apart along a first radial direction perpendicular to said longitudinal direction, such that said first inwardly oriented surface and said second inwardly oriented surface together define a cavity along said longitudinal direction, interacting said first cooperating member and said second cooperating member with said first actuator member of said first wall element and said second actuator member of said second wall element, respectively, and moving said elongated core element in said longitudinal direction relative to said first wall element and said second wall element causing said first wall element and said second wall element to move between a contracted state in which said first radial distance between said first inwardly oriented surface and said second inwardly oriented surface is reduced, in which said first edge of said first wall element is positioned closely against said second edge of said second wall element, and in which said first edge of said second wall element is positioned closely against said second edge of said first wall element, and an expanded state in which said first radial distance between said first inwardly oriented surface and said second inwardly oriented surface is increased, in which said first edge of said first wall element and said second edge of said second wall element is positioned in spaced apart relationship in said second radial direction, and in which said first edge of said second wall element and said second edge of said first wall element are positioned in spaced apart relationship and said first radial direction.

Fourth Set of Points Defining Features of the Invention

1. A drying unit and an adapter, said drying unit comprising a plurality of apertures and a ventilator for producing a stream of ventilation air through each of said apertures, said adapter comprising a first interface defining a first opening for accommodating a pelt board, and a second interface defining a second opening for connecting to said aperture of said drying unit.
2. The drying unit and adapter according to point 1, wherein said drying unit comprises a pin at each of said apertures for locking said adapter at said second interface.
3. A drying unit and an adapter according to any of the points 1 or 2, wherein said second opening is larger than or equal to said first opening.
4. A drying unit, said drying unit comprising a plurality of apertures and a ventilator for producing a stream of ventilation air through each of said apertures, said drying unit comprising a pin at each of said apertures for locking an adapter at said aperture.
5. An adapter comprising a first interface defining a first opening for accommodating a pelt board, and a second interface defining a second opening for connecting to an aperture of a drying unit, said second opening being larger than or equal to said first opening.

The invention claimed is:

1. A pelt board for use in combination with a drying unit for drying a pelt, said pelt having a substantially tubular shape defining an inwardly oriented leather side and an outwardly oriented fur side and further defining a nose end and a rear end, said pelt board comprising:

a top end configured for accommodating and fixing said nose end of said pelt;

a bottom end opposite said top end, said bottom end defining a bottom end area of said pelt board;

a circumferential and apertured wall defining an inner cavity and an outer surface configured for facing said leather side of said pelt;

a connector extending outwardly from said bottom end and adapted for connecting said pelt board to said drying unit; and an air inlet in said inner cavity at said bottom end of said pelt board and configured for introducing air from said drying unit into said inner cavity so as to be directed out of said inner cavity through said apertured wall, said air inlet defining an inlet area constituting between 15% and 95% of said bottom area of said pelt board.

2. The pelt board according to claim 1, wherein said air inlet is divided into sub air inlets circumferentially encircling said connector.

3. The pelt board according to claim 1, wherein said connector includes inlet slots configured for introducing air from said drying unit into said inner cavity.

4. The pelt board according to claim 1, wherein the pelt board defines a longitudinal direction, a first radial direction perpendicular to the longitudinal direction and a second radial direction perpendicular to the longitudinal direction and the first radial direction, and wherein the pelt board further comprises:

a first wall element extending along the longitudinal direction and defining a first outwardly oriented surface, a first inwardly oriented surface, a first set of oppositely located longitudinal edges, and a first actuator member;

a second wall element extending along the longitudinal direction and defining a second outwardly oriented surface, a second inwardly oriented surface facing the first inwardly oriented surface, a second set of oppositely located longitudinal edges, and a second actuator member;

the first wall element and the second wall element each having a low curvature part and a high curvature part joined together along a junction line extending generally in the longitudinal direction;

the low curvature part of the first wall element defining a first longitudinal edge of the first set of oppositely located longitudinal edges, the high curvature part of the first wall element defining a second longitudinal edge of the first set of oppositely located longitudinal edges, the low curvature part of the second wall element defining a first longitudinal edge of the second set of oppositely located longitudinal edges, the high curvature part of the second wall element defining a second longitudinal edge of the second set of oppositely located longitudinal edges, the first edge of the first wall element being juxtaposed with the second edge of the second wall element, and the first edge of the second wall element being juxtaposed with the second edge of the first wall element, the first inwardly oriented surface and the second inwardly oriented surface together defining a cavity along the longitudinal direction; and a core element extending within the cavity along the longitudinal direction, the core element having a top end and a bottom end, the core element being movable in relation to the first wall element and the second wall element, the core element comprising a first cooperating member interacting with the first actuator member of the first wall element, and a second cooperating member interacting with the second actuator member of the second wall element;

wherein the first wall element and the second wall element define (a) a contracted state in which the first radial distance between the first inwardly oriented surface and the second inwardly oriented surface is reduced, in which the first edge of the first wall element is positioned against the second edge of the second wall element, and in which the first edge of the second wall element is positioned against the second edge of the first wall element; and (b) an expanded state in which the first radial distance between the first inwardly oriented surface and the second inwardly oriented surface is increased, in which the first edge of the first wall element and the second edge of the second wall element are positioned in spaced apart relationship in the first radial direction, and in which the first edge of the second wall element and the second edge of the first wall element are positioned in spaced apart relationship in the first radial direction; and wherein the first wall element and the second wall element are selectively moveable between the contracted state and the expanded state by moving the core element in the longitudinal direction relative to the first wall element and the second wall element.

5. The pelt board according to claim 4, wherein each of the first actuator member and the second actuator member includes pins, wherein each of the first cooperating member and the second cooperating member includes a groove in which one of the pins is guided when the first wall element and the second wall element are moved between the contracted state and the expanded state.

6. The pelt board according to claim 4, wherein each of the first cooperating member and the second cooperating member includes pins, and wherein each of the first actuator member and the second actuator member includes a groove in which one of the pins is guided when the first wall element and the second wall element are moved between the contracted state and the expanded state.

7. The pelt board according to claim 4, wherein each of the first wall element and the second wall element includes ventilation grooves between the cavity and the outside of the pelt board.

8. The pelt board according to claim 4, wherein the first wall element and the second wall element define an opening between the cavity and the outside of the pelt board at the bottom end of the pelt board, the opening being configured for allowing ventilation air to enter the cavity.

9. The pelt board according to claim 4, wherein each of the first wall element and the second wall element has an arched shape, such that the first outwardly oriented surface and the second outwardly oriented surface define a convex shape.

10. The pelt board according to claim 4, wherein the first wall element defines a first radial edge adjacent the top end of the core element, and wherein the second wall element defines a second radial edge adjacent the top end of the core element, the pelt board further comprising:

a third wall element adjacent to the first wall element at the first radial edge, the third wall element extending along the longitudinal direction and away from the second wall element, the third wall element defining a third outwardly oriented surface and a third actuator member;

a fourth wall element adjacent to the second wall element at the second radial edge, the fourth wall element extending along the longitudinal direction away from the second wall element, the fourth wall element defining a fourth outwardly oriented surface and a fourth actuator member, the third wall element and the fourth wall element being spaced apart in the first radial direction; and a core extension element connected to the top end of the core element and extending along the longitudinal direction away from the core element, the core extension element being movable in relation to the third wall element and the fourth wall element, the core extension element comprising a third cooperating member interacting with the third actuator member of the third wall element, and a fourth cooperating member interacting with the fourth actuator member of the fourth wall element, whereby the third wall element and the fourth wall element are movable between the contracted state and the expanded state by moving the core element and the core extension element in the longitudinal direction relative to the first wall element, the second wall element, the third wall element, and the fourth wall element.

11. The pelt board according to claim 10, wherein the first wall element and the third wall element are provided by a first unitary wall element structure, wherein the second wall element and the fourth wall element are provided by a second unitary wall element structure, and wherein the core element and the core extension element are provided by a unitary core element structure.

12. The pelt board according to claim 10, wherein the pelt board further comprises:

a lower section including the first wall element, the second wall element, and the core element;

an upper section including the third wall element, the fourth wall element, and the core extension element; and an intermediate section located between the lower section and the upper section and comprising a core connecting element interconnecting the core element and the core extension element.

13. The pelt board according to claim 10, wherein the third wall element is connected to the first wall element at the first radial edge, and the fourth wall element is connected to the second wall element at the second radial edge.

14. The pelt board according to claim 10, wherein each of the third cooperating member and the fourth cooperating member includes pins, and wherein each of the third actuator member and the fourth actuator member includes a groove in which one of the pins is guided when the third wall element and the fourth wall element are moved between the contracted state and the expanded state.

15. The pelt board according to claim 10, wherein each of the third actuator member and the fourth actuator member includes pins, and wherein each of the third cooperating member and the fourth cooperating member includes a groove in which one of the pins is guided when the third wall element and the fourth wall element are moved between the contracted state and the expanded state.

16. The pelt board according to claim 4, wherein the core element comprises a first protrusion adjacent the bottom end of the core element, wherein the core element is spring-loaded at the bottom end of the core element and defines a centralized relaxed position and a non-centralized loaded position in at least one of the first radial direction and the second radial direction, wherein each of the first wall element and the second wall element comprises a second protrusion cooperating with the first protrusion, such that when the first wall element and the second wall element are in the expanded state and the core element defines the centralized relaxed position, the first and second protrusions prevent any longitudinal movement of the core element, and wherein, when the core element defines the non-centralized loaded position, the first and second protrusions allow longitudinal movement of the core element.

* * * * *